US006702427B2

(12) United States Patent
Shimizu et al.

(10) Patent No.: US 6,702,427 B2
(45) Date of Patent: Mar. 9, 2004

(54) LIQUID CONTAINER AND RECORDING APPARATUS

(75) Inventors: Eiichiro Shimizu, Kanagawa (JP); Hajime Yamamoto, Kanagawa (JP); Takeshi Kono, Kanagawa (JP); Shinichi Miyauchi, Kanagawa (JP); Yoshihiko Sugimura, Saitama (JP); Nobuyuki Hatasa, Kanagawa (JP); Hiroshi Koshikawa, Kanagawa (JP); Tatsuo Nanjo, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 170 days.

(21) Appl. No.: 10/067,222

(22) Filed: Feb. 7, 2002

(65) Prior Publication Data

US 2002/0109761 A1 Aug. 15, 2002

(30) Foreign Application Priority Data

Feb. 9, 2001 (JP) ..... 2001-033563
Feb. 9, 2001 (JP) ..... 2001-033633
Feb. 5, 2002 (JP) ..... 2002-028420

(51) Int. Cl.[7] ..... B41J 2/14; B41J 2/175
(52) U.S. Cl. ..... 347/50; 347/86
(58) Field of Search ..... 347/50, 19, 49, 347/85–87; 439/248, 247

(56) References Cited

U.S. PATENT DOCUMENTS 5,318,455 A * 6/1994 Villiers et al. ..... 439/248
5,523,780 A * 6/1996 Hirosawa et al. ..... 347/86
5,992,975 A 11/1999 Gasvoda et al. ..... 347/50
6,074,042 A 6/2000 Gasvoda et al. ..... 347/50
6,130,695 A 10/2000 Childers et al. ..... 347/85
6,183,077 B1 2/2001 Hmelar et al. ..... 347/86
2001/0033306 A1 10/2001 Hatasa et al. ..... 347/19
2001/0033315 A1 10/2001 Hatasa et al. ..... 347/86
2002/0122103 A1 9/2002 Yamamoto et al. ..... 347/85

* cited by examiner

*Primary Examiner*—Judy Nguyen
(74) *Attorney, Agent, or Firm*—Fitzpatrick, Cella, Harper & Scinto

(57) ABSTRACT

The invention is to connect a liquid container, having a fluid connecting portion and an information memory medium, to the main body of a recording apparatus without generating stress in both connecting portions. An information memory medium is fixed on the internal wall of a connection aperture of an information memory medium holder, which is contained in a space defined by an information memory medium holder containing portion and a bottom cover. The space is of a size capable of containing the information memory medium holder without contact thereto, and the information memory medium holder can change its position and direction in the space. The changes in the position and direction of the information memory medium holder allow to achieve fluid connection and connection of the information memory medium without generating stress in the connecting portions thereof, even if the fluid connecting portion and the connecting portion for the information memory medium in the main body of the recording apparatus have certain aberration in the relative position and relative direction.

39 Claims, 38 Drawing Sheets

LIQUID CONTAINER AND RECORDING APPARATUS

BACKGROUND OF THE INVENTION

1. Field of the Invention

The present invention relates to a liquid container adapted for use as an ink tank or the like for an ink jet recording apparatus and detachably mountable to the main body of a recording apparatus, and a recording apparatus in which such liquid container is mountable.

2. Related Background Art

The ink jet recording is a recording method of discharging an ink droplet from a minute discharge port provided in an ink jet head and depositing such ink droplet onto a recording medium thereby obtaining a desired record.

The ink jet recording apparatus, executing recording by such ink jet recording method, is provided with an ink jet head for discharging the ink droplet. A discharge energy generating element for generating energy for discharging the ink from the discharge port provided in the ink jet head can be, for example, an electromechanical converting member such as a piezo element or an electrothermal converting member including a heat-generating resistor. The ink jet head employing the electromechanical converting member discharges the ink droplet by directly applying a physical force to the ink. The ink jet head employing the electrothermal converting element discharges the ink droplet by heating the liquid.

With the recent progress in software and computer, such ink jet recording apparatus is required to output a color image. In order to meet such requirement, the ink jet head is being produced in a configuration suitable for forming a color image. In addition to the trend toward the color image output, there is also required a higher definition of the output image, and the ink jet recording is realizing image recording of higher definition and higher quality by increasing the image density and varying the ink concentration, and is thus being widely used not only by the experts of businesses and computers but also by the personal users of homes and small offices.

In such ink jet recording apparatus, there is known a configuration in which there is provided an ink supply system for supplying the ink jet head with the ink to be used for recording and an ink tank holding the ink is detachably connected to the end of such ink supply system. Among the conventional replaceable ink tanks, there is known, as disclosed in the Japanese Patent Application Laid-open No. 11-348308, an ink tank provided with an information memory medium capable of recording the information of the ink in the ink tank. Such information memory medium stores various information on the ink and can also record various information according to the status of use of the recording apparatus, whereby the user can always obtain satisfactory output.

FIGS. 44A and 44B are respectively an elevation view and a lateral view schematically showing a conventional example (hereinafter called conventional example 1). An ink tank 200 is provided with a fluid connection aperture 201 for ink supply, and the face having such fluid connection aperture 201 is further provided with a connection terminal 203 for connecting an information memory medium 204, provided in the ink tank 200, with the main body of the recording apparatus. Such face is parallel to the inserting direction 207 of the ink tank 200 into the main body of the recording apparatus. In an ink tank mounting portion in the main body of the recording apparatus, an ink supplying hollow needle is provided in a position opposed to the fluid connection aperture 201 of the ink tank 200, and a connector (not shown) is provided in a position opposed to the connection terminal 203 of the ink tank 200.

When the ink tank 200 is mounted on the main body of the recording apparatus, the hollow needle of the main body is inserted into the fluid connection aperture 201 of the ink tank 200 thereby forming the connection of the ink flow path, and the connection terminal 203 of the ink tank 200 engages with the connector of the main body so as to form mutual contacts thereby forming electrical connection. In such operation, the mutual positional relationship between the connecting position of the fluid connection aperture 201 and the hollow needle and the connecting position of the connectors may have certain fluctuation because of the forming precision in the manufacture, so that, if they are provided in fixed positions, there may not be achievable satisfactory connection for example because of the unnecessary stress applied to the connecting portions. Therefore, the connector in the main body of the recording apparatus is rendered movable in perpendicular two directions (X-direction 208, Y-direction 209) in a plane parallel to the mounting face of the ink tank.

FIGS. 46A and 46B are respectively an elevation view and a lateral view of another conventional replaceable ink tank (hereinafter called conventional example 2) disclosed in the U.S. Pat. No. 6,074,042. This ink tank 200 is provided with an information memory medium 204 capable of recording information on the ink contained in the ink tank, and with fluid connection apertures 201, 202 for ink supply. The information memory medium 204 and plural connection terminals 203 constituting electrical connecting portion therefor are provided on a face in a direction X 208 perpendicular to the inserting direction 207 of the ink tank. The face having the information memory medium 204 is further provided with a guide 206 for electrically connecting the connection terminals 203 of the ink tank with a connector of the main body of the recording apparatus. In an ink tank mounting portion in the main body of the recording apparatus, two ink supplying hollow needles are provided in positions opposed to the fluid connection apertures of the ink tank, and a connector is provided in a position opposed to the connection terminals 203 of the ink tank 200.

When the ink tank 200 is mounted on the main body of the recording apparatus, the two hollow needles of the main body are inserted into the fluid connection apertures 201, 202 of the ink tank thereby forming connection of the ink flow path, and the connector of the main body is guided by the guide 206 and engages with the connection terminals 203 of the information memory medium thereby forming electrical connection. In such operation, the mutual positional relationship between the connecting position of the fluid connection apertures and the hollow needles and the connecting position of the connectors may have certain fluctuation because of the forming precision in the manufacture, so that, if they are provided in fixed positions, there may not be achievable satisfactory connection for example because of the unnecessary stress applied to the connecting portions. Therefore, the connector in the main body of the recording apparatus is rendered movable in perpendicular two directions (X-direction 208, Y-direction 209) in a plane parallel to the mounting face of the ink tank 200.

However, it may be desirable to form two fluid connecting portions as in the conventional example 2 and to form the connecting terminal in a direction Y perpendicular to the inserting direction (Z direction) of the tank. More specifically there is desired a configuration of the configuration shown in FIGS. 44A and 44B but provided with two fluid connecting portions (cf. FIGS. 45A and 45B). Such configuration is required for example in a case where a fluid connecting portion 201 is provided for ink supply from the ink tank to the main body and a fluid connection portion 202 is provided for air supply to the ink tank in order to compensate the pressure reduction resulting in the ink tank from the ink supply, and the connection terminal face cannot be formed on the bottom surface because of the limitation in space when plural flat tanks are arrayed.

In case there are employed such two liquid connecting portions, the connection is to be made in three places within a same plane, including the guide portion for electrical connection. Therefore, satisfactory connection cannot be attained by rendering the guide portion movable in perpendicular two direction within such plane. Stated differently, when the ink tank is mounted by fixing two positions at the fluid connecting portions, the mounted position of the ink tank is determined not only in the X-direction 208 and the Y-direction 209 but also in the rotational direction (about Z-direction 207) within this plane.

Therefore, though it is possible to adjust the positions in the X-direction 208 and the Y-direction 209 by parallel displacement of the connectors in such directions, it is not possible to adjust the rotational direction so that unnecessary stress may be applied to each connecting portion.

Such stress, if applied to the electrical connecting portion, induces incomplete electrical connection, thereby resulting in a connection failure. Also such stress, if applied to the fluid connecting portion, induces a stress in a seal member positioned between the connection aperture and the hollow needle, thus resulting ink leakage or eventually bending of the hollow needle.

Also the aberration in the positions of the connection apertures, connecting terminal, hollow needles and connectors may result not only in the X-direction 208 and Y-direction 209 but also in the inclination about the X-axis and Y-axis. Particularly in case the hollow needle extends in a direction inclined with respect to the Z-direction 207 and the ink tank is mounted along the Z-axis, there may be applied a stress on the seal member to cause ink leakage from the liquid connecting portion, and, in order to prevent such phenomenon, the ink tank is preferably mounted in a direction somewhat inclined from the Z-axis rotationally about the X and Y-axes, matching the extending direction of the hollow needle. However, in the configuration shown in FIGS. 45A and 45B, the connectors cannot be connected satisfactorily in case of such inclined mounting of the ink tank.

Also in the conventional example 1, among the connectors for electrical connection between the ink tank and the main body of the recording apparatus, the connector at the side of the main body of the recording apparatus is provided, in a supporting portion thereof, with a movable mechanism, and, in case of a failure in such movable mechanism, the recording apparatus itself has to be repaired and cannot be used during the repair, thereby imposing significant disadvantage to the user.

Also the ink tank of the conventional example 2 has the two liquid connecting portions 201, 202, so that the connection is to be made in three places within a same plane, including the guide portion 206 for guiding the connector 211 of the recording apparatus for electrical connection. Therefore, when the ink tank is mounted by fixing two positions at the fluid connecting portions 201, 202 among such three connecting positions, the mounted position of the ink tank is determined not only in the X-direction 208 and the Y-direction 209 but also in all the rotational directions (about X-direction 208, Y-direction 209 and Z-direction 207.

Consequently, depending on the aberration in the positions of the connection apertures 201, 202, the plural connection terminals 203, the hollow needle 212 in the main body of the recording apparatus and the connector 211 in the main body of the recording apparatus, there may be result aberrations not only in the X-direction 208 and Y-direction 209 but also in the inclinations about the X-direction 208 and Y-direction 209. On the other hand, in the configuration of the conventional example 2, the connector at the main body of the recording apparatus is rendered movable only in two perpendicular directions (X-direction 208 and Y-direction 209), so that, in case the plural connectors 203 are inclined in the direction of array (X'-direction 210) thereof as shown in FIG. 47, the connectors 203 and those 211 at the main body of the recording apparatus may show fluctuating contact pressures, resulting eventually in contact failure.

Also in case ink leaks from the fluid connecting portions 201, 202 for some reason, if the connection terminals 203 are positioned in a face in which the fluid connecting portions 201, 202 are located as in the conventional example 2, the connection terminals 203 mutually cause shortcircuiting by the leaking ink because the flow of such leaking ink is not hindered, whereby the information memory medium 204 of the ink tank 200 or the main body of the recording apparatus may cause electrical error in the operation or destruction in the worst case.

Also as in the conventional example 1, among the connectors for electrical connection between the ink tank 200 and the main body of the recording apparatus, the connector 211 in the main body of the recording apparatus is provided at the supporting portion with a movable mechanism, and, in case of a failure therein, the recording apparatus itself has to be removed for repair and cannot be used during such repair thereby imposing significant inconvenience to the user.

In consideration of the foregoing, an object of the present invention is to provide a liquid container capable of satisfactory connection of the liquid connecting portion and the electrical connecting portion with the main body of the recording apparatus thereby enabling satisfactory recording, and a recording apparatus capable of mounting such liquid container.

On the other hand, in order to achieve color recording by the ink jet recording, there is generally employed a color ink jet recording apparatus having mutually independent plural (for example four) discharge mechanisms and supply systems for discharging color inks such as of cyan, magenta and yellow in addition to black ink. In such configuration, the path for the ink of each color is made exclusive for such color from the ink tank to the ink discharge port, in such a manner that the ink of each color is not mixed with the ink of another color.

Also there may be employed inks of plural kinds depending on the recording apparatus, for example a low-class apparatus in which high recording quality is not required and a high-class apparatus in which high recording quality is required.

In the ink jet recording apparatus having independent plural supply systems for recording with plural color inks or with plural inks of different characteristics, there are usually employed plural ink tanks (liquid containers) of a single kind. More specifically, plural (for example four) ink tanks of a same structure, containing respective inks, are mounted on the recording apparatus. Such configuration is adopted in order to complete the designing and evaluating work for the ink tanks and the mounting mechanisms therefor at a time thereby simplifying the manufacturing process and to utilize common components thereby reducing the manufacturing cost. Also the ink tanks of a substantially same configuration are employed for the independent plural supply systems in a case where the ink tanks are mounted together with the main body of the recording head on the carriage and rendered movable, or a case where the ink tanks are fixed in the main body of the recording apparatus separately from the main body of the recording head and the carriage, or a case employing an unmovable full-line recording head.

In case of employing ink tanks of a same configuration for containing inks of different colors or different kinds, there may result erroneous mounting of the ink tank at the replacement thereof. For example, the ink supplied from a newly mounted ink tank is different in color from the ink remaining on the wall of the ink supply path, the stain caused by ink mixing deteriorates the color recording quality. Also the mixing of the ink with the remaining ink may induce a chemical reaction, thereby eventually forming precipitate and inducing clogging of the recording head. Therefore, there is desired a configuration always enabling the mounting of an ink tank containing ink of specified color and type in an ink supply path at the ink tank replacement in order that there cannot be supplied ink different from the ink used before.

In order to meet such requirement, the Japanese Patent Application Laid-open No. 9-174879 discloses a key system capable of preventing the mount of an ink tank containing ink of a specified color or type in the ink supply path of another color or type.

In the key system proposed in the Japanese Patent Application Laid-open No. 9-174879, a projection (key) and a recess (key groove) for mechanical identification are provided on the entire length of the lateral face of the ink tank, and, on the internal wall of a slot for inserting the ink tank in the object for mounting (main body of the ink jet recording apparatus), a recess (key groove) and a projection (key) of rail shape are provided in a position opposed to the key of the ink tank at the insertion thereof. Such key and key groove are made different in the number, position or size (width) depending on the color and type of the ink contained in the ink tank. Therefore, in case of mounting a matching ink tank in a slot (namely in case of mounting an ink tank containing ink matching the supply path), the key and the key groove mutually match and engage whereby the ink tank can be inserted into the slot. However, in case of mounting an unmatching ink tank in a slot (namely in case of mounting an ink tank containing ink not matching the supply path in color or type), the key and the key groove do not mutually match and cannot mutually engage whereby the ink tank cannot be inserted into the slot.

However, the key system employing the aforementioned key and key groove for mechanical identification is associated with the following drawbacks.

In the ink jet recording apparatus, there is selected only a small clearance between the internal shape of the slot in which the ink tank is to be inserted and the external shape of the inserting end of the ink tank, substantially perpendicular to the inserting/detaching direction. Thus the external shape of the ink tank and the internal shape of the slot is almost same in order to define the position of the ink tank without play, so that the ink tank is rather difficult to insert. Because of this fact, it is difficult to set a clearance between the key and key groove on the ink tank and the inserting slot of the ink jet recording apparatus.

If the internal shape of the entrance of the slot of the ink jet recording apparatus is substantially same as the external shape of the inserting end of the ink tank, the ink tank has to be positioned correctly and inserted in the correct direction with respect to the main body of the ink jet recording apparatus in such manner that the internal shape of the slot corresponds to the external shape of the inserting portion of the ink tank, and only a very small allowance can be permitted therebetween.

As explained in the foregoing, in such configuration, the ink tank can be inserted into the slot only in case the key and the key groove on the ink tank to be mounted and on the internal wall of the slot mutually match and engage, and the ink tank cannot be inserted into the slot if the key and the key groove do not mutually engage. This means that even an appropriate ink tank cannot be inserted into the slot if the key and the key groove do not mutually engage. Stated differently, if the clearance between the internal shape of the slot and the external shape of the inserting end of the ink tank is selected larger in such a manner that the user can achieve loose ink tank insertion without paying much attention on the positional relationship between the key and the key groove, there may result a case where the key and the key groove do not match in their positions and even an appropriate ink tank cannot be inserted into the slot.

However, in consideration of the original objective of preventing erroneous insertion of the ink tank, an appropriate ink tank has to be always accepted into the slot. In case an appropriate ink tank cannot be inserted, such situation leads to an erroneous judgment of the user that such ink tank is inappropriate, whereby the ink tank or the ink jet recording apparatus itself may be regarded defective incapable of proper identification of the ink tank.

In order to prevent such situation, the Japanese Patent Application Laid-open No. 9-174879 discloses that the inserting portion of the ink tank and the entrance of the slot mutually correspond in such extremely exact manner that the key and the key groove are always in a correct positional relationship, namely that the internal shape of the slot and the external shape of the inserting portion of the ink tank are formed substantially same without play therebetween in such a manner that the key (or key groove) of an appropriate ink tank always match the key groove (or key). However, such configuration requires that, in case of mounting the ink tank into the slot, the ink tank has to be rigorously positioned with respect to the main body of the ink jet recording apparatus and has to be inserted in the correct inserting direction, whereby a loose insertion of the ink tank cannot be achieved and the user is requested to execute a cumbersomely exact mounting operation of the ink tank.

On the other hand, it is also conceivable to facilitate engagement of the key and the key groove by selecting a larger clearance therebetween even if the inserting portion of the ink tank and the entrance of the slot are not in a precisely defined positional relationship. However, if the clearance between the key and the key groove is larger, particularly in case the user inserts the ink tank in an inclined position with respect to the slot, there may result a situation where a projection or a recess not directly related to the mechanical identification tends to engage with the key or the key groove or an adjacent key tends to engage with the key groove in case plural keys or key grooves are arrayed. In such case, in an initial stage in case of inserting an inappropriate ink tank into the slot of the ink jet recording apparatus, the user has a feeling as if a projection penetrates into a recess, and, trying to further insert the ink tank, the user feels a strong resistance as if the insertion is inhibited by mutual hooking in the course of insertion. Stated differently, although the insertion is not possible in this case, there may result in slight engagement between a projection and a recess (not necessarily limited to the key and the key groove) because of the larger clearance between the key and the key groove, and this fact provides the user with a feeling that the ink tank is insertable. As a result, the user is inclined to thereafter continue insertion of the ink tank despite of slight resistance, thereby resulting in the breakage of the key or key groove of the ink tank or the ink jet recording apparatus.

Also if the clearance between the key and the key groove is selected small, particularly if the user inserts the ink tank in an inclined position with respect to the slot, there can be easily generated a situation where the key and the key groove do not mutually engage and even an appropriate ink tank cannot be inserted as explained in the foregoing. In such case the user may consider that the ink tank is not insertable and interrupts the inserting operation.

Furthermore, the conventional configuration disclosed in the Japanese Patent Application Laid open No. 9-174879 requires a complex manufacturing process and is associated with a high manufacturing cost, since the identifying key is formed over the entire length of the lateral face of the ink tank and the key groove of a same length is formed on the internal wall of the slot.

SUMMARY OF THE INVENTION

In consideration of the foregoing, an object of the present invention is to provide a liquid container capable of achieving satisfactory connection of the fluid connecting portion and the electrical connecting portion with the main body of the recording apparatus, thereby enabling satisfactory recording, and a recording apparatus capable mounting such liquid container.

Also in consideration of the foregoing, another object of the present invention is to provide a liquid container such as an ink tank capable of more precise identification for preventing erroneous insertion thereby avoiding misjudgment of the user, still allowing easy attaching/detaching operation and providing a low manufacturing cost, and an ink jet recording apparatus in which such liquid container can be attached and detached.

The above-mentioned objects can be attained, according to the present invention, by a liquid container detachably attachable to a recording apparatus for executing recording by depositing recording liquid onto a recording medium, the liquid container comprising:

a liquid chamber for containing the recording liquid;

a liquid connection aperture for causing the liquid chamber to communicate with a recording liquid supply system of the recording apparatus upon mounting on the recording apparatus;

an information memory medium which holds information including information relating to the liquid container and in which the information can be renewed or added by linkage with the recording apparatus; and an information memory medium unit to engage, upon mounting on the recording apparatus, with information exchange means of the recording apparatus and adapted to guide the information memory medium to a position capable of communication with the recording apparatus;

wherein the information memory medium unit is capable of changing position and direction with respect to the fluid connection aperture according to the position and direction of the information exchange means of the recording apparatus.

In such configuration, even in the presence of certain aberration in the relative position between a connection portion of the main body of the recording apparatus with the fluid connection aperture and a connector therein, the information memory medium unit may change position relative to the fluid connection aperture whereby both the fluid connection aperture and the information memory medium unit may be positioned so as to match the connecting portions of the recording apparatus. Consequently the connection of the fluid and that of the information memory medium can be achieved in satisfactory manner without causing unnecessary stress in both connecting portions. Particularly in the liquid container of the present invention, the information memory medium unit can also change its direction, so that both the fluid connection aperture and the information memory medium unit can be so directed as to match the respective connecting portions of the recording apparatus even if the connecting portion with such fluid connection aperture and the connector in the main body of the recording apparatus have certain mutual aberration in the directions thereof.

Also a movable mechanism for rendering the connecting portion movable is provided in the liquid container, so that the main body of the recording apparatus need not be repaired even in case of a failure in the movable mechanism and the inconvenience on the user can be alleviated.

Also as a configuration for rendering the information memory medium unit movable in position and direction, there is provided an information memory medium unit containing portion provided with a connecting aperture for the information memory medium in the connecting direction with the connector of the recording apparatus and also with an internal space of a size capable accommodating the information memory medium unit without touching such aperture, wherein the information memory medium unit is accommodated in freely movable manner in the information memory medium unit containing portion.

In such configuration, the information memory medium unit can change position and direction thereof within a certain range determined by the size of the internal space of the information memory medium unit containing portion. In particular, the information memory medium unit can change its direction by rotation in any direction, including rotations (rotations in directions $\theta_X$,$\theta_Y$) about axes (X, Y axes) in a plane perpendicular to the connecting direction (Z-direction) with the connector of the recording apparatus.

Also in the present invention, there may be employed an information memory medium of non-contact type. As the information memory medium can change its position and direction with respect to the fluid connection aperture, matching the position and direction of the connector of the recording apparatus, the information memory medium unit can move according to the position and direction of the connector of the recording apparatus even in the presence of certain aberration in the position and direction of the information memory medium unit and the connector of the recording apparatus whereby both can always assume a position most efficient for communication. Therefore there can be made compact the antenna required for communication of the two, so that the size of the liquid container and the main body of the recording apparatus can be made compact.

Also in such configuration, there is preferably formed, on the external surface of the information memory medium unit and the internal surface of the information memory medium unit containing portion, a projection or a recess for causing mutual impingement of the two thereby limiting the movable range of the information memory medium unit. In this manner it is rendered possible to appropriately limit the movable range of the information memory medium and to limit the contact area in the movement thereby achieving smooth movement of the information memory medium unit.

More specifically, the information memory medium unit may be composed of an information memory medium holder having a connection aperture and a connection aperture rim protruding around the connection aperture in the direction of aperture, and an information memory medium having a contact portion fixed in the connection aperture and adapted to be electrically connected with the connector of the recording apparatus. The information memory medium holder is contained in the information memory medium unit containing portion in such a manner that the connection aperture rim is exposed from the connection aperture for the information memory medium, and the movable range of the information memory medium holder can be limited within such a range that a gap at least equal to a predetermined amount is formed between the connection aperture rim and the connection aperture for the information memory medium and a gap at least equal to a predetermined amount is formed between a face having the connection aperture rim and the internal wall of the information memory medium unit containing portion. In such configuration, even in case the recording liquid leaks from the fluid connection aperture outside the information memory medium unit containing portion, such recording liquid flowing toward the information memory medium unit containing portion tends to flow along the wall of the information memory medium unit containing portion and hardly reaches the information memory medium holder separated at least by a predetermined amount from such wall. It is therefore rendered possible to prevent electrical failure in the information memory medium resulting from contact with the recording liquid.

It is also possible to further reduce the electrical failure in the information memory medium by providing the rim of the connection aperture for the information memory medium with a capillary groove for guiding the recording liquid by a capillary force, thereby causing the recording liquid to flow more securely along the internal wall of the information memory medium unit containing unit.

Also in the present invention, the information memory medium unit and the connector of the recording apparatus may have such a configuration that a projection formed on either is inserted in and engages with a recess formed on the other thereby forming electrical connection. In such configuration, the projection may be provided with a tapered portion pointed in the inserting direction into the recess while the recess may be provided with a tapered portion pointed in the inserting direction of the projection, whereby the information memory medium unit can satisfactorily engage with the connector of the recording apparatus by a simple mounting operation, in a state where the information memory medium unit and the connector of the recording apparatus are approximately opposed, of moving the liquid container in the connecting direction so as to mutually press the two. In such operation, even if the information memory medium unit and the connector of the recording apparatus have certain mutual aberration in the position and direction, the information memory medium unit moves according to the position and direction of the connector of the recording apparatus thereby achieving satisfactory engagement of the two.

Also, the fluid connection aperture and the information memory medium unit may be both provided on an external face of a same direction in the liquid container. Such configuration allows to connect both the fluid connection aperture and the information memory medium unit with the recording apparatus by a simple operation of mounting the liquid container on the recording apparatus by moving the liquid container toward the face having the liquid connection aperture and the information memory medium unit.

The present invention is applicable particularly advantageously to a liquid container provided with two fluid connection apertures. In the liquid container having two fluid connection apertures, the liquid container is defined not only in the position but also in the direction by the connection of such fluid connection apertures. However, in the present invention, since the information memory medium unit is movable not only in the position but also in the direction, so that the two fluid connection apertures and the information memory medium unit can be connected in satisfactory manner without any stress.

In case there are provided two fluid connection apertures and such fluid connection apertures and the information memory medium unit are formed on an external face of a same direction in the liquid container, it is preferred to position the two fluid connection apertures in mutually adjacent manner and to provide the information memory medium unit in a distant position. In such configuration, in case of leakage of the recording liquid from the fluid connection apertures, the leaking liquid is less likely to reach the information memory medium unit and there can be prevented electrical failure in the information memory medium.

One of the two fluid connection apertures can be used for the supply of the recording liquid into the recording apparatus while the other can be used for fluid introduction into the liquid chamber. Thus there can be realized a configuration where the fluid is introduced into the liquid chamber so as to substantially cancel the pressure reduction therein resulting from the outflow of the recording liquid. Such configuration allows to maintain a constant pressure in the liquid chamber and to supply the recording liquid always under a substantially constant pressure. In such configuration, the fluid introduced into the liquid chamber can be liquid or air. There may be adopted a configuration where the recording liquid same as that contained in the liquid chamber is introduced therein. Also there may be provided a guard portion having a connection finger provided with the connection aperture for the information memory medium, engaging with a connecting portion provided in the liquid chamber and causing an elastic deformation in response to an external strain. In such configuration, in case the liquid container not mounted in the ink jet recording apparatus is erroneously dropped for example onto a floor, the connection finger provided in the guard portion causes an elastic deformation to absorb the impact of dropping thereby preventing the information memory medium, contained in a cover portion, from destruction by the impact of dropping.

As explained in the foregoing, the present invention is advantageously applicable to a liquid container having two or more fluid connection apertures. Also as explained in the foregoing, the liquid container having two fluid connection apertures can achieve supply of the recording liquid under a constant pressure condition. Therefore, the liquid container of the present invention can be advantageously employed in an ink jet recording apparatus for discharging and depositing the recording liquid onto a recording medium, in which the supply of the recording liquid under a constant pressure is particularly preferred. Also, the information exchange means is preferably an antenna for wireless communication. Also the information exchange means is preferably a connector for electrical connection with the information memory medium. There is also preferred a configuration provided with a face having the aforementioned connection aperture for the information memory medium, containing the information memory medium unit in a space constituted by the aforementioned information memory medium containing portion, and further provided with a guard portion having a connection finger engaging with the connecting portion provided in the liquid chamber and capable of causing an elastic deformation in response to an external strain. The present invention is naturally effectively applicable to the configuration of the conventional example 1 with a single fluid connection aperture.

The recording apparatus of the present invention is so constructed as to be capable of mounting the liquid container described above. Such recording apparatus is provided with a guide mechanism for guiding the liquid container, at the mounting thereof, to a proper mounting position, and such guide mechanism is preferably capable of changing the mounting position and direction of the liquid container within a predetermined range. Such configuration is capable, by changing the mounting position and direction of the liquid container, of adjusting the position of the fluid connection aperture according to the connecting portion of the recording apparatus thereby achieving satisfactory fluid connection without generating unnecessary stress at the fluid connection aperture. Even when the liquid container is mounted in such state adjusted in the mounting position and direction, the information memory medium unit can accordingly change the position and direction, thereby being satisfactorily connected to the connector of the recording apparatus without generating unnecessary stress therein.

The present invention provides a liquid container which can be inserted and detachably mounted in a slot of a mount object and is provided on the external periphery with an identifying portion, for identifying at the inserting operation whether the liquid container is to be inserted into the aforementioned slot, corresponding to an identifying portion of the mounted side provided on the internal wall of the slot, the liquid container being featured in that the identifying portion is provided in the vicinity of an inserting end and is provided with an identifying recessed portion in which, when opposed to an identifying rib of the identifying portion of the mounted side of the slot, such identifying rib can be inserted, and an identifying projection to impinge on the identifying rib when opposed thereto, wherein the identifying projection has, in the longitudinal direction thereof, an inverted T-shape along the inserting direction.

Such configuration allows to simplify the manufacturing or working process in comparison with the conventional configuration in which the identifying projection and recess are formed in a rail shape along the entire length of the liquid container. Also, since the identifying projection is formed in an inverted T-shape, the identifying projection tends to firmly impinge on the identifying rib at the insertion of an inappropriate liquid container, whereby the user can know more easily that the insertion is not possible. Also the identifying projection cannot be easily broken even under a relatively strong inserting force.

The present invention is also featured in that the identifying portion is provided in the vicinity of an inserting end and is provided with an identifying recessed portion in which, when opposed to an identifying rib of the identifying portion of the mounted side of the slot, such identifying rib can be inserted, and an identifying projection to impinge on the identifying rib when opposed thereto, wherein the identifying projection has, in the longitudinal direction thereof, a T-shape along the inserting direction.

In the configuration with such T-shaped identifying projection, in case of insertion of an inappropriate liquid container in an inclined state into the slot, the identifying projection coming into firm impingement on the identifying rib is reinforced in the upper part whereby the user can know more easily that the insertion is not possible. Also the identifying projection cannot be easily broken even under a relatively strong inserting force.

The present invention is further featured in that the identifying portion is provided in the vicinity of an inserting end and is provided with an identifying recessed portion in which, when opposed to an identifying rib of the identifying portion of the mounted side of the slot, such identifying rib can be inserted, and an identifying projection to impinge on the identifying rib when opposed thereto, wherein the width of a face having the identifying portion is smaller than the internal width of the slot in a portion where the identifying portion of the mounted side is provided, by a distance A smaller than the difference B between the width of the identifying recess and that of the identifying rib.

Such configuration enables simple and exact connection for the liquid supply etc. since the external shape of the liquid container is precisely positioned with respect to the internal shape of the slot when the liquid container reaches the identifying portion of the mounted side in the slot. On the other hand, such precise relative positional relationship is not required between the identifying recess and the identifying rib, and the operation of the aforementioned connection etc. can be executed smoothly without being affected by such relative positional relationship.

The identifying portions are preferably formed on a pair of mutually opposed lateral faces.

The identifying projection preferably has such a length as to always impinge on the identifying rib when the identifying projection is in a position opposed to the identifying rib of the identifying portion of the mounted side in the slot even in case of insertion in an inclined position with respect to the slot. Such configuration allows, even in case of insertion of an inappropriate liquid container in an inclined position into the slot, to prevent intrusion of the identifying projection by evading the impingement with the identifying rib, thereby preventing the erroneous insertion.

The identifying recess can be a portion formed by eliminating a protruding portion formed between plural supporting pillars and connecting the adjacent supporting pillars and the identifying projection can be a remaining portion of the protruding portion formed between plural supporting pillars and connecting the adjacent supporting pillars. In such configuration, the liquid container can be mass produced and stored in a state prior to the elimination of the protruding portion, and the protruding portion can be later suitably eliminated to form the identifying projection and recess according to the liquid to be contained. In this manner it is not necessary to design, manufacture and store liquid containers different according to the liquids so that the manufacturing cost can be significantly reduced.

The end face of the support pillar in the inserting direction and the end face of the identifying projection in the inserting direction are preferably in a same plane. Such configuration prevents, in case of insertion of an inappropriate liquid container, fitting of the identifying rib in the gap between the supporting pillars (a small space under the identifying projection), thus giving a fitting feeling to the user and causing erroneous judgment thereof.

It is also preferred that the protruding portion is thinner than the supporting pillar and that the protruding portion has a longitudinal length in the connecting portion with the supporting pillar smaller than the entire longitudinal length of the protruding portion. Such configuration enables simple formation of the identifying recess by cutting off the protruding portion.

Furthermore, the identifying portion is preferably formed in such an asymmetrical manner that the positions of the identifying projection and recess of the identifying portion are substantially displaced by a half pitch when the identifying portion is inverted by 180° about the central axis in the inserting direction. Such configuration allows to prevent mounting of the liquid container in a position where the left and right sides thereof are misjudged.

A liquid connection aperture capable of passing liquid may be provided on a face substantially perpendicular to the inserting direction and positioned at the leading end in the inserting direction. In such case, the identifying portion may be positioned close to the face on which the liquid connection aperture is provided. In such case, since the lower face of the identifying projection is positioned in the vicinity of the inserting end of the liquid container, the erroneous insertion can be detected in an early stage of the inserting operation of the liquid container, whereby the user can know in an early stage that the liquid container is to be replaced and the convenience for the user can therefore be improved. Also, the identifying portion may be provided on a face substantially perpendicular to a face on which the liquid connection aperture is provided.

The number and position of the identifying projection and recess may be determined according to the color and type of recording ink to be contained in the liquid container.

The ink jet recording apparatus of the present invention is provided with a slot in which the liquid container of the aforementioned configuration can be detachably mounted.

DESCRIPTION OF THE PREFERRED EMBODIMENTS

Now the present invention will be clarified in detail by embodiments thereof, with reference to the accompanying drawings.

Entire Configuration of Ink Tank (Liquid Container)

Figure 1:
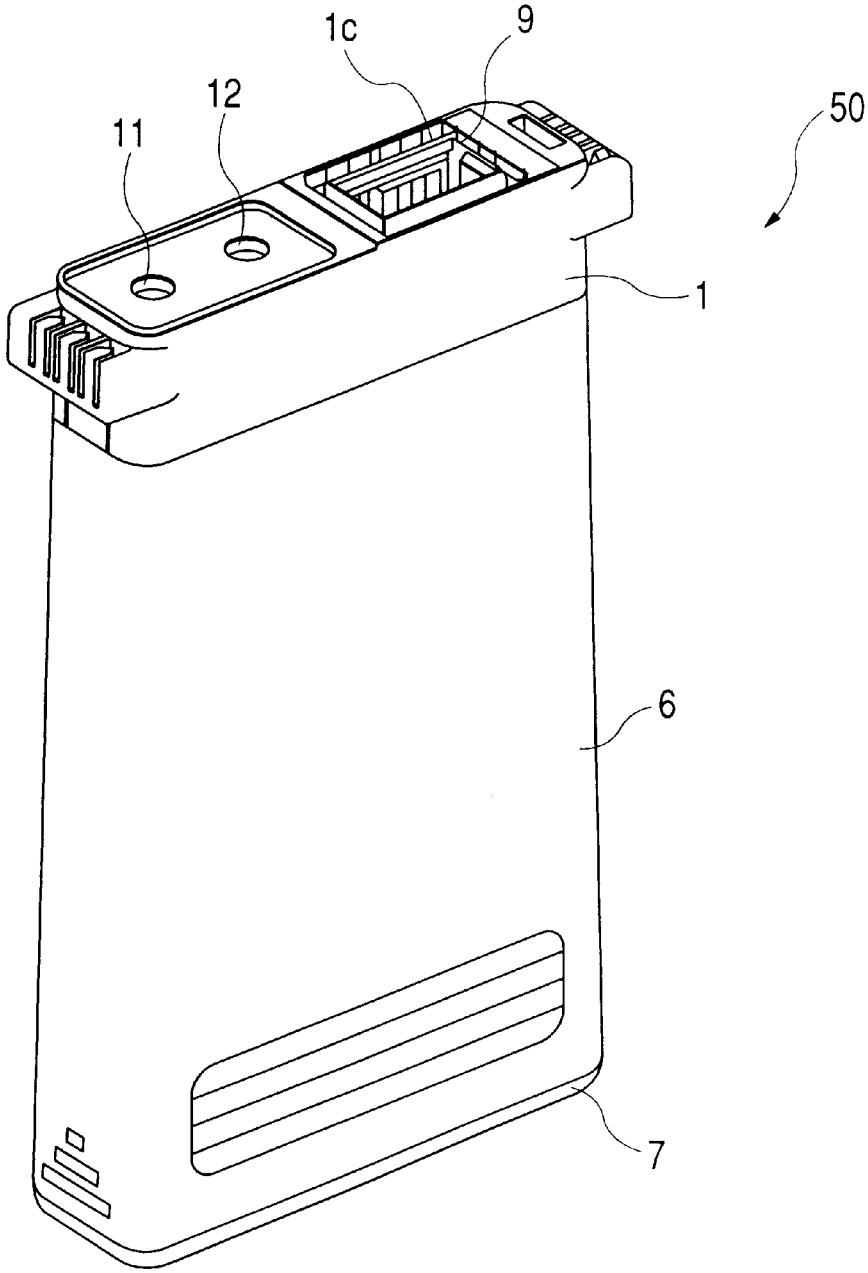
FIG. 1 is a perspective view of an ink tank embodying the present invention, seen from the side of a fluid connection aperture.
Figure 2:
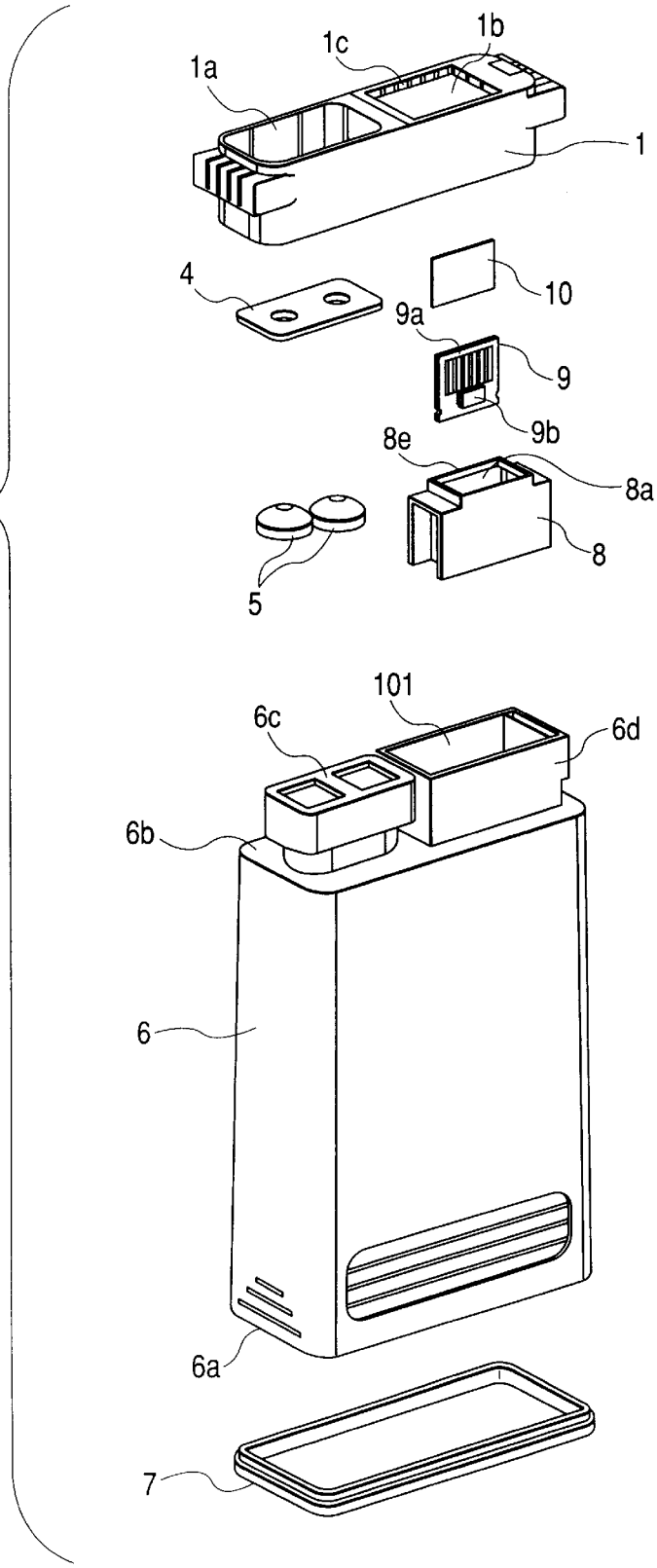
FIG. 2 is a schematic exploded perspective view of the ink tank shown in FIG. 1.

At first there will be explained the entire configuration of an ink tank 50, with reference to FIGS. 1 and 2. FIG. 1 is a perspective view of an ink tank 50 embodying the present invention with fluid connection apertures 11, 12 positioned upwards, and FIG. 2 is an exploded perspective view of the ink tank 50. This ink tank is mounted on the recording apparatus in a state in which the fluid connection apertures 11, 12 are positioned downwards, so that a bottom portion 6*b* is at the side of the fluid connection apertures 11, 12.

The ink tank 50 is provided with an ink container 6 and a cover 7, and the cover 7 is hermetically adjoined by ultrasonic fusion to the upper face 6*a* of the ink container 6 to form an ink chamber 523 (cf. FIG. 4) in which ink (discharge liquid) is contained. On a bottom face 6*b* of the ink container 6, opposite to the face adjoined to the cover 7, a fluid connection aperture guiding portion 6*c* and an information memory medium holder containing portion 6*d* are formed so as to protrude from the bottom face. A bottom cover 1 is mounted so as to cover these. The bottom cover 1 is provided with a fluid connection aperture 1*a* in a position opposed to the fluid connection aperture guiding portion 6*c* and an information memory medium connection aperture 1*b* in a position opposed to the information memory medium holder containing portion 6*d*.

The fluid connection aperture guiding portion 6*c* is provided therein with first fluid connection aperture 11 and a second fluid connection aperture 12 penetrating through the guiding portion and communicating with the interior of the ink chamber 523. Inside the fluid connection apertures 11, 12 there are inserted elastic members 5. A fixing member 4 having apertures in positions corresponding to the fluid connection apertures 11, 12 is provided outside and is fixed by ultrasonic fusion to press and fix the elastic members 5. Thus the elastic members 5 are compressed and fixed in the respective fluid connection apertures 11, 12 thereby hermetically sealing such apertures. Until the hollow needles of the main body are inserted into the fluid connection apertures 11, 12, the interior of the ink chamber 523 is hermetically sealed by the elastic members 5 and the cover 7.

Figure 3:
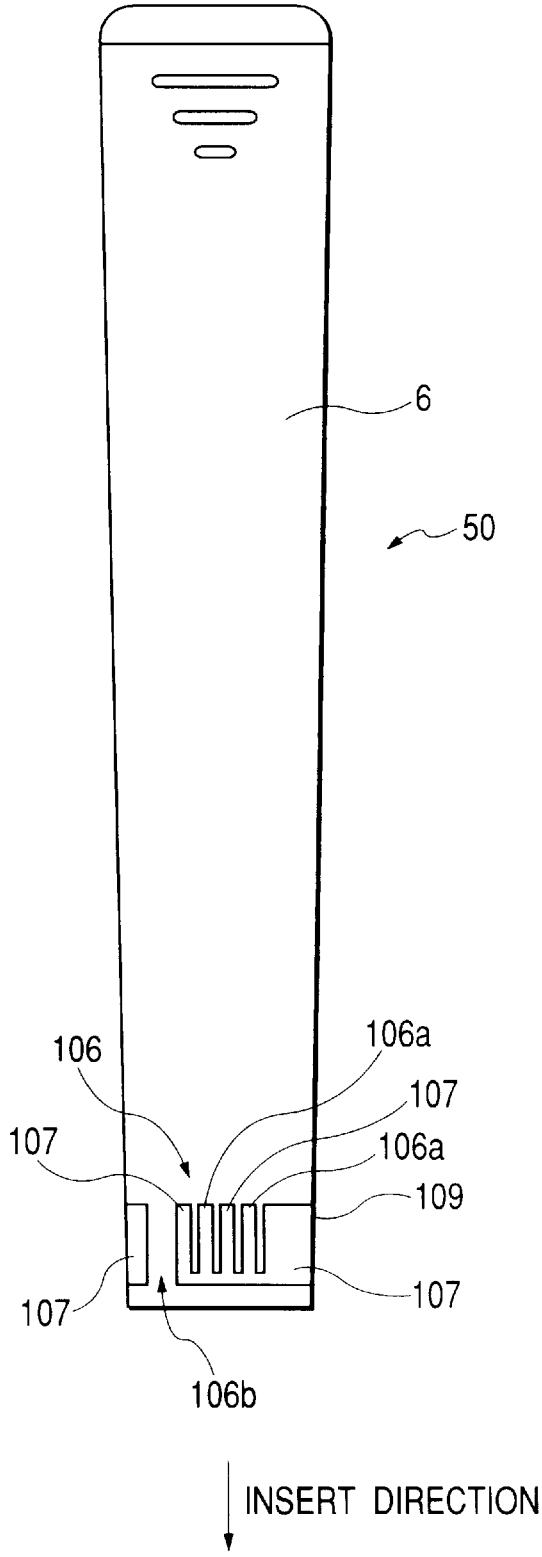
FIG. 3 is a lateral view of the ink tank shown in FIG. 1.

A main body 2 of the tank is provided, on the lateral faces thereof, with extending portions 109. As shown in FIG. 3, each extending portion 109 is provided with an identifying portion 106. In each identifying portion 106, there are provided plural (four in the present embodiment) supporting pillars 107. The gaps of such support pillars 107 constitute independent identification points for actual identification, among which a portion containing an inverted T-shaped member constitutes an identifying projection (identifying key) 106*a* and a portion not containing the inverted T-shaped member (cut-off portion) constitutes an identifying recess (identifying key groove) 106*b*. In the present embodiment, there are employed three identifying points in each identifying portion 106 or six identifying points in total.

At first there will be given an explanation on the information memory medium 9 featuring the present invention. A connecting portion for the information memory medium 9 is provided on a face at the same side of the two fluid connection apertures 11, 12, namely on the bottom face 6*b*. The information memory medium 9 is fixed, with a double-sided adhesive tape 10, on the internal face of a connection aperture 8*a* of the information memory medium holder 8, fitting with a protruding connector 550 (cf. FIG. 6) of the main body. The information memory medium unit is constituted by the information memory medium holder 8 and the information memory medium 9 fixed thereto. The information memory medium holder 8 incorporating the information memory medium 9 is inserted in a recess 101 opened in the information memory medium holder containing portion 6*d*. The information memory medium holder 8 is covered by the bottom cover 1, thereby being contained and prevented from dropping in an information memory medium unit containing portion constituted by the information memory medium holder containing portion 6*d* and the bottom cover 1.

In such state, the information memory medium holder 8 is supported with a gap therearound so as to be capable of changing the position and the direction within a predetermined range in a space defined by the recess 101 and the bottom cover 1. Therefore the information memory medium holder 8 can change the position and direction, according to the relative position of the connector of the main body to be connected to the information memory medium 9 with respect to the information memory medium holder 8, so as to achieve satisfactory connection of the connector of the main body and the information memory medium 9. In the present specification, such function of the information memory medium holder 8 is called "equalizing", and the supported state thereof is called "floating". The equalizing operation of the information memory medium holder 8 and the supporting of the information memory medium holder 8 in the floating state will be explained later in more details.

The fluid connection aperture guiding portion 6*c* and the information memory medium holder containing portion 6*d* are separately formed in mutually distanced positions on the bottom portion 6*b* of the ink container 6. The recess 101 for containing the information memory medium holder 8 is opened only downwards. In such configuration, even in case the ink leaks by a breakage in the vicinity of the elastic members 5 of the fluid connection apertures 11, 12 and flows along the bottom portion 6*b* of the ink container 6, it hardly enters the recess 101.

Also in the supporting of the information memory medium holder 8 in the aforementioned floating state, the movement of the information memory medium holder 8 is limited within such a range that a connection aperture rim 8*e*, formed around the connection aperture 8*a* of the information memory medium holder 8 so as to protrude from the face of such aperture, does not touch the rim of the information memory medium aperture 1*b* of the bottom cover 1. On the rim of the information memory medium connection aperture 1*b* of the bottom cover 1, there are formed capillary grooves 1*c* along the direction of the aperture. In such configuration, even in case the ink leaks and flows along the bottom of the ink tank 50 toward the information memory medium 9, it is attracted in the space between the information memory medium holder 8 and the information memory medium holder containing portion 6*d* by the capillary force of the capillary grooves 1*c*, thereby being prevented from entering the connection aperture 8*a* of the information memory medium holder 8.

As explained in the foregoing, the ink tank of the present embodiment is so constructed that the eventually leaking ink hardly reaches the information memory medium 9 thereby preventing electrical failure such as shortcircuiting resulting from the ink. This configuration is also effective in preventing the electrical failure caused by the ink deposited in the vicinity of the fluid connection apertures 11, 12 when the ink tank 50 is detached from the main body of the recording apparatus. Particularly in case the detached ink tank 50 is placed with the bottom thereof upwards, the ink flowing on the bottom of the ink tank 50 toward the information memory medium 9 is attracted in the space between the information memory medium holder 8 and the information memory medium holder containing portion 6*d* as explained in the foregoing, whereby the ink hardly touches the information memory medium 9.

Ink Supply System (Recording Liquid Supply System)

Figure 4:
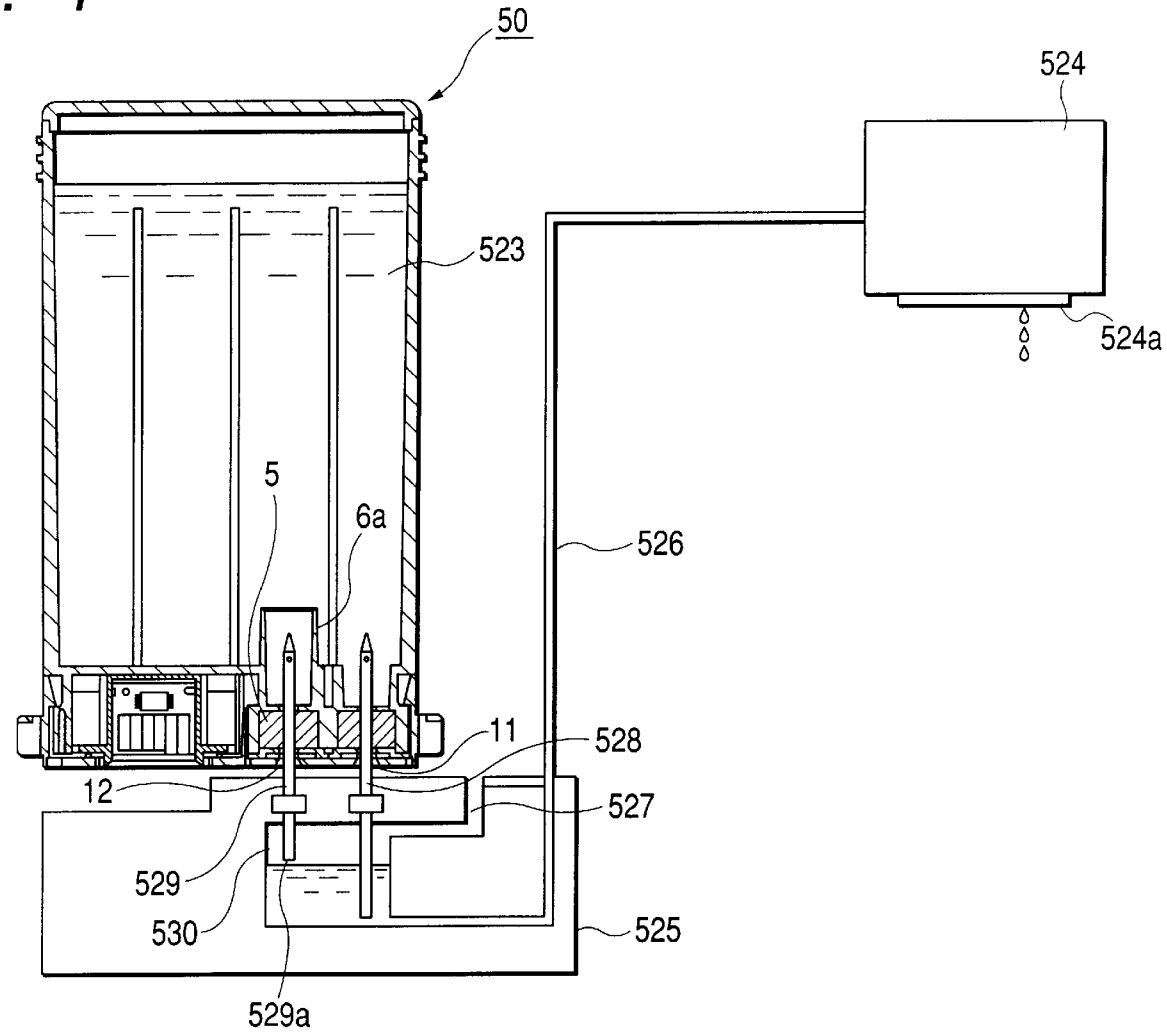
FIG. 4 is a partly sectioned schematic view showing the configuration of an ink supply system of a recording apparatus of the present invention.

In the following there will be explained, with reference to FIG. 4, an example of the ink supply system of the ink jet recording apparatus to which the ink tank 50 of the present embodiment is to be connected. FIG. 4 is a view showing the schematic configuration of an ink supply system, connected to an ink jet head 524 for recording on a recording medium by depositing ink thereon and serving to supply such head with the ink.

The ink jet head 524 is in fluid connection with the ink tank 50 through an ink supply pipe 526. The end of the ink supply pipe 526 at the side of the ink tank 50 is connected to a buffer chamber 530 of an ink supply unit 525. The ink supply unit 530 is provided with a hollow ink supply needle 528 communicating with the buffer chamber 530. The ink supply needle 528 penetrates the elastic member 5 provided in the first fluid connection aperture 11 of the ink tank 50 and extends into the ink chamber 523, thereby allowing the ink in the ink chamber 523 to flow through a needle hole provided in the vicinity of the front end of the needle. In such situation, since the elastic member 5 is fixed in the compressed state as explained in the foregoing, the elastic member 5 presses the external periphery of the penetrating ink supply needle 528 thereby maintaining a hermetically sealed state in such periphery and preventing ink leakage.

The ink supply unit 525 is further provided with an air introducing needle 529 communicating with the buffer chamber 530. Like the aforementioned ink supply needle 528, the air introducing needle 529 penetrates through the second fluid connection aperture 12 of the ink tank 50. The buffer chamber 530 is provided with a buffer chamber air communicating portion 527 communicating with the exterior of the ink supply unit 525 from the upper portion of the buffer chamber 530. The air introducing needle 529 extends to the approximate middle in the height of the buffer chamber 530, while the ink supply needle 528 extends to a position lower than that of the air introducing needle 529. In a stationary state, the buffer chamber 530 is filled with ink to the lower end position of the air introducing needle 529, thus forming a buffer space thereon.

In the ink chamber 523 of the ink tank 50 of the present embodiment, there is provided a cylindrical portion 6*e* surrounding laterally the air introducing needle 529 which extends in the ink chamber 523 in a state where the ink tank 50 is set on the ink supply unit 525. In this state, since the air introduced from the hole of the air introducing needle 529 generates bubbles in the ink chamber 523, a sufficient clearance is formed between the diameter of the air introducing needle 529 and the cylindrical portion 6*e* in such a manner that such bubbles do not remain therein.

The cylindrical portion 6*e* extends higher than the upper end of the inserted air introducing needle 529. The ink supply needle 528 and the air introducing needle 529 are both composed of electrically conductive materials, and there can be detected, from a change in the electrical resistance between the ink supply needle 528 and the air introducing needle 529, that the remaining ink amount in the ink tank 50 becomes less than a predetermined amount. When the level of the ink becomes lower than the cylindrical portion 6*e* by the ink consumption, the electrical current no longer flows between the ink supply needle 528 and the air introducing needle 529 through the ink, whereby the low remaining amount state of ink can be detected.

In order to enable such detection in satisfactory manner, the upper end of the cylindrical portion 6*e* is rounded at the edges in order to promptly separate the ink between inside and outside of the cylindrical portion 6*e* when the ink level lowers from a state where such ink level is slightly above the upper end. In the present embodiment, the cylindrical portion 6*e* has such a height capable of detecting when the remaining ink amount in the ink tank 50 becomes less than 10%.

The cylindrical portion 6*e* may have an agitation accelerating structure for inducing an ink flow in the ink chamber 523 for eliminating the precipitation in the pigment ink. It is also possible to form a similar cylindrical portion in the inserting position of the ink supply needle 523 and to provide a filter in the aperture of such cylindrical portion whereby the ink guided from the ink chamber 523 passes through such filter. Such filter can be composed of a fibrous member, a fibrous sheet, a foamed member, a member formed from beads or a foamed member formed by dissolution, of a material same as that constituting the tank.

In the foregoing, there have been explained examples of the internal configuration and function of an ink tank having two fluid connection apertures as an example of the ink tank of the present invention, but the present invention is not limited to such examples in the fluid connection aperture and the internal structure and there may also be adopted a configuration in which an ink containing flexible bag is provided in a container as in the conventional example 2 (U.S. Pat. No. 6,074,042) and two fluid connection apertures are so provided as to connect the interior and the exterior of the bag.

In the following there will be given a schematic explanation on the ink supplying operation.

The ink jet head 524 discharges ink from an ink discharge face 524*a* thereby executing recording on the recording medium. Then, in order to replenish the discharged ink, the ink is supplied from the ink tank 50 to the ink jet head 524 through the ink supply pipe 526. As the ink decreases in the ink tank 50 by the ink supply, the pressure therein becomes lower. In response, air is introduced into the ink tank 50 through the buffer chamber air communicating portion 527 and the air introducing needle 529.

In the ink jet recording apparatus, it is already known that the supplied ink has to be maintained at a negative pressure in comparison with the ink jet head. In the ink supply system of the present embodiment, a bubble introducing point 529*a* at the lower end of the air introducing needle 529 is positioned lower than the discharge port face 524*a* of the ink jet head 524, and the difference in height h (water head) between the point 529*a* and the discharge port face 524*a* always applies a negative pressure on the ink jet head 524. Stated differently, regardless of the ink level in the ink tank 50, a substantially constant negative pressure h is applied to the ink jet head 524.

In the following there will be explained a case where the air in the tank expands or contracts by a change in the environmental conditions such as temperature or air pressure. When the air inflates, the ink is pressed into the buffer chamber 530 through the air introducing pipe 529, but the buffer chamber 530 has such a sufficient volume as not to cause ink overflowing under the anticipated environmental change. Also, even if the ink overflows, such ink is absorbed by a used ink absorbent member (not shown) provided beyond the buffer chamber air communicating portion 527 and does not smear other portions of the recording apparatus. On the other hand, when the air contracts, air is introduced into the ink tank 50 through the air introducing pipe 527.

In the present embodiment, there has been explained a configuration of introducing air from the air introducing needle 529 in order to compensate the pressure decrease in the ink chamber 523 resulting from the ink supply, but it is also possible to connect a system for liquid supply under a constant pressure condition to the second fluid connection aperture 12 thereby supplying liquid for compensating the pressure decrease. Such liquid can be ink same as that contained in the ink chamber 523.

Information Memory Medium

In the following there will be given an explanation on the information memory medium 9 (see FIGS. 1 and 2) provided in the ink tank 50 of the present embodiment. The information memory medium 9 can exchange information with the ink jet recording apparatus in a state where the ink tank 50 is mounted thereon. The information exchanged between the information memory medium 9 and the ink jet recording apparatus includes, for example, effective term of the ink, ink amount in the ink tank 50 and ink color. Such information exchange allows to issue an alarm on the expiration of effective term of the ink or on the absence of ink, thereby requesting the replacement of the ink tank to the user. It is thus rendered possible to prevent an influence on the recorded image by the discoloration or viscosity increase of the ink, a recording operation with the empty ink tank or a recording operation with an erroneously mounted ink tank containing the ink of a wrong color, thereby avoiding defective recording. Such configuration allows to execute the recording operation always in a satisfactory state, thereby providing an image output of high image quality.

The information memory medium 9 can be composed of any medium providing identification information by various information acquiring means such as magnetic, magnetooptical, electrical or mechanical means, specifically a flash memory or a write-once magnetic memory. The ink tank 50 of the present embodiment employs an EEPROM 9*b* capable of electrical writing and erasing process, as a medium capable of holding the tank identifying information, reading the information from the main body of the recording apparatus, adding the memory information from the main body of the recording apparatus and changing or deleting the memorized information (cf. FIG. 2). The EEPROM 9*b* is mounted on a printed wiring board having a contact portion 9*a* to be electrically connected with a connected fixed in the main body of the recording apparatus, thereby integrally constituting the information memory medium 9.

In the information memory medium of contact type, since the contact portion 9*a* causes friction with and is abraded by the connector at each connection with the main body of the recording apparatus, there may also be employed an information memory medium 9 of non-contact type capable of power generation and communication by wireless system. Even in such non-contact type communication, the distance and direction of communication cannot be selected unconditionally. For achieving non-contact communication over a longer distance or irrespective of the direction, there is required a longer or larger antenna in each of the information memory medium 9 and the main body of the recording apparatus, thus increasing the dimension thereof. Therefore, by defining the direction and distance of the connector and the information memory medium unit according to the present invention, there can be provided a more efficient communication environment thereby allowing to compactize the antenna and also the dimension of the information memory medium 9 and the main body of the recording apparatus.

Mounting

Figure 5A:
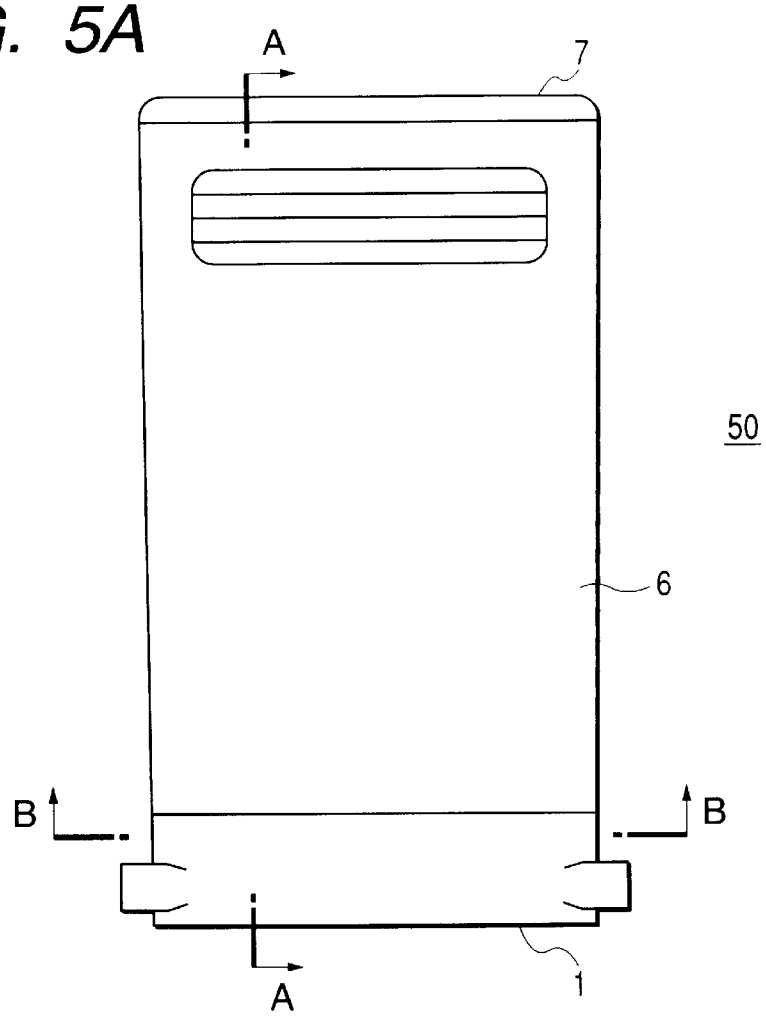
FIGS. 5A and 5B are respectively a schematic plan view and a schematic plan view, seen from below, of the ink tank shown in FIG. 1.
Figure 5B:
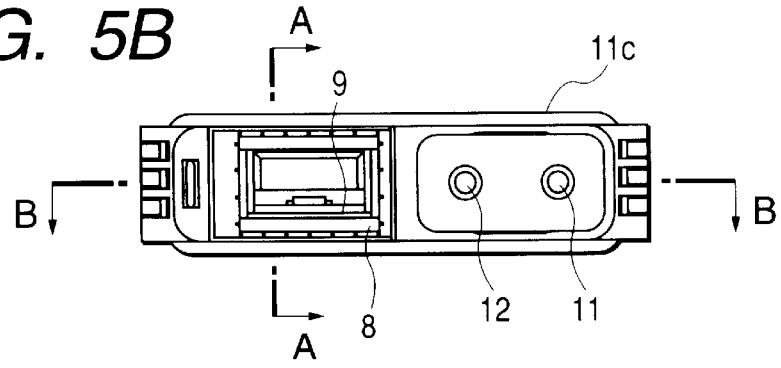

In the following there will be explained, with reference to FIGS. 5A and 5B to 9A and 9B, the process of mounting the ink tank of the present invention on the ink jet recording apparatus. FIGS. 5A and 5B are respectively a lateral view and a plan view seen from the side of the fluid connection apertures 11, 12, showing the external view of the ink tank embodying the present invention. FIGS. 6A, 7A, 8A and 9A are cross-sectional views along a line A—A in FIG. 5A while FIGS. 6B, 7B, 8B and 9B are cross-sectional views along a line B—B in FIG. 5A, showing different stages of mounting of the ink tank The ink tank 50 is inserted and mounted from above to below on an ink tank mounting portion of an unrepresented ink jet recording apparatus. The main body of the recording apparatus is normally provided with a guide mechanism, such as a guide rail, for causing the ink tank 50 to slide in a state for example in contact with a part of the lateral face thereof thereby enabling mounting in a predetermined position.

In the present embodiment, such guide mechanism is preferably so formed as to be capable of supporting the ink tank 50 even in a state where the position and direction thereof is somewhat changed, particularly in a state somewhat inclined from the vertical direction. Such configuration can be realized, for example, by slightly increasing the distance of guide members provided in positions sandwiching the ink tank 50. Such configuration allows a change in the mounting position and direction of the ink tank 50 even if the extending direction of the air introducing needle 529 and the ink supply needle 528 is slightly deviated from the vertical direction, thereby achieving straight introduction thereof into the fluid connection apertures 11, 12. It is thus rendered possible to avoid unnecessary stress on the elastic members 5, thus achieving satisfactory connection without ink leakage.

Figure 6A:
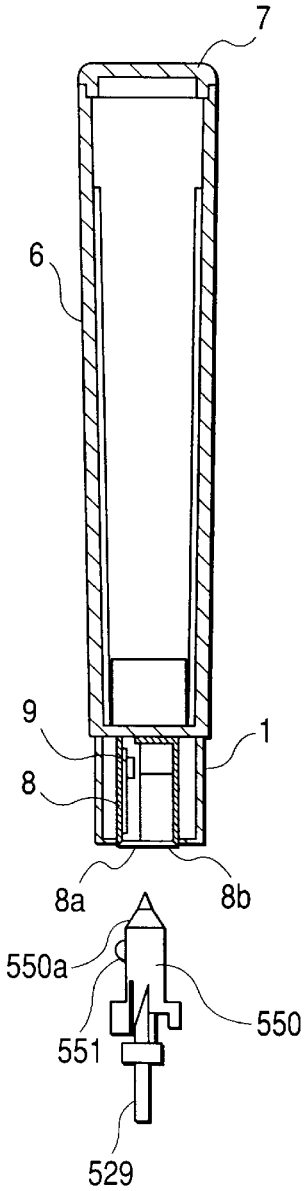
FIGS. 6A and 6B are cross-sectional views respectively along lines A—A and B—B in FIGS. 5A and 5B, of the ink tank shown in FIG. 1 in a stage in the course of mounting on an ink jet recording apparatus.
Figure 6B:
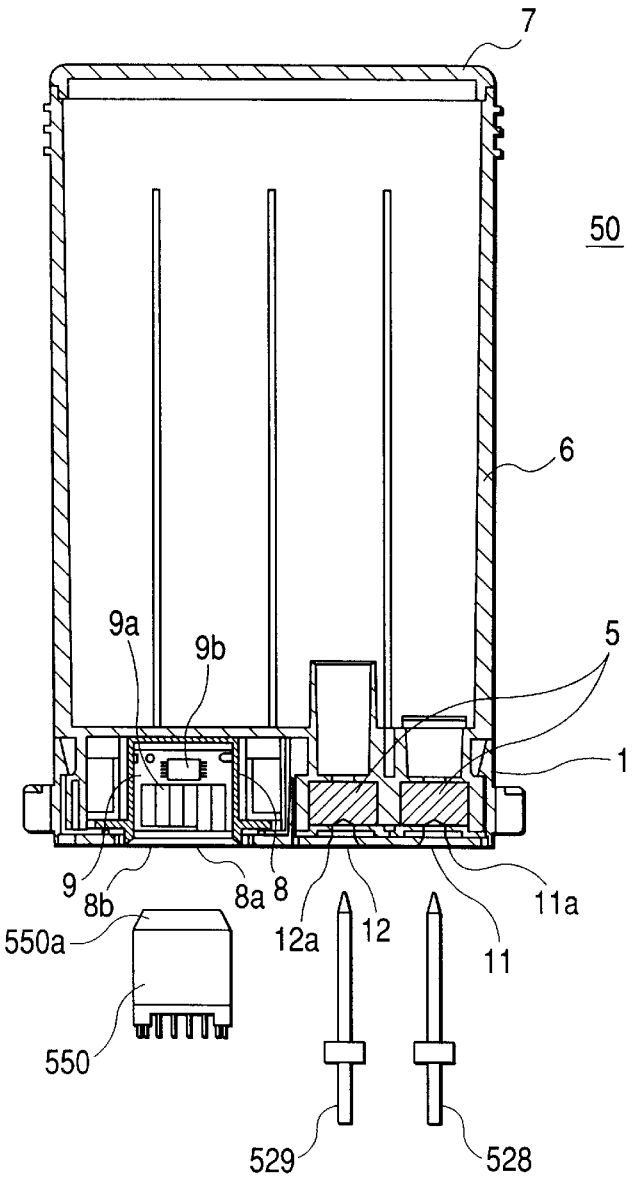

By mounting the ink tank 50 along the aforementioned guide mechanism of the main body, the ink tank 50 reaches a position shown in FIGS. 6A and 6B where the information memory medium holder 8 is opposed to the connector 550 of the main body, while the first fluid connection aperture 11 is opposed to the ink supply needle 528 of the main body, and the second fluid connection aperture 12 is opposed to the air introducing needle 529 of the main body. The connector 550 has a protruding shape fitting with the connection aperture 8*a* of the information memory medium holder 8, and is fixed in a vertical position as shown in FIGS. 6A and 6B. On a lateral face of the connector 550, an electrical contact 551 protrudes for contacting the contact portion 9*a* of the information memory medium 9 for making electrical connection. The electrical contact 551 is so constructed as to be capable of elastically changing the protruding amount, and, when the connector 550 is inserted into the information memory medium holder 8, it comes into contact with the contact portion 9*a* with an appropriate pressure thereby forming satisfactory electrical connection.

In FIGS. 6A and 6B, the connector 550, the air introducing needle 529 and the ink supply needle 528 alone are illustrated in the main body of the recording apparatus, but the air introducing needle 529 and the ink supply needle 528 are connected to the ink supply unit as explained in the foregoing and the connector 550 is connected to a control circuit of the recording apparatus and such additional configurations are omitted.

Figure 7A:
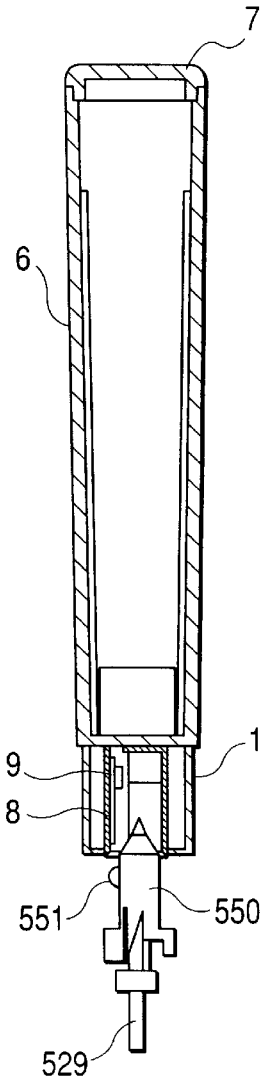
FIGS. 7A and 7B are views similar to FIGS. 6A and 6B but showing another stage.
Figure 7B:
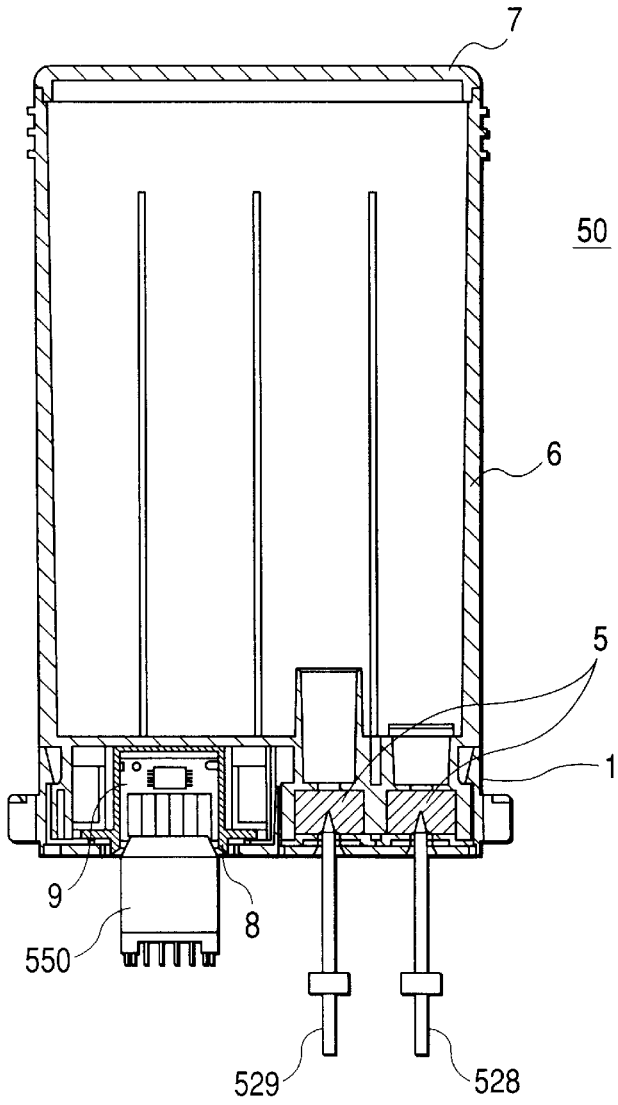

As the ink tank 50 is further lowered from the state shown in FIGS. 6A and 6B, the ink supply needle 528 and the air introducing needle 529 are inserted into the fluid connection apertures 11, 12 as shown in FIGS. 7A and 7B and penetrate the internal elastic members 5. The ink supply needle 528 and the air introducing needle 529 are pointed toward the front ends thereof and the fluid connection apertures 11, 12 are provided, at the entrances thereof, with tapered portions 11*a*, 12*a* so inclined that the holes become narrower toward the inside. Therefore, if the ink supply needle 528 and the air introducing needle 529 have a mutual positional aberration at the insertion into the fluid connection apertures 11, 12, such needles come into contact with the inclined lateral face of the tapered portions 11*a*, 12*a* thereby applying a force to the ink tank 50 in the horizontal direction. In this manner the ink tank 50 is adjusted in its position so as that the ink supply needle 528 and the air introducing needle 529 are aligned with the fluid connection apertures 11, 12.

In the present embodiment, two connecting positions are determined by the ink supply needle 528, the air introducing needle 529 and the fluid connection apertures 11, 12. Therefore, in the positional adjustment in the horizontal direction, the ink tank 50 is subjected not only to a parallel displacement in the horizontal direction but also to a rotational displacement in the horizontal plane.

Then, when the ink supply needle 528 and the air introducing needle 529 enter the fluid connection apertures 11, 12 to a certain extent, the end of the connector 550 comes into contact with the connection aperture 8*a* of the information memory medium holder 8. The connector 550 is provided at the front end thereof with a tapered portion 550*a* pointed toward the front end thereof and the connection aperture 8*a* of the information memory medium holder 8 is provided, at the entrance thereof, with a tapered portion 8*b* so inclined that the hole becomes narrower toward the inside. Therefore, if the connector 550 and the information memory medium holder 8 have a mutual positional aberration, the tapered portions 550*a* and 8*b* come into mutual contact thereby applying a force to the information memory medium holder 8 in the horizontal direction. As explained in the foregoing, the information memory medium holder 8 is rendered movable in the recess 101 of the information memory medium holder containing portion 6*d*, and the position adjustment is executed so as to align the connection aperture 8*a* and the connector 550 by the force applied in the horizontal direction. The information memory medium holder 8 is subjected not only to a parallel displacement but also to a rotational displacement in the horizontal plane.

Figure 8A:
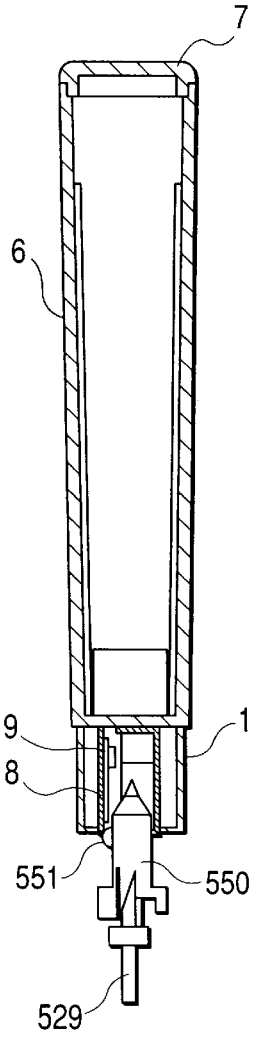
FIGS. 8A and 8B are views similar to FIGS. 6A and 6B but showing still another stage.
Figure 8B:
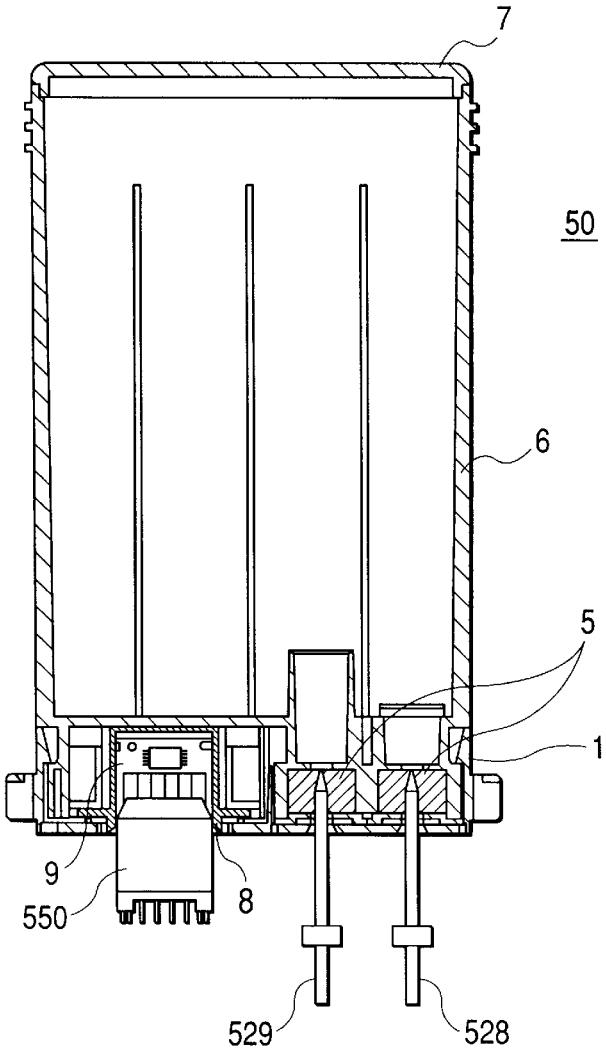
Figure 9A:
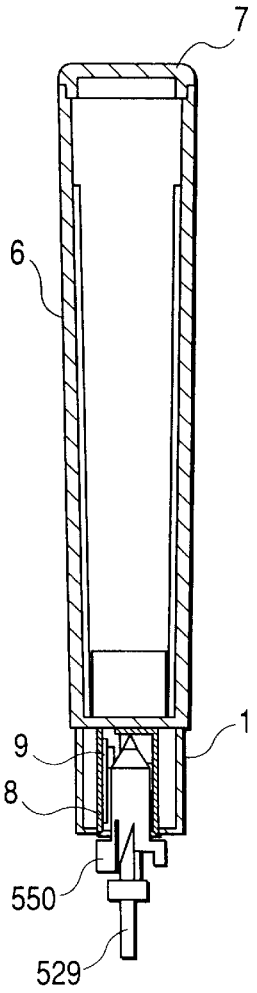
FIGS. 9A and 9B are views similar to FIGS. 6A and 6B but showing still another stage.
Figure 9B:
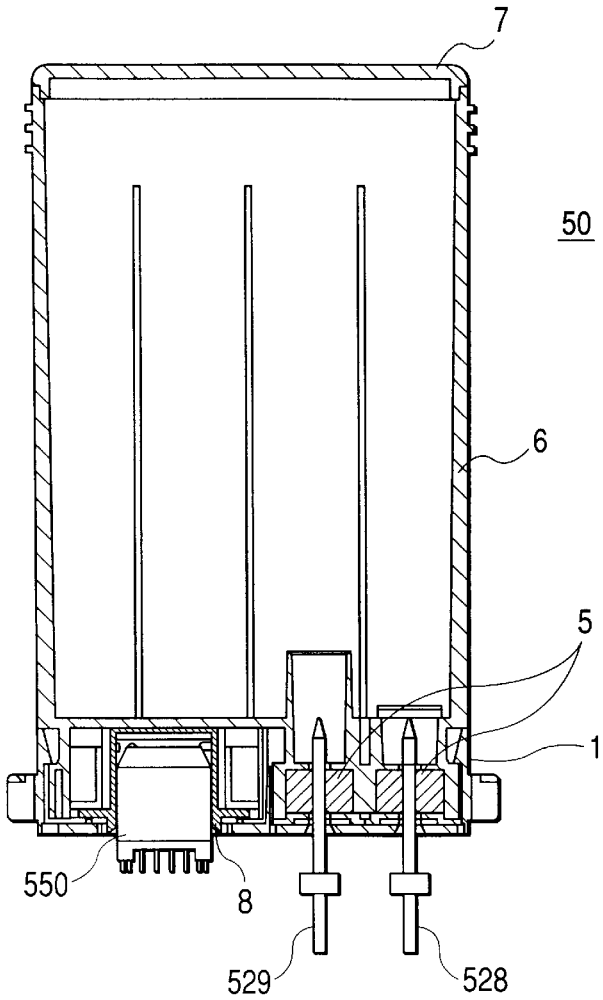

As the ink tank 50 is further lowered downwards, the ink supply needle 528 and the air introducing needle 529 further enter the fluid connection apertures 11, 12 as shown in FIGS. 8A and 8B. In such operation, the needles 528, 529 come into contact, at the lateral faces thereof, with the lateral faces of the fluid connection apertures 11, 12 whereby the direction of the ink tank 50 is so adjusted that the needles 528, 529 can enter straightly the fluid connection apertures 11, 12.

As the ink tank 50 is further lowered downwards, the connector 550 also enters the connection aperture 8*a* of the information memory medium holder 8 and the lateral face of the connector 550 comes into contact with the lateral face of the connection aperture 8*a*, whereby the direction of the information memory medium holder 8 is so adjusted that the connector 8*a* can enter straightly the connection aperture 8*a*.

When the ink tank 50 is further lowered downwards and the connector 50 further enters the connection aperture 8*a*, the electrical contact 551 of the connector 550 comes into contact with the lateral face of the information memory medium holder 8 thereby being retracted. When the mounting proceeds to a state shown in FIGS. 9A and 9B, the electrical contact 551 is pressed to the electrical contact 551 of the information memory medium 9 under an appropriate pressure as explained in the foregoing whereby the information memory medium 9 is electrically connected with the main body of the recording apparatus.

In the present embodiment, as explained in the foregoing, the mounting position and direction of the ink tank 50 are adjusted based on the ink supply needle 528 and the air introducing needle 529 in such a manner that such needles can straightly enter the fluid connection apertures 11, 12. On the other hand, the information memory medium holder 8 changes its position and direction, namely being equalized, in such a manner that the connector 550 can straightly enter the connection aperture 8*a* of the information memory medium holder 8. In such operation, the information memory medium holder 8 is so constructed as to be capable of changing the position and direction relative to other portions of the ink tank 50, particularly to the fluid connection apertures 11, 12, so that the equalizing operation can be achieved without changing the position and direction of the ink tank 50, thus without generating unnecessary stress in the fluid connecting portions.

As explained in the foregoing, the present embodiment can achieve fluid connection without causing unnecessary stress in the connecting portions and satisfactory electrical connection at the same time.

Floating Support of Information Memory Medium Holder

Figure 10:
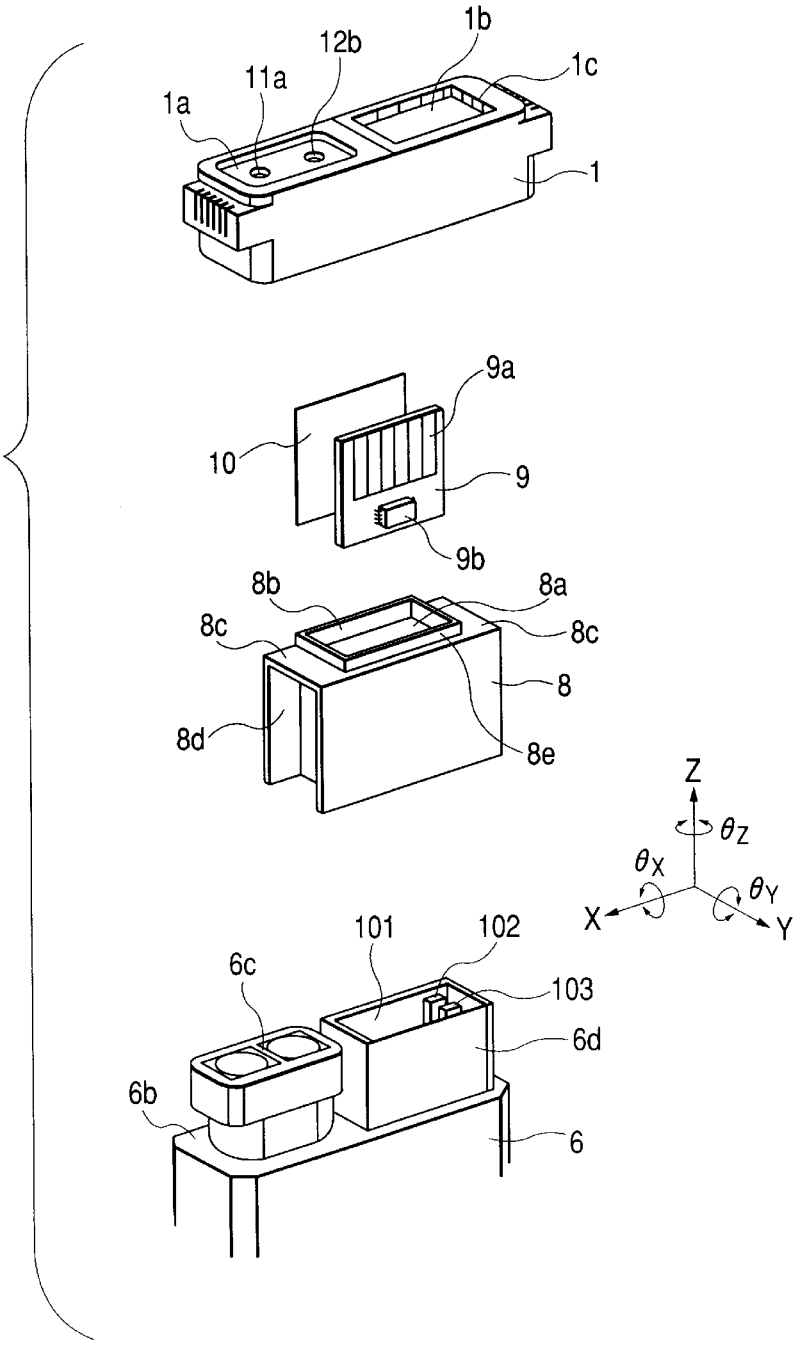
FIG. 10 is a magnified exploded perspective view around an information memory medium in the ink tank shown in FIG. 1.
Figure 19:
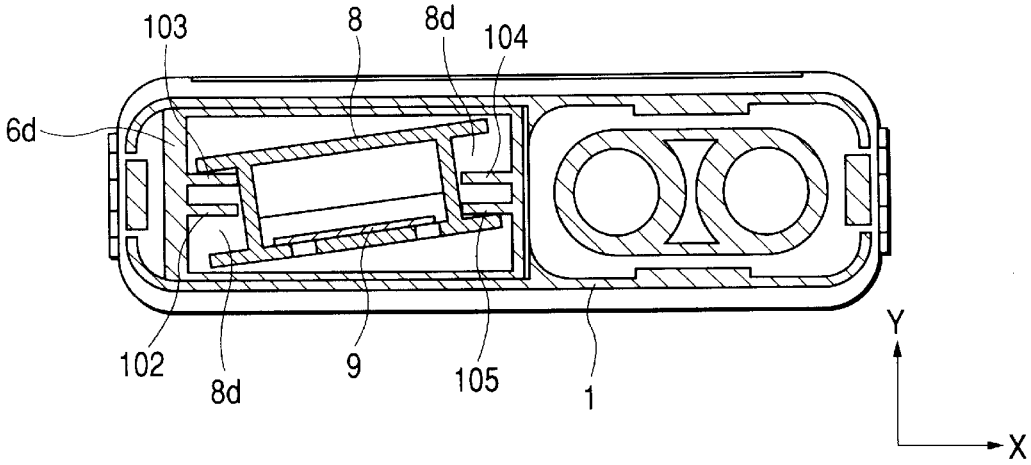
FIG. 19 is a cross-sectional view similar to FIG. 15 showing a state in which the information memory medium holder is rotated fully counterclockwise in the drawing.
Figure 20:
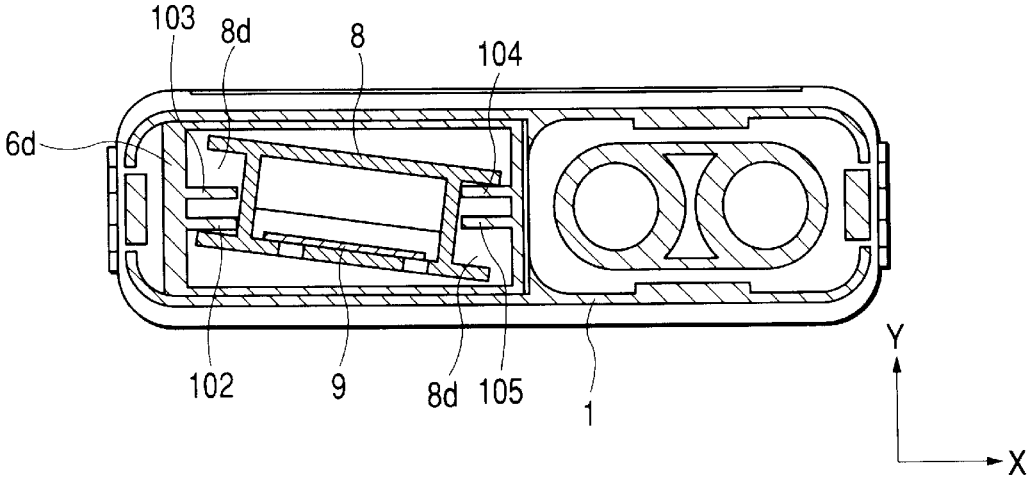
FIG. 20 is a cross-sectional view similar to FIG. 15 showing a state in which the information memory medium holder is rotated fully clockwise in the drawing.
Figure 21:
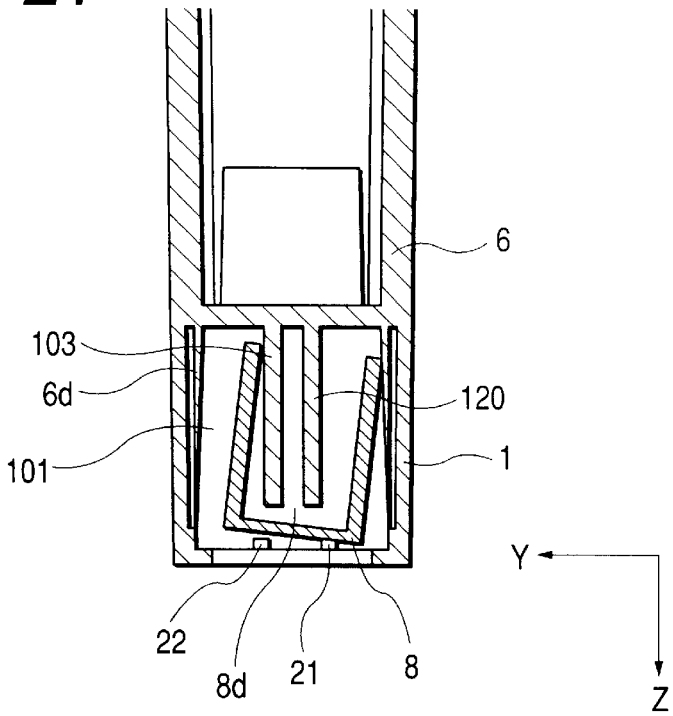
FIG. 21 is a cross-sectional view along a Y-Z plane shown in FIG. 10, showing the vicinity of the information memory medium in the ink tank shown in FIG. 1, in a state in which the information memory medium holder is fully rotated clockwise in the drawing.
Figure 22:
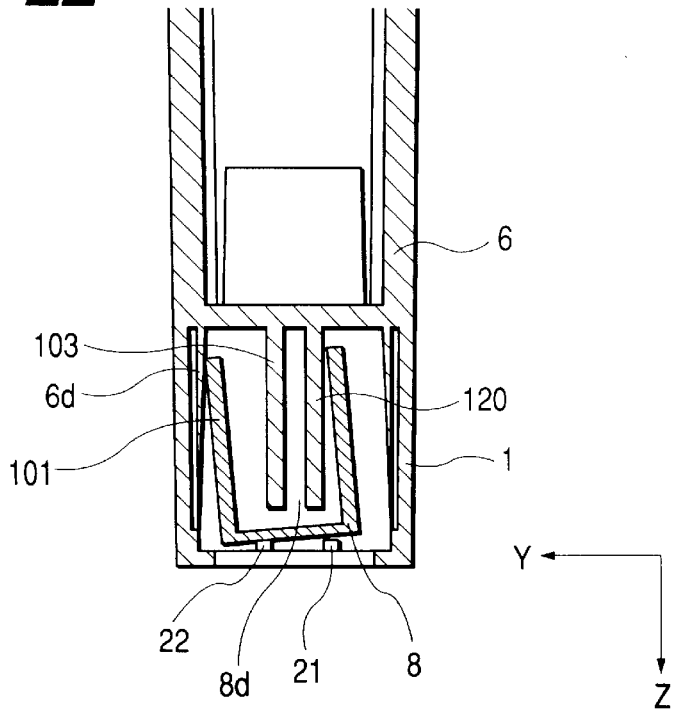
FIG. 22 is a cross-sectional view similar to FIG. 21 showing a state in which the information memory medium holder is rotated fully counterclockwise in the drawing.

In the following there will be explained, with reference to FIGS. 10 to 22, the supporting of the information memory medium holder in the floating state, wherein FIG. 10 is an exploded perspective view of the ink tank 50 while FIGS. 11 to 22 are cross-sectional views of the ink tank 50 in magnified manner in the vicinity of the information memory medium holder 8. FIGS. 11 to 14 are cross-sectional views along an X-Z plane shown in FIG. 10 at the approximate middle of the information memory medium holder containing portion 6*d*, while FIGS. 15 to 20 are cross-sectional views along an X-Y plane shown in FIG. 10, seen from the bottom side, and FIGS. 21 and 22 are cross-sectional views along a Y-Z plane shown in FIG. 10, seen from the side of the information memory medium holder containing portion 6*d*.

The information memory medium holder 8, supporting the information memory medium 9 in the connection aperture 8*a* by the double-sided adhesive tape, is surrounded and supported by the information memory medium holder containing portion 6*d* formed on the bottom 6*b* of the ink container 6 and the bottom cover 1. The space surrounded by the information memory medium holder containing portion 6*d* and the bottom cover 1 is made larger than the information memory medium holder 8 over the entire periphery thereof in such a manner that the information memory medium holder 8 can displace within predetermined ranges in the X, Y and Z directions and can also rotate within predetermined ranges about the X, Y and Z axes.

In the present embodiment, the information memory medium holder 8 is so constructed that the contacting area thereof with the information memory medium holder containing portion 6*d* and with the bottom cover 1 does not become too large in order that the information memory medium holder 8 can be smoothly equalized by the force applied by contact with the connector 550 in the main body of the recording apparatus. As a reduced contact area limits the frictional force at the contact portion, the information memory medium holder 8 can move smoothly. In order to thus reduce the contact area and to appropriately limit the movable range of the information memory medium holder 8, projecting and recessed portions are formed on the information memory medium holder 8, information memory medium holder containing portion 6*d* and bottom cover 1.

Around the connection aperture 8*a* of the information memory medium holder 8, there is formed a connection aperture rim 8*e* protruding in the Z-direction. On both sides of the connection aperture rim 8*e* in the X-direction, there are formed flat shoulder portions 8*c* slightly lower than the rim 8*e*. On both lateral faces of the information memory medium holder 8 in the X-direction, there are formed rectangular recesses 8*d* penetrating to a face opposite to the face including the connection aperture 8*a*.

The recess 101 of the information memory medium holder containing portion 6*d* is provided, on both lateral faces thereof in the X-direction, respectively with ribs 102, 103 and ribs 104, 105. These ribs 102, 103, 104, 105 are extended in the Z-direction to the bottom of the recess 101 and protrude in the X-direction to the interior of the recess 8*d* of the information memory medium holder 8. Thus, the information memory medium holder 8 is placed in the recess 101 of the information memory medium holder containing portion 6*d* in such a manner that the ribs 102, 103, 104, 105 enter the recesses 8*b* from the apertures thereof in the Z-direction.

On the internal face of the bottom cover 1, four projections 21, 22, 23, 24 protruding in the Z-direction are formed in positions around the information memory medium connecting aperture 1*b* and opposed to the shoulder portions 8*c* of the information memory medium holder 8 but the projection 24 is not shown in the drawings.

In the following there will be explained the movable range of the information memory medium holder 8.

Figure 11:
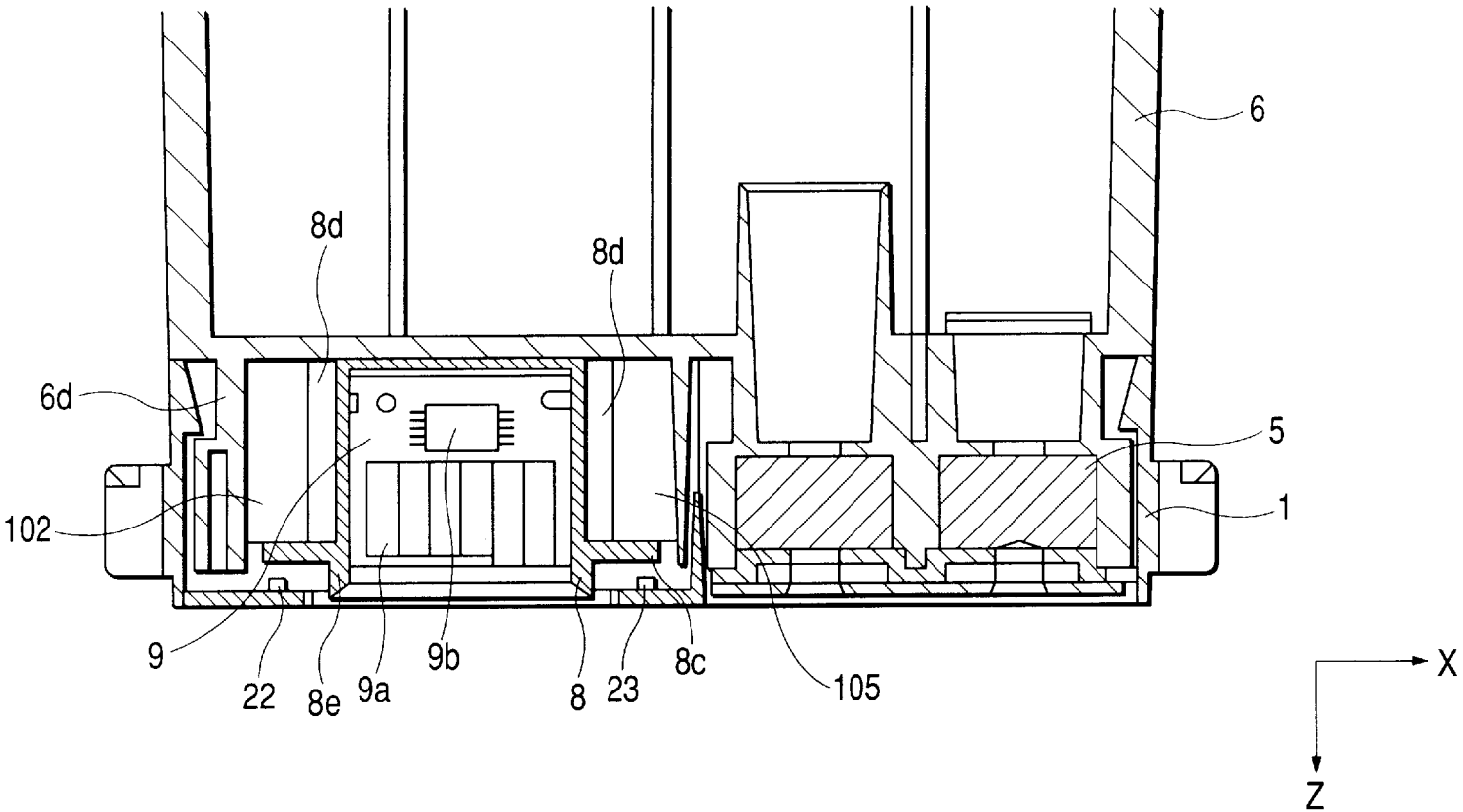
FIG. 11 is a cross-sectional view along an X-Z plane shown in FIG. 10, showing the vicinity of the information memory medium in the ink tank shown in FIG. 1 in magnified manner, in a state in which an information memory medium holder is fully moved upwards in the drawing.
Figure 12:
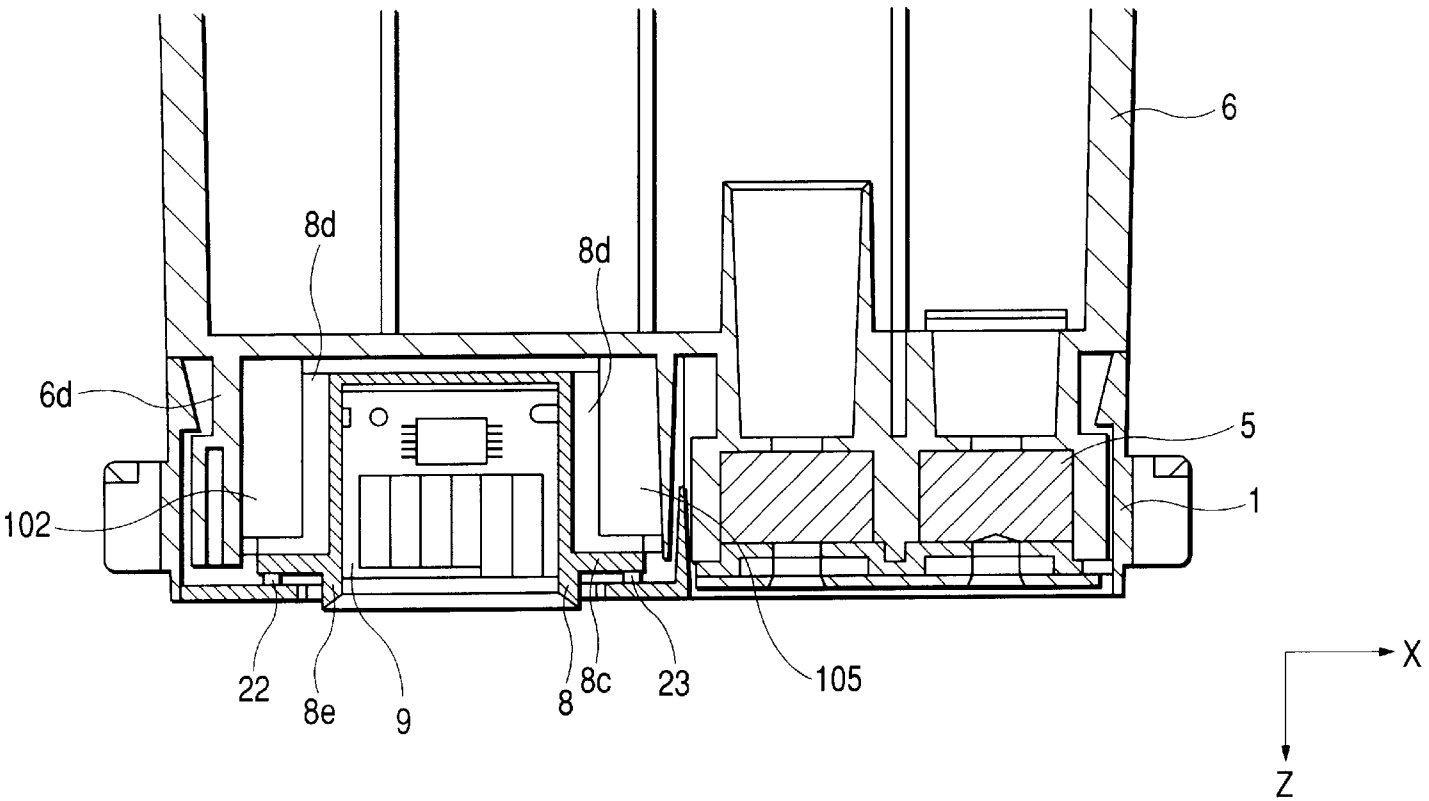
FIG. 12 is a cross-sectional view similar to FIG. 11 showing a state in which the information memory medium holder is moved fully downwards in the drawing.

At first, upwards in the Z-direction, the information memory medium holder 8 can move until lateral face at the side of the connection aperture 8*a* of the recess 8*d* impinges on the ribs 102, 103, 104, 105 of the information memory medium holder containing portion 6*d* as shown in FIG. 11. Downwards in the Z-direction, the information memory medium holder 8 can move until the shoulder portions 8*c* impinges on the projections 21, 22, 23, 24 of the bottom cover 1 as shown in FIG. 12. In this manner a gap of at least a predetermined amount is secured between the shoulder portions 8*c* of the information memory medium holder 8 and the internal surface of the bottom cover 1. In this manner the ink guided to the capillary grooves 1*c* of the bottom cover 1 is not easily transmitted to the shoulder portions 8*c* as explained in the foregoing, whereby the information memory medium 9 is prevented from contact with the ink.

Figure 13:
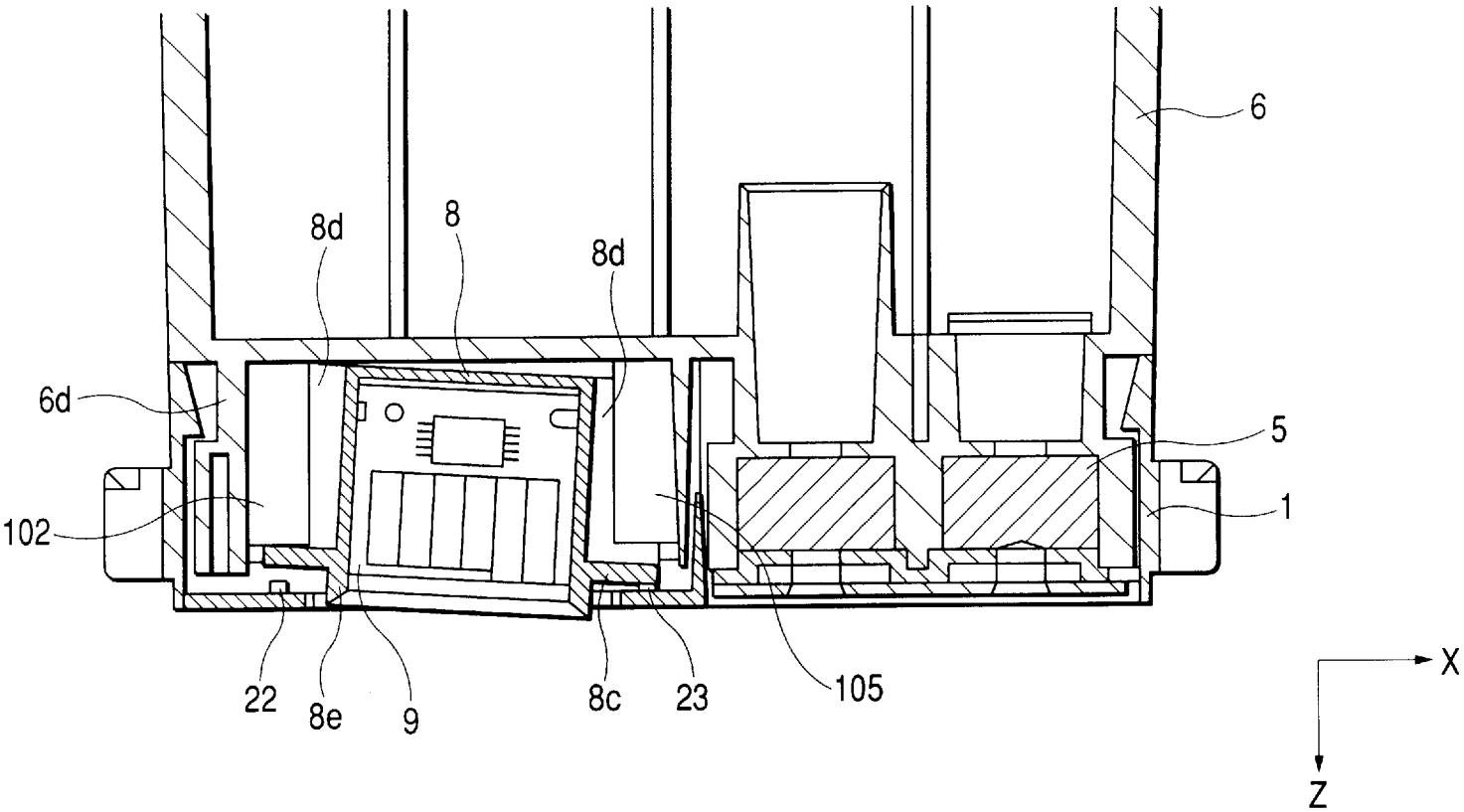
FIG. 13 is a cross-sectional view similar to FIG. 11 showing a state in which the information memory medium holder is rotated fully clockwise in the drawing.
Figure 14:
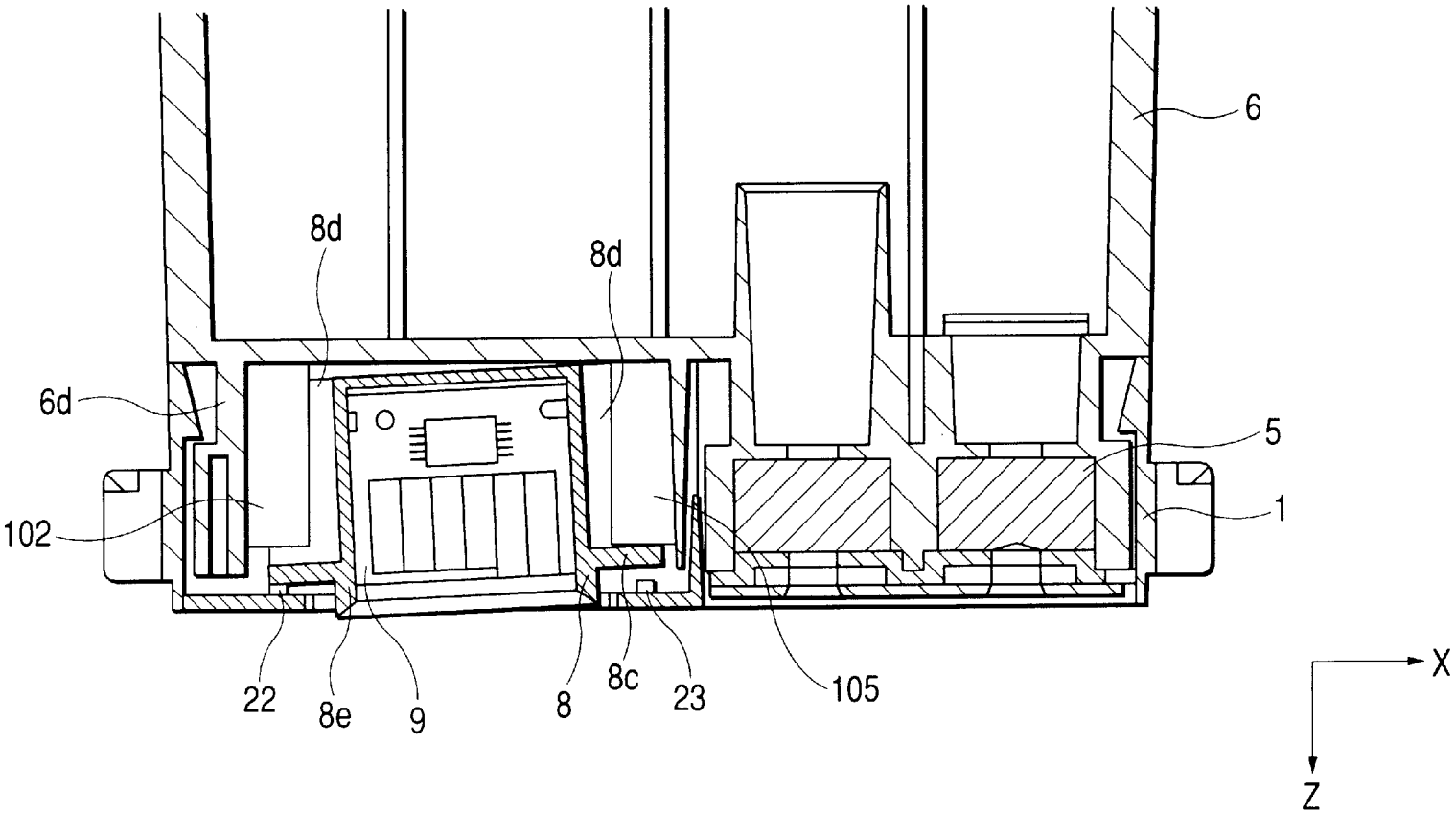
FIG. 14 is a cross-sectional view similar to FIG. 11 showing a state in which the information memory medium holder is rotated fully counterclockwise in the drawing.

Then, in the rotational direction $\theta_Y$ about the Y-axis, the information memory medium holder 8 can rotate clockwise in FIG. 13, until a shoulder portion 8*c* impinges on the two projections 23, 24 at a side and a lateral face at the side of a connection aperture 8*a* at a recess 8*d* impinges on the ribs 102, 103 at a side of the information memory medium holder containing portion 6*d*. In the opposite direction, as shown in FIG. 14, the information memory medium holder 8 can rotate until a shoulder portion 8*c* impinges on the two projections 21, 22 at a side and a lateral face at the side of a connection aperture 8*a* at a recess 8*d* impinges on the ribs 104, 105 at a side of the information memory medium holder containing portion 6*d*.

Figure 15:
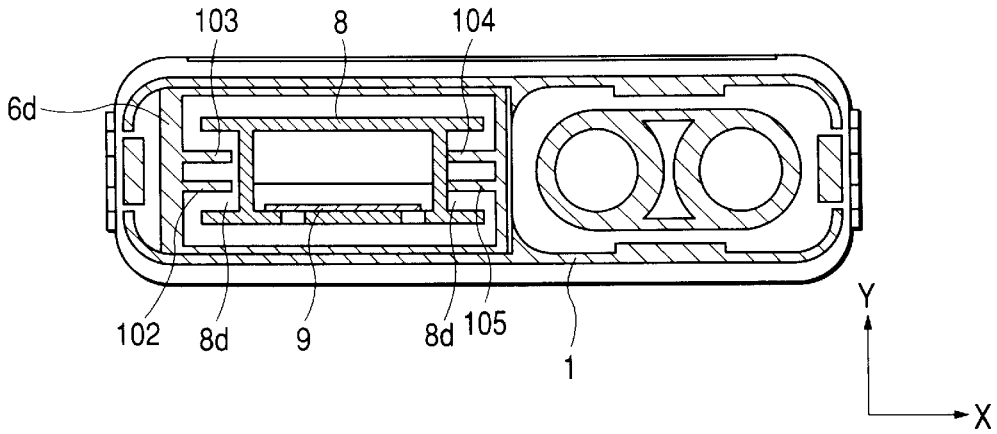
FIG. 15 is a cross-sectional view along an X-Y plane shown in FIG. 10, showing the vicinity of the information memory medium in the ink tank shown in FIG. 1, in a state in which the information memory medium holder is fully moved to the right in the drawing.
Figure 16:
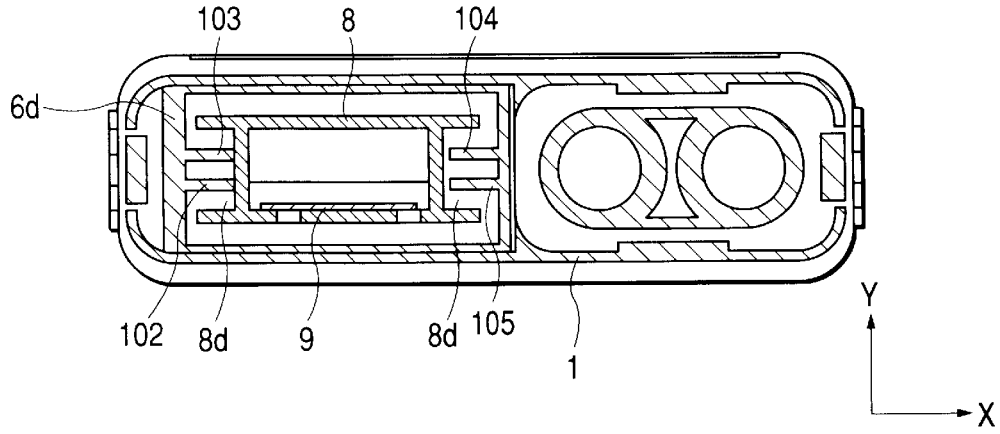
FIG. 16 is a cross-sectional view similar to FIG. 15 showing a state in which the information memory medium holder is moved fully to the left in the drawing.
Figure 17:
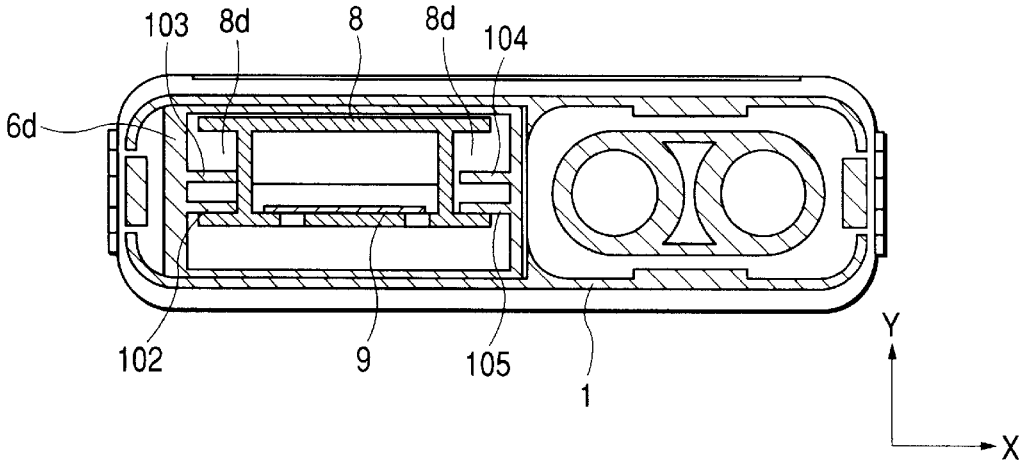
FIG. 17 is a cross-sectional view similar to FIG. 15 showing a state in which the information memory medium holder is moved fully upwards in the drawing.
Figure 18:
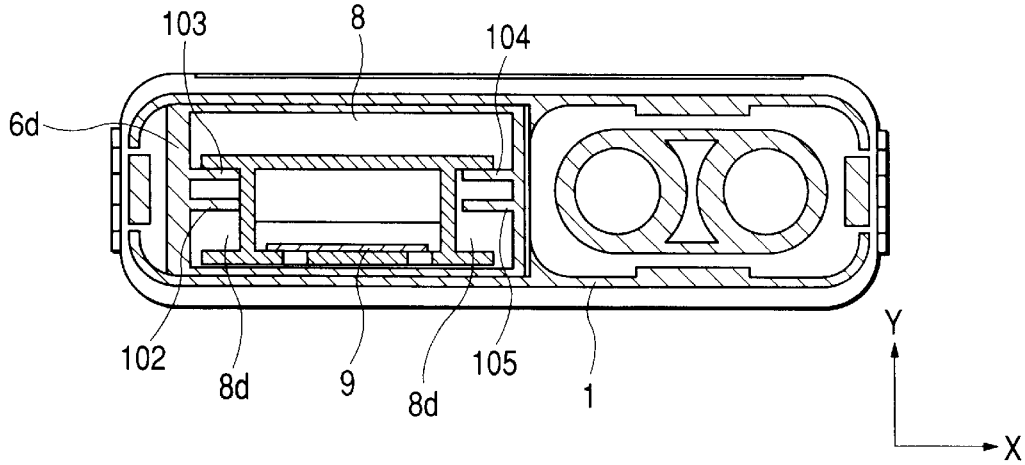
FIG. 18 is a cross-sectional view similar to FIG. 15 showing a state in which the information memory medium holder is moved fully downwards in the drawing.

Then, in the X-direction, the information memory medium holder 8 can move between a position where the bottom face of a recess 8*d* impinges on the right ribs 104, 105 shown in FIG. 15 and a position where the bottom face of the recess 8*d* at the opposite side impinges on the ribs 102, 103 as shown in FIG. 16. In the X-direction, the information memory medium holder 8 can move between a position where the lower lateral face, shown in FIG. 17, of the recess 8*d* impinges on the lower ribs 102, 105 as shown in FIG. 17 and a position where the upper lateral face, shown in FIG. 18, of the recess 8*d* impinges on the ribs 103, 104 as shown in FIG. 18.

Then, in the rotational direction $\theta_Z$ about the Z-axis, the information memory medium holder 8 can rotate counterclockwise in FIG. 19, until a lower right lateral face, shown in FIG. 19, of the recess 8*d* impinges on the rib 105 and an upper right lateral face, shown in FIG. 19, of the recess 8*d* impinges on the rib 103. Similarly, in the opposite direction, as shown in FIG. 20, the information memory medium holder 8 can rotate until the lateral faces of the recesses 8*d* respectively impinge on the ribs 102, 104.

Then, in the rotational direction $\theta_X$ about the X-axis, the information memory medium holder 8 can rotate clockwise in FIG. 21, until the upper end of the left lateral face, shown in FIG. 21, of the recess 8*d* impinges on the ribs 103, 104 and the shoulder portion 8*c* impinges on the right projections 21, 24. Similarly, in the opposite direction, the information memory medium holder 8 can rotate until the upper end of the right lateral face, shown in FIG. 22, of the recess 8*d* impinges on the ribs 102, 105 and the shoulder portion 8*c* impinges on the left projections 22, 23.

As explained in the foregoing, the information memory medium holder 8 is so supported as to be capable of changing the position and direction within a predetermined range. In such situation, the movable range of the information memory medium holder 8 can be adjusted by suitably determining the size and position of the recesses and projections in various positions. Such movable range is preferably selected slightly larger than the maximum aberration in position and direction between the fluid connecting portion and the information memory medium connecting portion, eventually resulting from the tolerance of the precision. In this manner the equalizing operation of the information memory medium holder 8 allows to attain satisfactory connection in the fluid connecting portion and in the information memory medium connecting portion without generating unnecessary stress therein. Also in the equalizing operation in any direction, there is always secured a gap of at least a predetermined amount between the shoulder portion 8*c* of the information memory medium holder 8 and the internal surface of the bottom cover 1 as explained in the foregoing, whereby the ink guided to the capillary grooves 1*c* of the bottom cover 1 is not easily transmitted to the shoulder portions 8*c* and the information memory medium 9 is prevented from contact with the ink as explained in the foregoing.

The configuration of the projections and recesses provided on the information memory medium holder 8, the information memory medium holder containing portion 6*d* and the bottom cover 1 can be altered suitably, such as forming ribs on the lateral faces of the information memory medium holder 8 and forming ribs, so as to sandwich the aforementioned ribs, on the lateral faces of the information memory medium holder containing portion 6*d*.

In the following there will be explained the adjoining of the bottom cover 1 with reference to FIGS. 39A, 39B and 40.

Figure 39A:
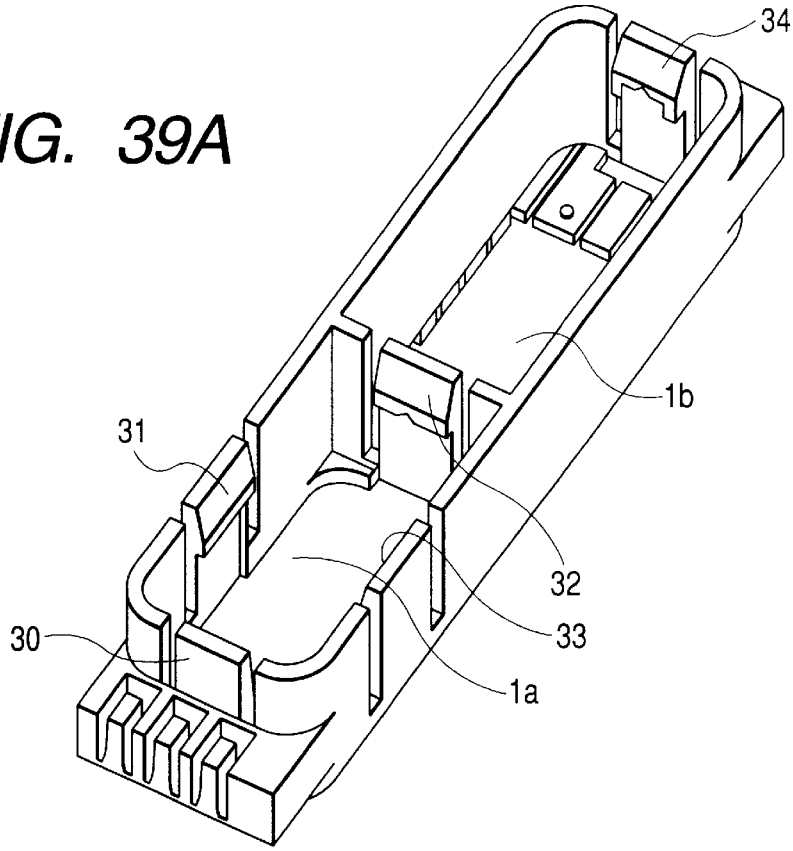
FIGS. 39A and 39B are perspective views showing another configuration of a bottom cover.
Figure 39B:
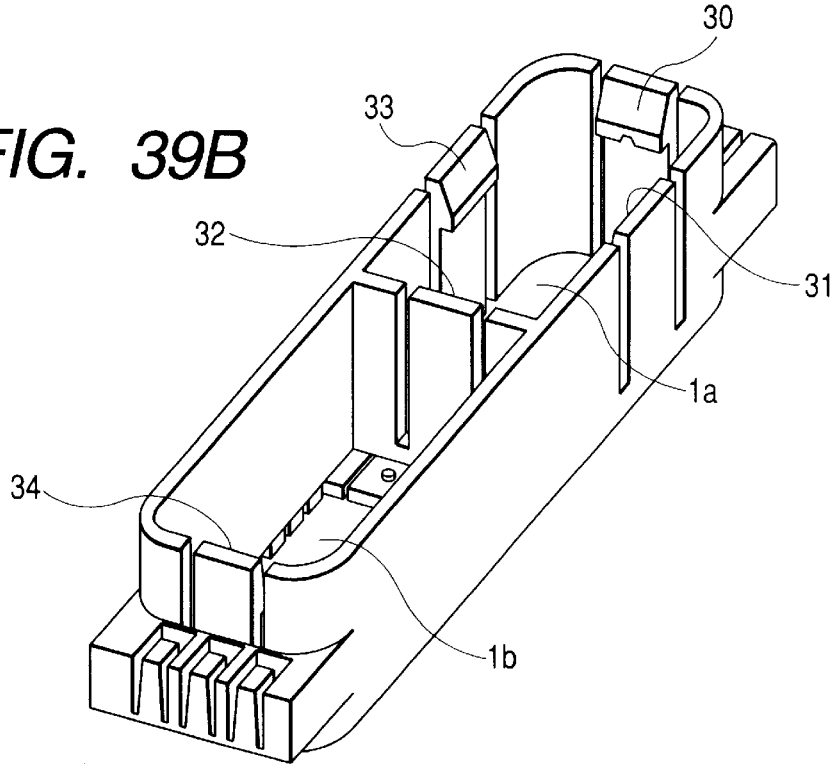

FIGS. 39A and 39B are views showing the details of the bottom cover 1 and an adjoining finger provided thereon, among the components of the present embodiment. FIG. 39A is a perspective view of the interior of the bottom cover 1, showing the arrangement of first to third connecting fingers 30 to 32 and a fifth connecting finger 34. FIG. 39B is a perspective view seen from a direction opposite to that in FIG. 39A, and showing the first connecting finger 30 and a fourth connecting finger 33. FIG. 40 is a perspective view showing the engaging relationship of the bottom cover 1 and the liquid container, wherein the bottom cover 1 is cut off at an arbitrary position to illustrate the engaging relationship between the internal second connecting finger 31 and the ink container 6.

As explained in the foregoing, the ink tank 50 is provided, on the bottom face 6*b* of the ink container 6 opposite to the face adjoined to the cover 7, with a fluid connection aperture guiding portion 6*c* and an information memory medium holder containing portion 6*d* so as to protrude from such face. The bottom cover 1 is so provided as to cover these. The bottom cover 1 is provided with the fluid connecting aperture 11*a* at a position opposed to the fluid connection aperture guiding portion 6*c* and the information memory medium connecting aperture 1*b* at a position opposed to the information memory medium holder containing portion 6*d*.

Also as shown in FIGS. 39A and 39B, the bottom cover 1 is provided with first to fifth connecting fingers 30 to 34 for engaging with an adjoining portion 6*c* of the ink container 6.

Figure 40:
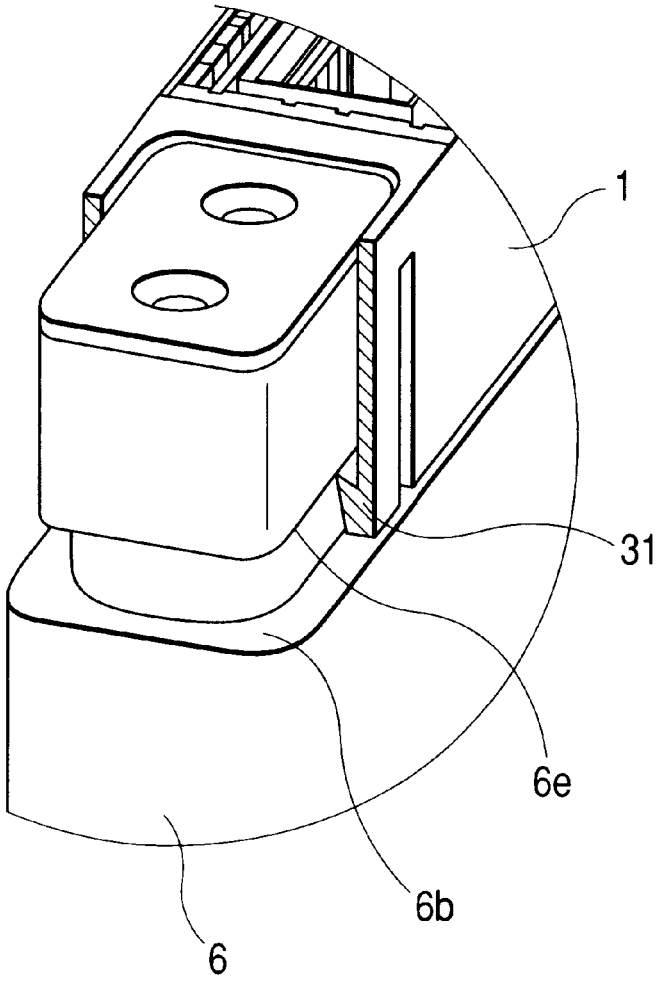
FIG. 40 is a partially cut-off perspective view of the bottom cover shown in FIGS. 39A and 39B, in a state mounted on an ink container.

Then, as shown in FIG. 40, in the ink container 6 and the bottom cover 1, the second connecting finger 31 and the adjoining portion 6*a* mutually engage in loose manner, maintaining a small gap therebetween. Also, though not illustrated, other first, third, fourth and fifth connecting fingers 30, 32, 33, 34 engage with the adjoining portion 6*e* of the ink container 6 in a similar manner as the second connecting finger 31.

In such configuration, in case the liquid container not mounted in the ink jet recording apparatus is erroneously dropped for example onto a floor, the first to fifth connection fingers 30 to 34 of the bottom cover 1 cause an elastic deformation to absorb the impact of dropping thereby preventing the information memory medium, contained in the bottom cover 1, from destruction by the impact of dropping.

Also the first to fifth connecting fingers 30 to 34 are preferably provided, on both sides thereof, with slits as shown in FIGS. 39A and 39B in order to increase the elastic effect of such connecting fingers. There may also be employed not only such slits but any configuration enabling elastic deformation of the connecting fingers, and a similar effect can be obtained by reducing the thickness of the adjoining portion of the bottom cover 1 or of the vicinity thereof.

In the following there will be explained another connecting method of the bottom cover 1 with reference to FIGS. 41 to 43.

Figure 41:
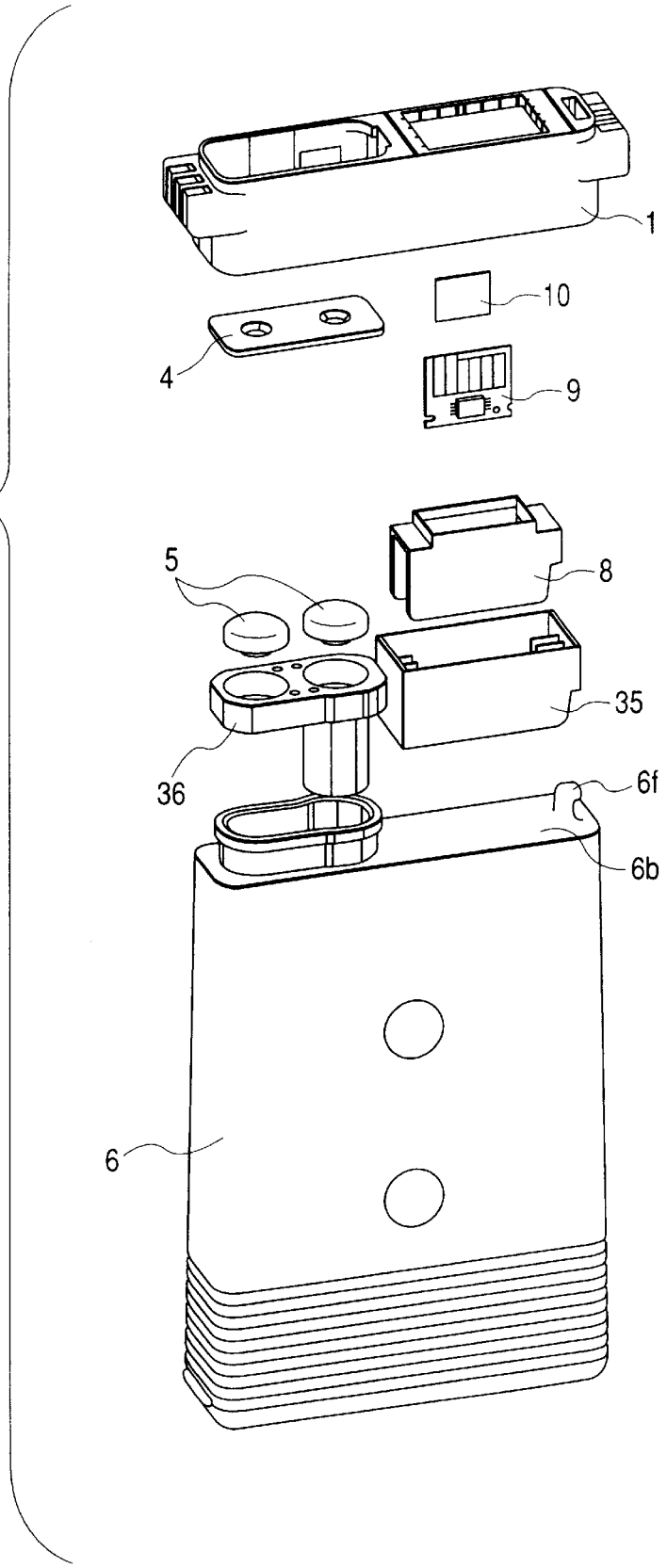
FIG. 41 is an exploded perspective view of an ink tank utilizing the bottom cover shown in FIGS. 39A and 39B.
Figure 42:
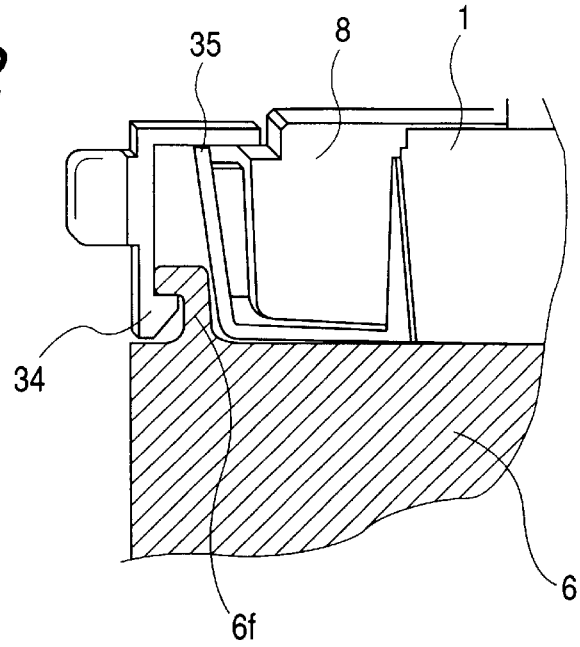
FIGS. 42 and 43 are perspective views showing a state in which the bottom cover is mounted on the ink container.
Figure 43:
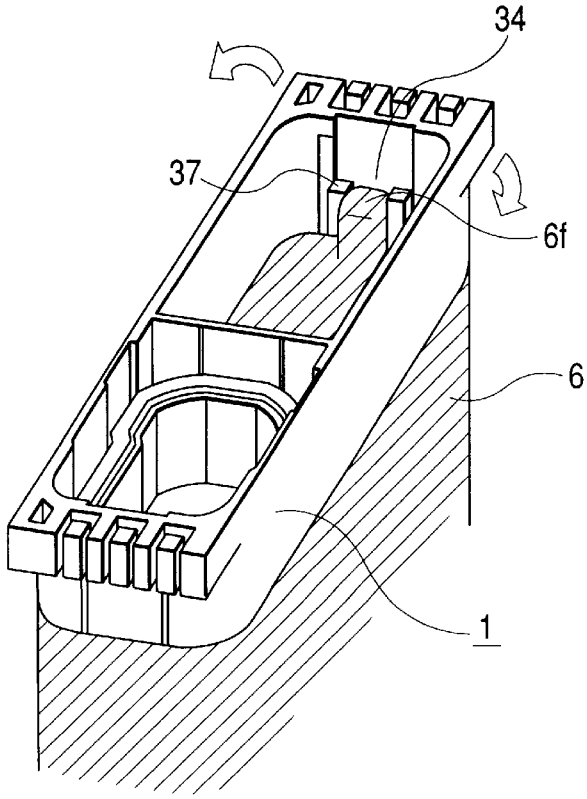
Figure 44A:
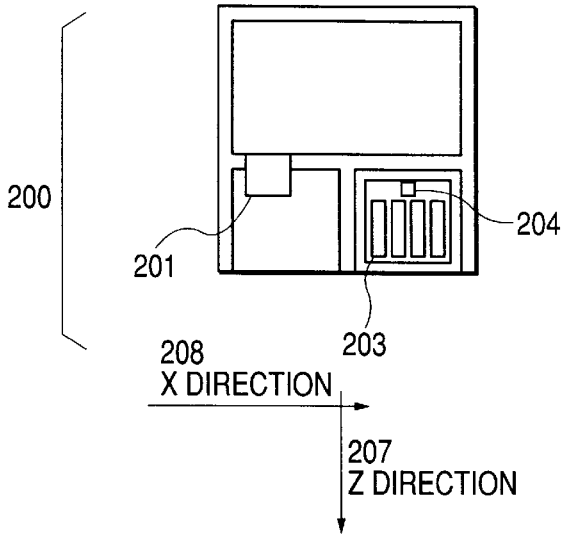
FIG. 44A PRIOR ART
FIGS. 44A and 44B are views showing a configuration of a conventional ink tank.
Figure 44B:
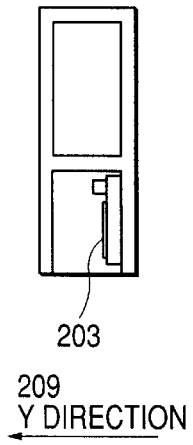
FIG. 44B PRIOR ART
Figure 45A:
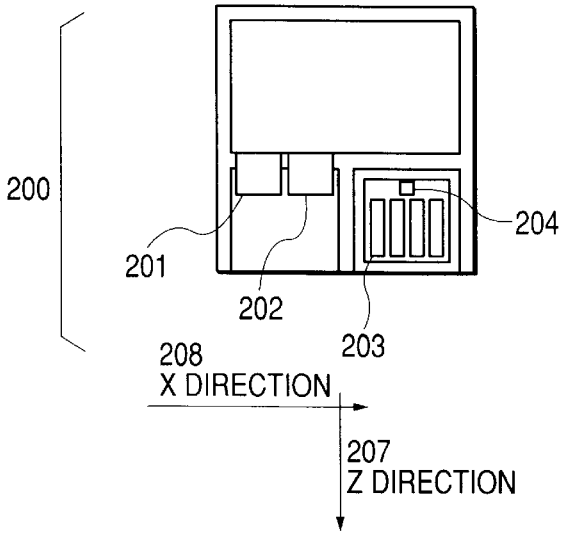
FIG. 45A PRIOR ART
FIGS. 45A and 45B are views showing another configuration of the conventional ink tank.
Figure 45B:
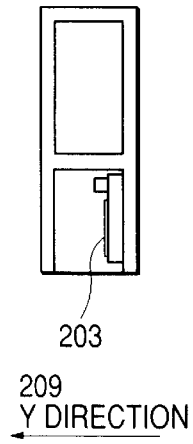
FIG. 45B PRIOR ART
Figure 46A:
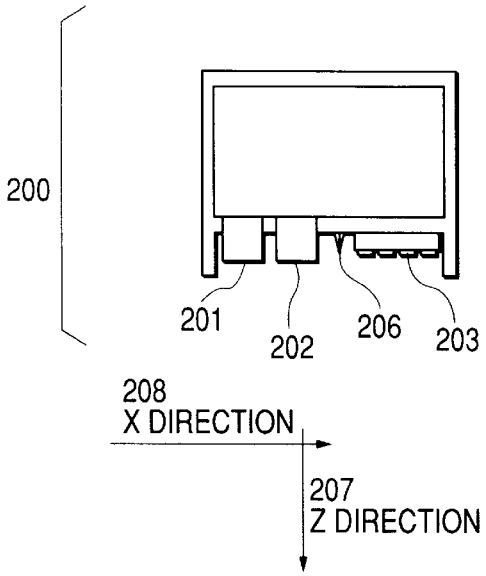
FIG. 46A PRIOR ART
FIGS. 46A and 46B are views showing still another configuration of the conventional ink tank.
Figure 46B:
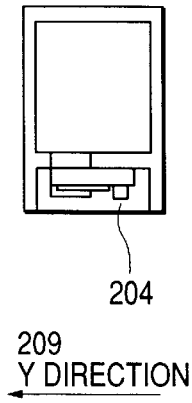
FIG. 46B PRIOR ART
Figure 47:
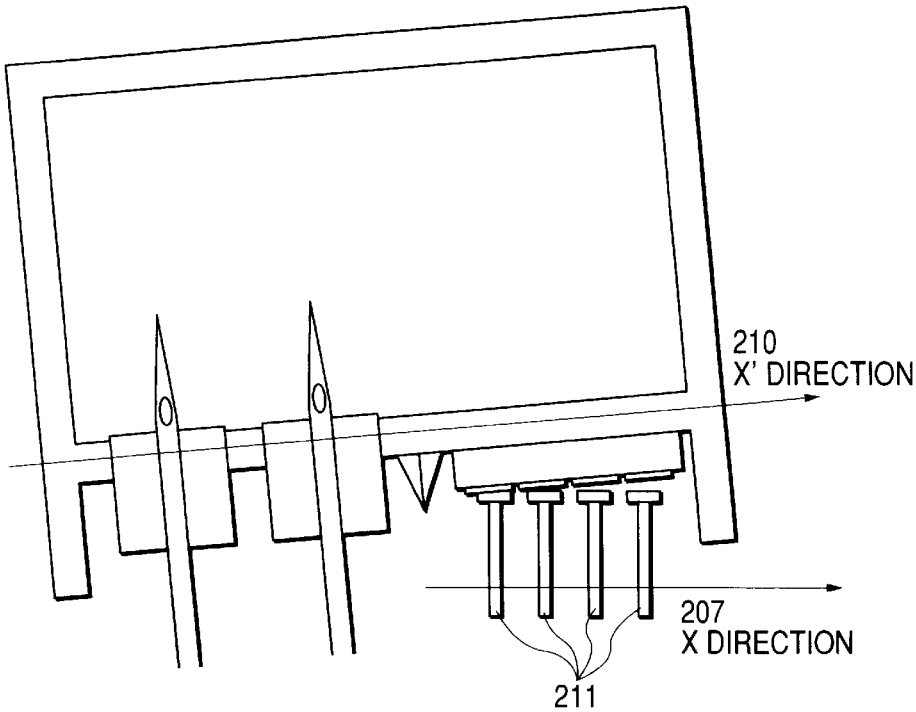
FIG. 47 is a schematic view showing a failure in the mounting of the ink tank.

FIG. 41 is an exploded perspective view showing another configuration of the ink tank 50, while FIG. 42 is a cross-sectional view showing the connection between the ink container 6 and the bottom cover 1, and FIG. 43 is a perspective view in which the components other than the ink container 6 and the bottom cover 1 are omitted in order to show the connection between the ink container 6 and the bottom cover 1, and the bottom cover 1 is cut off at an arbitrary height in order to facilitate observation of the connecting portion.

The configuration shown in FIG. 41 is basically different from the configuration shown in FIG. 2 etc. in that the main portion of the information memory medium holder is separated from the bottom 6*b* of the ink container 6 and a connecting portion 6*f* is instead added to the bottom 6*b*. In addition, the ink container 6 is formed by blow molding and is integrally formed with the cover 7. Also an elastic member containing portion 36 for containing the elastic members is newly added, and is adjoined for example by ultrasonic fusion to the ink container 6. Other configurations are equivalent to those shown in FIG. 2 etc. and the components other than those explained in the following are common in configuration and in function and will not be explained further.

As shown in FIG. 42, the bottom face 6*b* of the ink container 6 is provided with a connecting portion 6*f* so as to protrude from such face. The connecting portion 6*f* engages with the fifth connecting finger 34 provided on the bottom cover 1, and an information memory medium holder containing portion 35, separate from the ink container 6, is provided at a side opposite to the engaging portion of the connecting portion 6*f*. The information memory medium holder containing portion 35 contains the information memory medium holder 8, and the bottom cover 1 is so provided as to cover these components.

As shown in FIG. 43, the fifth connecting finger 34 of the bottom cover 1 engages with the connecting portion 6*f* of the ink container 6, and, at both sides of the fifth connecting finger 34 of the bottom cover 1, there are provided vibration stoppers 37 for preventing vibration of the bottom cover 1 in a direction indicated by an arrow.

As explained in the foregoing, the present invention can provide a liquid container provided with a fluid connecting portion and an information memory medium, wherein an information memory medium unit for connecting the information memory medium electrically with the main body of the recording apparatus is so constructed as to be capable of changing the position and direction according to the position and direction of information exchange means in the main body of the recording apparatus thereby achieving both the fluid connection and the electrical connection of the information memory medium in satisfactory and reliable manner with generating unnecessary stress in the both connecting portions.

According to the present invention, particularly in a liquid container having two fluid connecting portions, the information memory medium connecting portion can change direction even when the direction of the liquid container is determined at the two fluid connecting portions, so that the fluid connection and the electrical connection of the information memory medium in contact or non-contact manner can be both achieved in satisfactory manner.

In the following there will be explained the configuration of the identifying key and the identifying key groove on the ink tank and the slot in the main body of the ink jet recording apparatus.

Figure 23:
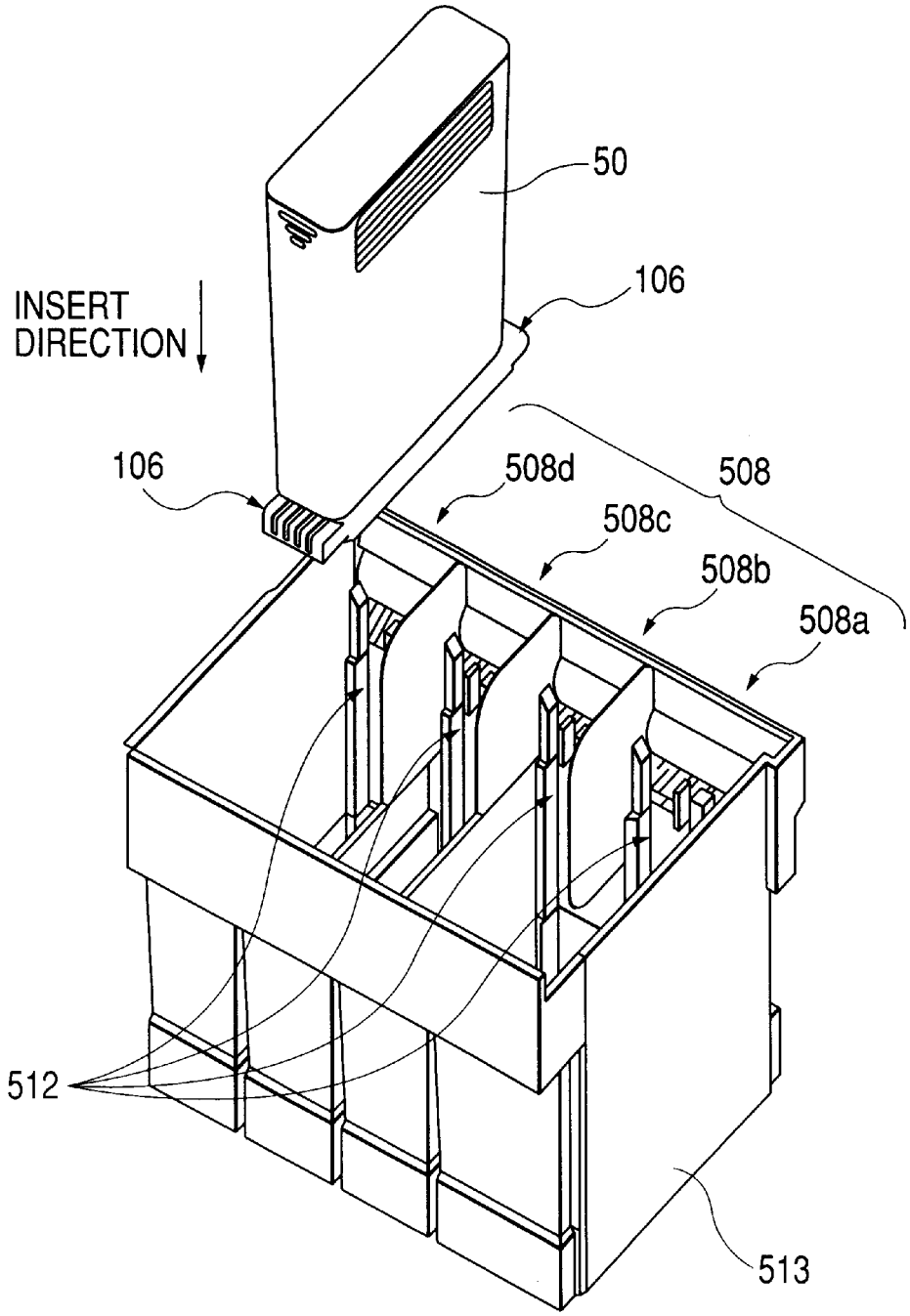
FIG. 23 is a perspective view of an ink tank and a station base, showing the configuration of an identifying portion.

A station base 513 is provided with plural slots 508. In the present embodiment, as shown in FIG. 23, there are formed four slots 508*a* to 508*d* constituting ink paths for black, cyan, magenta and yellow colors. The ink paths of respective colors are completely independent without being joined or mutually crossing, in order to avoid ink mixing. In case the ink is consumed in the ink tank 50 mounted on the station base 513, or in case of another incident for some reason, the ink tank 50 is detached from the station base 513 and is replaced by a new ink tank 50. The ink tank 50 to be newly mounted at such replacement has to contain the ink of a color and a type same as those of the ink tank 50 mounted in the past, for the following reason.

The ink tank 50 mounted at first on the station base 513 supplies the ink path leading to a recording head 524 with ink of a specified color and a specified type. Even after the ink in the ink tank 50 is exhausted and the ink tank 50 is detached, the ink still remains in the ink path, though in a small amount, for example by adhering to a part of the wall of the ink path. If a new ink tank 50 is mounted on the station base 513 and supplies ink of a different color, the remaining ink mixes with the newly supplied ink of another color to alter the ink color by mixing, thereby rendering the recording of a desired color impossible or to mix the color of the remaining ink into the newly supplied ink thereby forming marble-patterned smears, thus deteriorating the quality of color recording. Also if the newly mounted ink tank 50 supplies ink of a type different from that of the ink remaining in the ink path, the inks of two types may be mixed to induce a chemical reaction. In certain cases, the chemical reaction may generate precipitate in the ink path thereby clogging the ink path and rendering the recording impossible. Therefore, in the slot 508, there has to be mounted an ink tank 50 containing ink of a color and a type same as those in the previously mounted ink tank 50.

In the present embodiment, therefore, mechanical identification is provided in such a manner that a specified slot 508 can accommodate only an ink tank 50 containing ink of a specified color and a specified type and cannot accommodate any other ink tank 50. For this purpose, the ink tank 50 is provided with the aforementioned identifying portion 106 corresponding to the color and type of the ink contained in the ink tank 50, and, as shown in FIG. 23, the slot 508 is provided with a mounted side identifying portion 512 corresponding to the color and type of the ink to be supplied from such slot 508, in a position corresponding to the identifying portion 106 of the ink tank 50.

In the present embodiment, as shown in FIG. 23, the slot 508 is provided with the mounted side identifying portion 512 which includes an identifying projection (rib) 512*a* protruding inwards from the internal wall of the slot 508. Such identifying rib 512*a* can be inserted into an identifying recess 106*b* of the ink tank 50.

In the following there will be given a detailed explanation on the identifying portion 106 of the ink tank 50 and the mounted side identifying portion 512 provided on the internal wall of the slot 508 in the main body of the ink jet recording apparatus.

In the present embodiment, as explained in the foregoing, an identifying portion 106 is provided on each lateral face of the ink tank 50, and each identifying portion 106 has three identifying points composed of the identifying projections 106*a* or the identifying recesses 106*b*. On the internal wall of the slot 508, portions respectively corresponding to the identifying portions 106 constitute the mounted side identifying portions 512.

Figure 25:
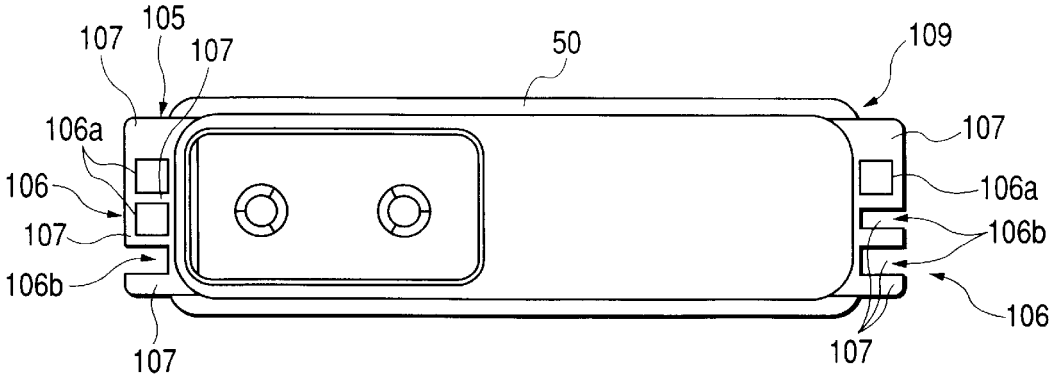
FIG. 25 is a bottom view of the ink tank shown in FIG. 23.
Figure 27:
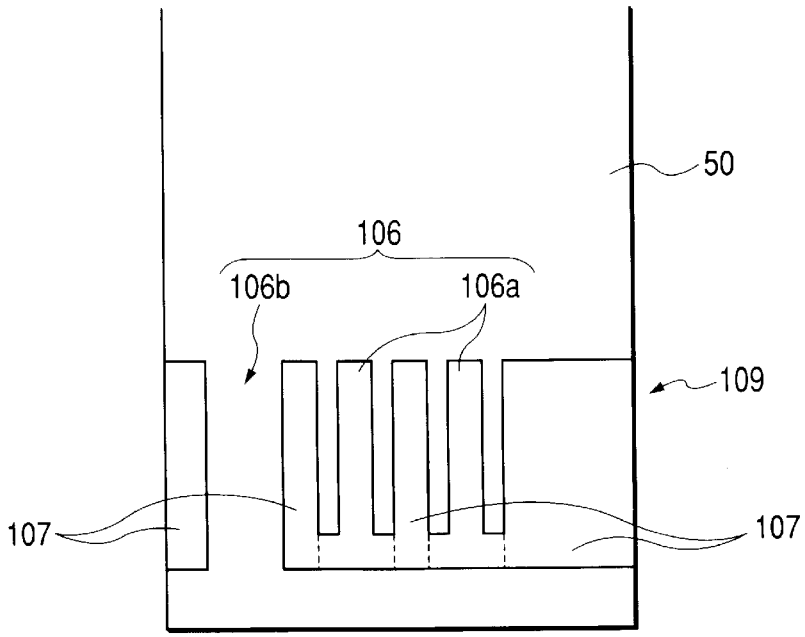
FIG. 27 is a partial magnified view of the identifying portion of the ink tank of a first embodiment in a completed state.

More specifically, as shown in FIGS. 25 and 27, the ink tank 50 is provided at the extending portion 109 with plural support pillars 107, and a portion where an inverted T-shaped member is present between the support pillars 107 constitutes an identifying projection 106*a* and a portion where such member is absent constitutes an identifying recess 106*b*. On the other hand, when the ink tank 50 is properly mounted in the slot 508, the portions corresponding to the identifying portions 106 constitute the mounted side identifying portions 512 of the slot 508, and portions respectively corresponding to the identifying points of the identifying portion 106 constitute the identifying points of the mounted side identifying portion 512. An identifying rib (projection) 512*a* provided on the internal wall of the slot 508 corresponds to the identifying recess 106*b* of the ink tank 50. In a position corresponding to the identifying projection 106*a* of the ink tank 50, there is not formed any structure on the internal wall of the slot 508, and such portion without any structure constitutes the identifying recess 512*b* in the present embodiment. In fact it is merely a part of a flat wall, but it is regarded as the identifying recess 512*b* relative to the protruding identifying rib 512*a*. In case of mounting an appropriate ink tank 50, the internal wall of the slot 508 is not provided with the identifying rib 512*a* in a portion opposed to the identifying projection 106*a* of the ink tank 50 but is provided with the identifying rib 512*a* in a portion opposed to the identifying recess 106*b* of the ink tank 50.

In the present embodiment the ink tanks 50 of a same configuration are used to contain various inks different in color and/or type. The type of ink indicates the chemical or physical properties of the ink such as viscosity or solubility in water. Each ink tank 50 indicates the color and type of the ink contained therein by the pattern of the six identifying points of the aforementioned identifying portions 106, and each slot 508 indicates the color and type of the ink to be supplied therefrom by the six identifying points of the corresponding mounted side identifying portions 512. Consequently, in case of inserting an appropriate ink tank into a slot 508, the identifying projections 106*a* and recesses 106*b* provided on the ink tank 50 match the identifying recesses 512*b* and ribs 512*a* provided on the slot 508, but, in case of inserting an inappropriate ink tank 50, at least a part of the identifying projections and recesses in the ink tank 50 and the slot 508 does not match to induce impingement of the identifying projection 106*a* and the identifying rib 512*a* whereby such ink tank 50 cannot be inserted. In this manner there cannot be mounted any ink tank other than the one containing the desired ink.

FIG. 23 is a perspective view showing the ink tank 50 and the slot 508, in which the ink tank 50 is to be inserted, in the station base 513 of the ink jet recording apparatus. The ink tank 50 in the present embodiment is substantially rectangular, and is provided on the two lateral faces with the identifying portions 106 each of which is provided with three identifying points. Such configuration is assumed in order to reduce the width of the ink tank 50, whereby four ink tanks 50 can be arranged in a small station base 513 without excessively increasing the area in the ink jet recording apparatus. The identifying portions 106 are positioned in the lower part of the ink tank 50 (in the vicinity of the ink supply aperture 3), so that there can be judged whether the insertion is possible, namely whether the ink tank 50 is appropriate, in an early stage of the inserting operation into the slot 508.

Figure 24:
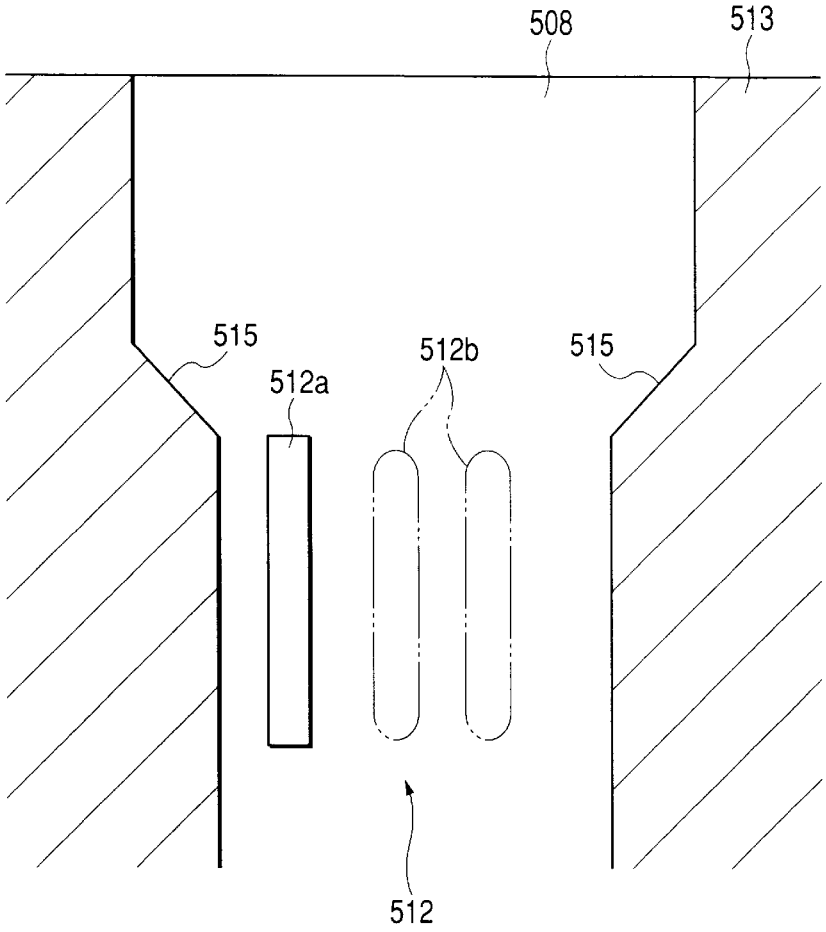
FIG. 24 is a magnified cross-sectional view of a slot in which the ink tank shown in FIG. 23 is to be mounted.

In the present embodiment, there are provided four slots 508 for accommodating four ink tanks 50 containing inks of respectively different colors (black, cyan, magenta and yellow) Also, as shown in FIG. 23, the mounted side identifying portions 512 are provided on two internal lateral faces of the slot 508, corresponding to the identifying portions 106 of the ink tank 50. As shown in FIG. 24, the mounted side identifying portion 512 of the slot 508 includes the identifying ribs 512*a* constituting a pattern for identifying the color. The identifying ribs 512*a* are different in the number and/or in the positions thereof for each slot 508, and correspond to the identifying recesses 106*b* of the ink tank 50 of the desired color. Between the entrance of the slot 508 and the mounted side identifying portion 512, there is formed a tapered portion 515 for guiding the ink tank 50 in such a manner that the ink tank 50 can be smoothly and vertically inserted into the slot 508.

In the following there will be explained the number of identifying patterns achievable in the configuration of the present embodiment. In the ink tank 50 of the present embodiment, each identifying point can assume either of two states corresponding to the presence or absence of the inverted T-shaped member (cf. FIG. 26), namely whether there is an identifying projection 106*a* or an identifying recess 106*b*. Therefore, for the identifying points of a number a, there can be theoretically obtained $2^a$ identifying patterns. However, for example if all the identifying points are composed of identifying recesses 106*b* (namely no identifying projection 106*a* is present), such ink tank can be inserted into any slot 508 regardless of the presence or absence of the identifying ribs 512, so that such identifying points are practically useless for identification. Consequently, among the identifying points of a certain number, the identifying projections 106*a* and the identifying recesses 106*b* respectively occupy about a half. Under such condition, there can be obtain ${}_aC_{a/2}$ combinations if the number a of the identifying points is even, or ${}_aC_{(a+1)/2}$ or ${}_aC_{(a-1)/2}$ combinations if the number a is odd. In the aforementioned embodiment having 3×2=6 identifying points, there can be obtained $2^6$=64 identifying patterns in theory, but practically available are about ${}_6C_3$=20 identifying patterns. Therefore, with the ink tanks 50 of a same configuration, there can be identified 20 inks different in color and/or in type.

Also as shown in FIG. 25, the ink tank 50 of the present embodiment cannot be inserted into the slot 508 when the left and right sides of the ink tank are inverted, namely when the ink tank 50 is rotated by 180° about the central axis thereof along the inserting direction thereof. This is because the ink tank 50 is not point symmetrical with respect to the center point in FIG. 25 (not point-symmetrical in the vertical direction therein), but each identifying point of the identifying portions 106 are so formed, upon rotation by 180° about the central axis in the inserting direction, as to be displaced by a half pitch in comparison with those prior to the rotation. More specifically, the support pillars 107 on both ends have different widths in the different identifying portions 106, so that, in the ink tank 50 rotated by 180°, the identifying points of the ink tank 50 are displaced by a half pitch from those on the internal wall of the slot 508, whereby at least a part of the identifying ribs 512*a* impinge on the support pillars 107 between the identifying points regardless of the presence or absence of the identifying recesses 106*b* and the ink tank 50 can no longer be inserted into the slot 508. It is therefore possible to prevent mounting of the ink tank 50 in a state where the left and right sides thereof are erroneously inverted. Also the identifying pattern, changed by the erroneous inversion of the left and right sides, may coincidentally match the identifying pattern of an inappropriate ink tank 50, but, in the present embodiment, the ink tank 50 cannot be inserted whenever the left and right sides are erroneously inverted, so that the erroneous insertion resulting from such misjudgment can be avoided.

In the present embodiment, as explained in the foregoing, six identifying points are provided in the identifying portions 106 of the ink tank 50, each of the identifying ribs 512*a* on the internal wall of the slot 508, the identifying recesses 106b and the identifying projections 106*a* of the ink tank 50 is provided in three units, but the number of the identifying points may be increased or decreased according to the number of the ink tanks 50 to be identified and the number of the identifying ribs 512*a*, the identifying recesses 106*b* and the identifying projections 106*a* may also be increased or decreased.

Figure 26:
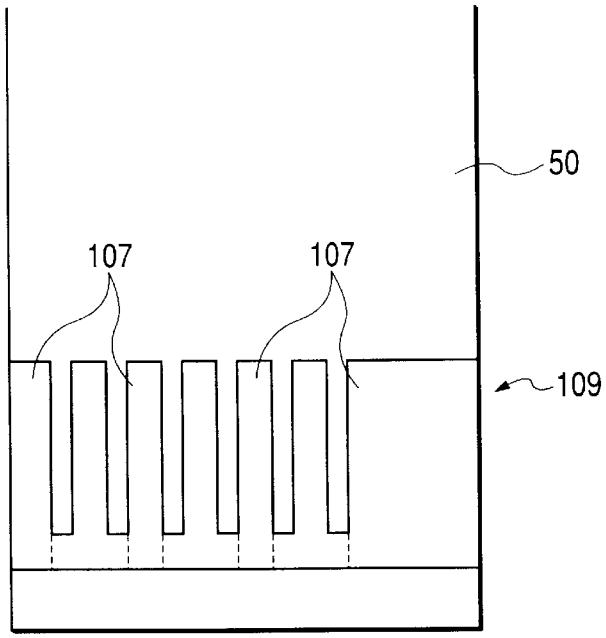
FIG. 26 is a partial magnified view of the identifying portion of the ink tank in the course of a forming process therefor.

In the following there will be explained the method for forming the identifying portion 106 of the ink tank 50 of the present embodiment. As shown in FIG. 26, the identifying portion 106 of the present embodiment is obtained by forming an extending portion 109 on each lateral face of the ink tank 50, forming four support pillars 107 of a constant pitch in each extending portion 109, and forming an inverted T-shaped projection in the gap between the adjacent support pillars 107 in such a manner that the inverted T-shaped projection connects the adjacent support pillars 107. In such structure, a portion where the projection is cut off constitutes an identifying recess 106*b*, and a portion where the projection remains without being cut off constitutes an identifying projection 106*a*. This methods provides an advantage of reducing the manufacturing cost, since only one mold is required for example for injection molding of the tank, in order to obtain the ink tanks 50 for containing inks of various colors and types.

As explained in the foregoing, the identifying portions 106 of the ink tank 50 includes the identifying points consisting of the identifying recesses 106*b* formed by cutting off the inverted T-shaped projection and the identifying projections 106*a* where the inverted T-shaped projection remains without being cut off. The inverted T-shaped projection, having a thin and narrow (short in the longitudinal direction of the projection) connection with the support pillar 107, can be easily cut off to form the identifying recess 106*b*. Particularly in comparison with the configuration of the Japanese Patent Application Laid-open No. 9-174879 utilizing the projection and recess of rail shape formed over the entire length of the ink tank, the configuration of the present embodiment can simplify the manufacturing and working processes as the inverted T-shaped projection is shorter and can be easily cut off. Also the identifying portions 512 of the slot 508 in the present embodiment can be extremely easily manufactured or prepared since there is only required to form the identifying ribs 512*a* of a length smaller than in the prior art.

On the other hand, in the present embodiment, the identifying projections 106*a*, identifying recesses 106*b* and identifying ribs 512 are given a certain longitudinal length, in order to avoid the drawbacks to be explained in the following. In the following description, there is assumed a case of trying to insert an inappropriate ink tank 50 in a situation where the identifying projections 106*a* of the ink tank 50 and the identifying ribs 512*a* of the slot 508 are a mutually corresponding positions.

Figure 28:
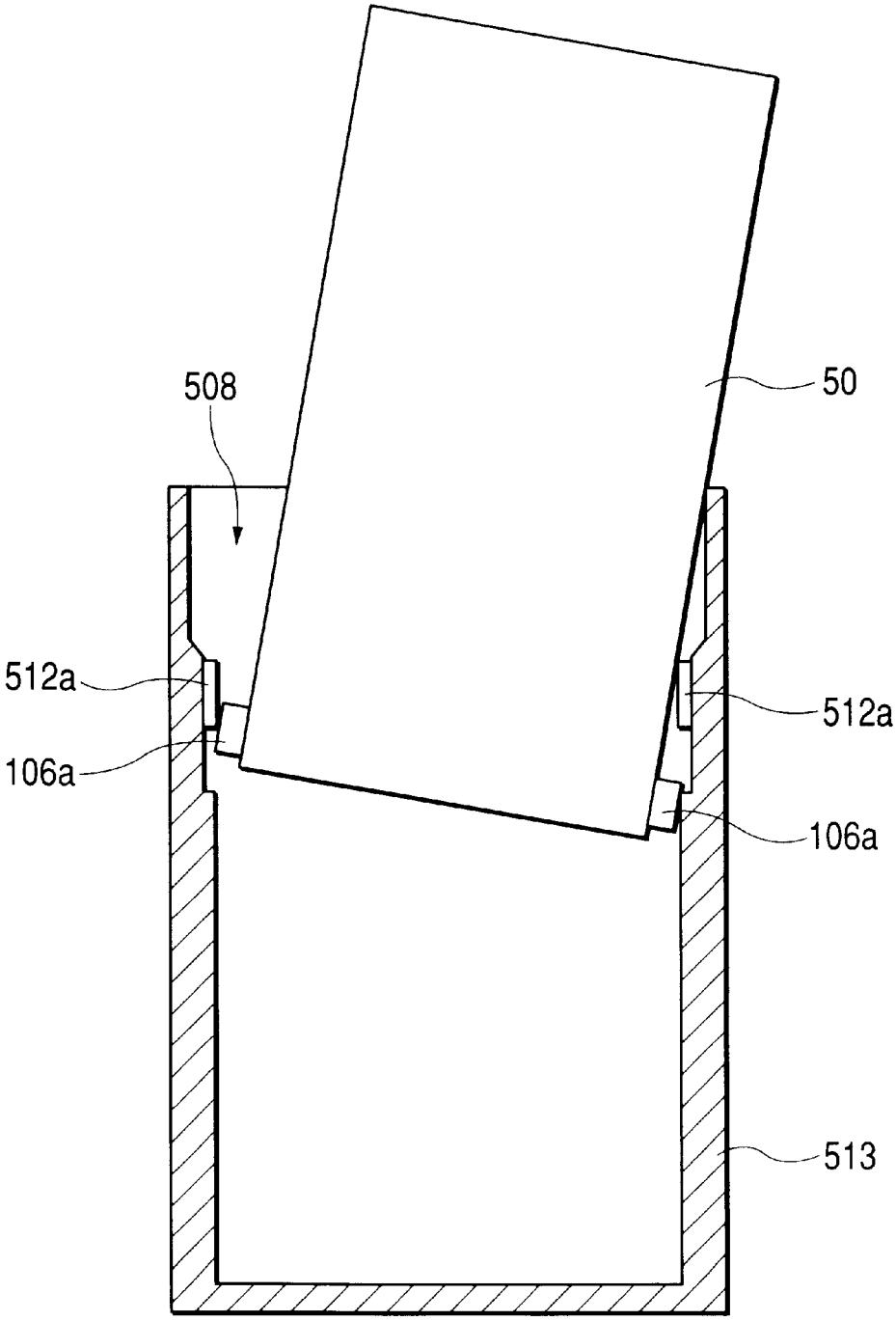
FIG. 28 is a schematic view showing an inclined insertion state of the ink tank of the first embodiment.
Figure 29:
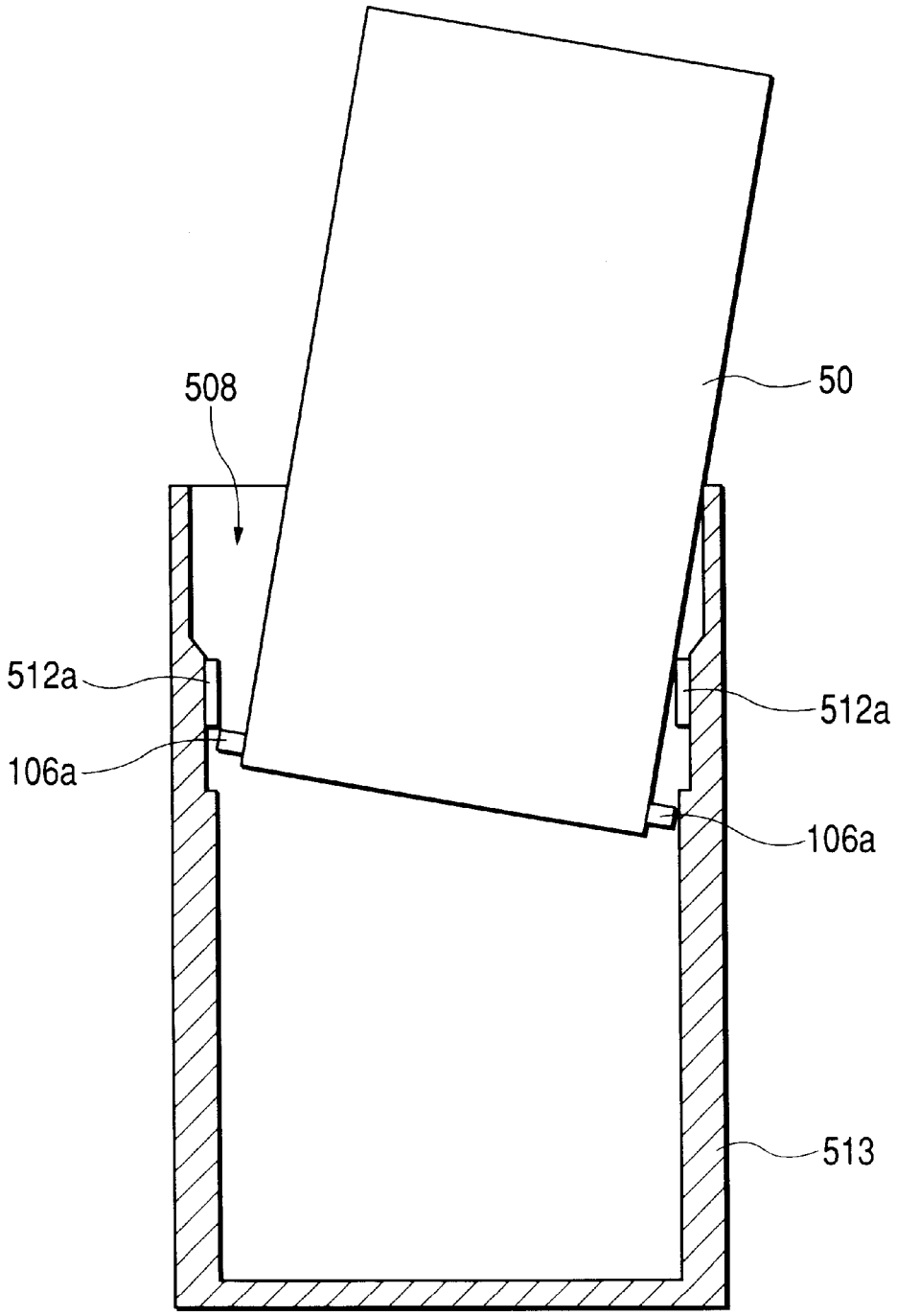
FIG. 29 is a schematic view showing an inclined insertion state of the ink tank of a reference example.
Figure 30:
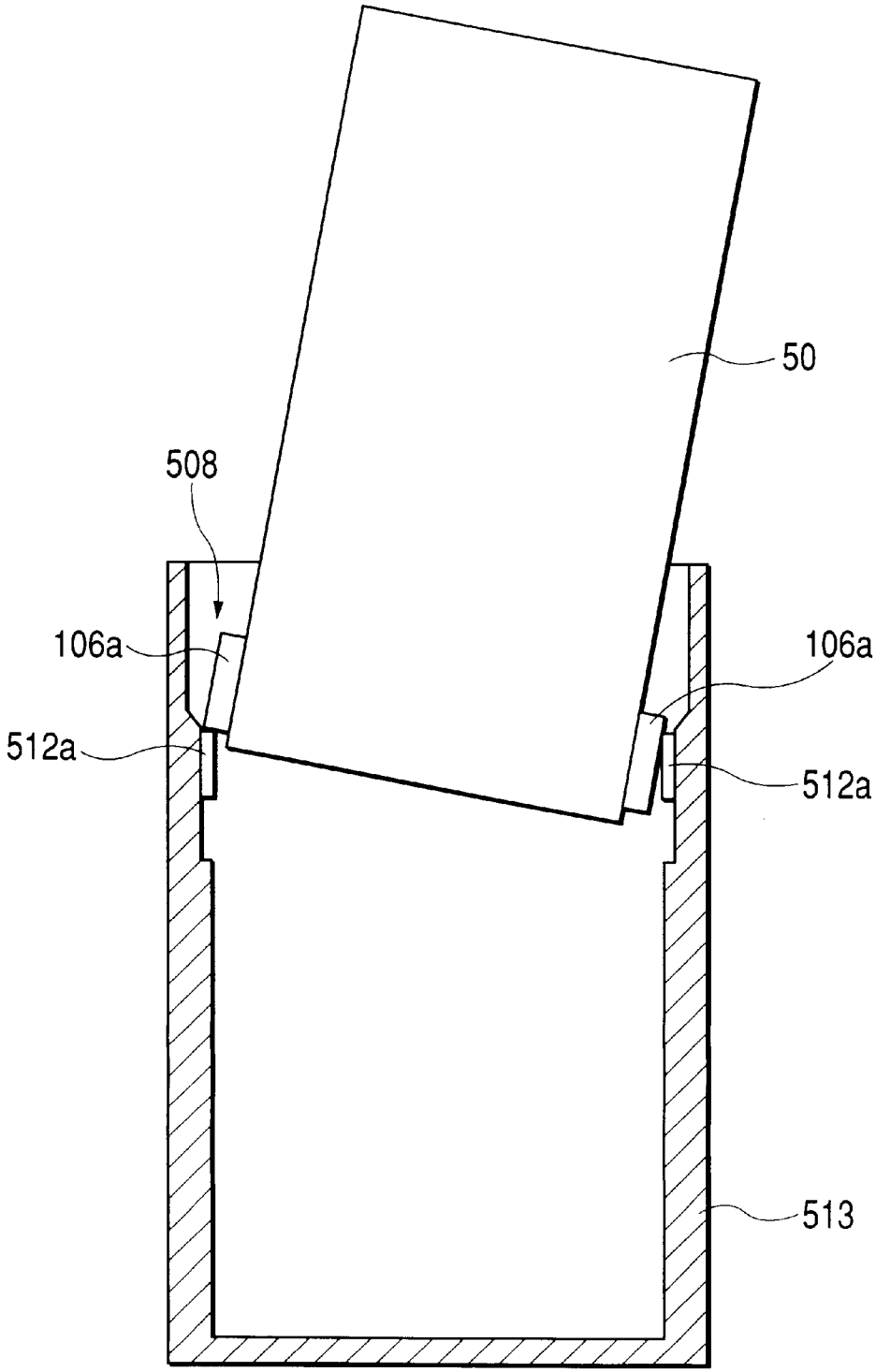
FIG. 30 is a schematic view showing an inclined insertion state of the ink tank of another embodiment of the present invention.

In case of trying to insert an inappropriate ink tank 50 into the slot 508 in the main body of the recording apparatus, if the user inserts the ink tank 50 in an inclined state with respect to the slot 508 as shown in FIG. 28, the extending portion 109 at a side (right side in FIG. 28) of the ink tank 50 can enter the slot 508 without causing the contact between the identifying projections 106*a* and the identifying ribs 512*a*. If the ink tank 50 is moved in this state from the inclined position to an almost vertical position, the identifying projections 106*a* at the other side execute a swinging motion. If the identifying projections 106*a* are short as shown in FIG. 29, the extending portion at the other side may also be able to enter the slot 508 without causing mutual impingement. This means that any ink tank 50 can be inserted into the slot 508 without the identifying function. Consequently, the identifying projections 106*a* preferably have such a sufficient length that the identifying projections 106*a* in at least a side always pass through a trajectory coming into contact with the identifying ribs 512*a* even in case of inclined insertion as shown in FIG. 28. Furthermore, more preferably, the identifying projections 106*a* have such a sufficient length that the identifying projections 106*a* in any side always pass through a trajectory coming into contact with the identifying ribs 512*a*, namely that the identifying operation cannot be evaded on both sides even in case of trying to insert the ink tank 50 in an inclined position with respect to the slot 508 as shown in FIG. 30. The support pillars 107 and the identifying recesses 106*a* are formed in a length corresponding to that of the identifying ribs 512*a* and the identifying projections 106*a*.

In the following there will be explained, with reference to FIGS. 31 to 36, an operation of mounting the ink tank 50 of the aforementioned configuration into the slot 508 in the main body of the recording apparatus. In these drawings, the identifying ribs 512*a* are fully illustrated for the purpose of clarity, though they should in fact be partly hidden by the ink tank 50.

Figure 31:
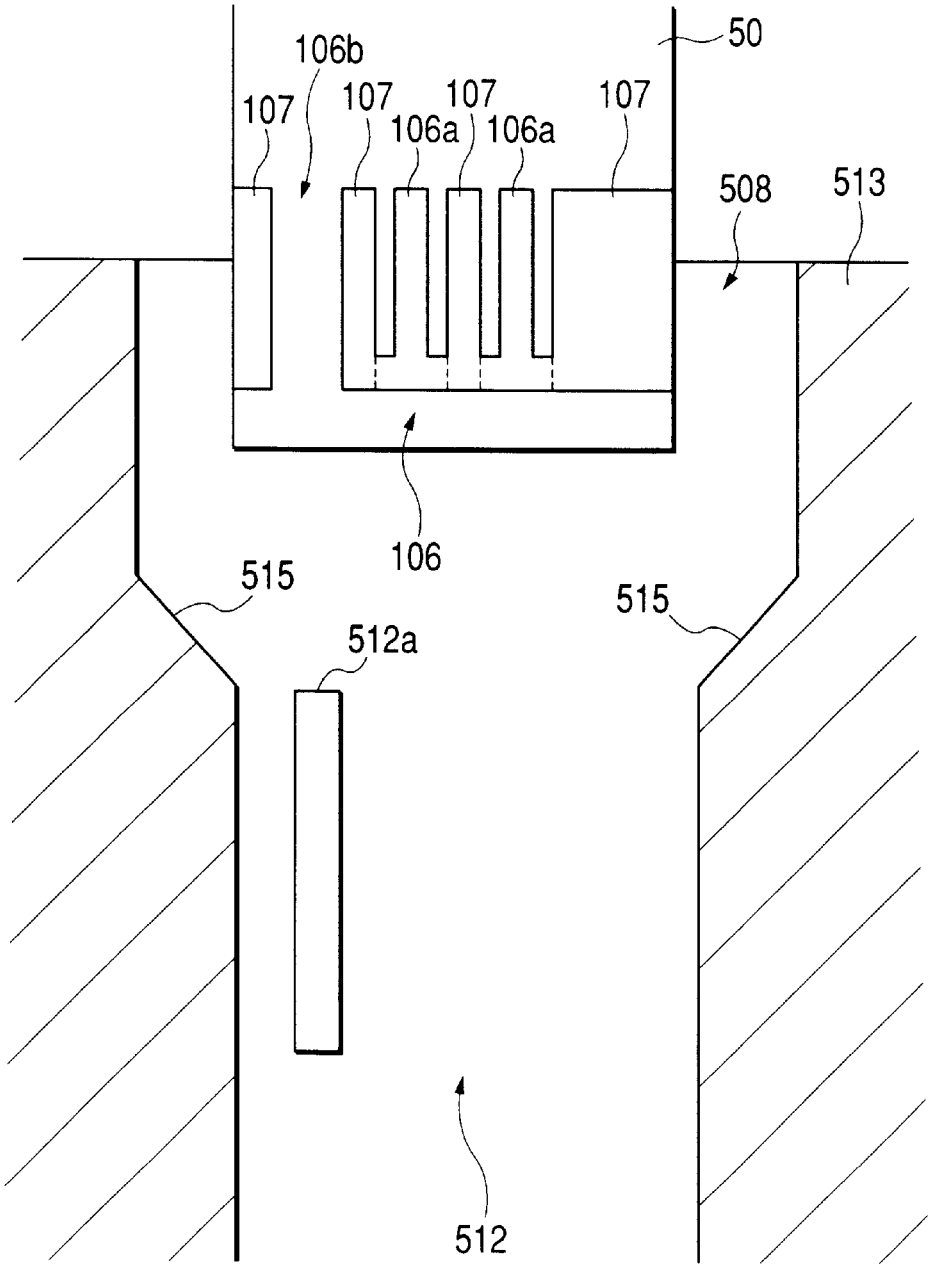
FIG. 31 is a partial magnified view showing a first stage of the insertion of the ink tank shown in FIG. 23.

FIG. 31 shows the ink tank 50 in a state prior to mounting into the station base 513 in the main body of the recording apparatus. The internal width of the entrance of the slot 508 above the mounted side identifying portion 512 is made larger than the width of the face including the identifying portion 106 of the ink tank 50, and the tapered portion 515 is formed between the entrance of the slot 508 and the upper end of the mounted side identifying portion 512, in order to facilitate the insertion of the ink tank 50. The entrance of the slot 508 is formed considerably wide in order to improve the operability of the user. Consequently, even if the user inserts the ink tank 50 in a loose manner as if throwing it into the slot 508, the ink tank 50 can be accommodated in the entrance of the slot 508, and the tapered portion 515 then rectifies the posture of the ink tank 50 in such a manner that it can smoothly guided to a position where the ink tank 50 is vertically inserted into the slot 508.

Figure 32:
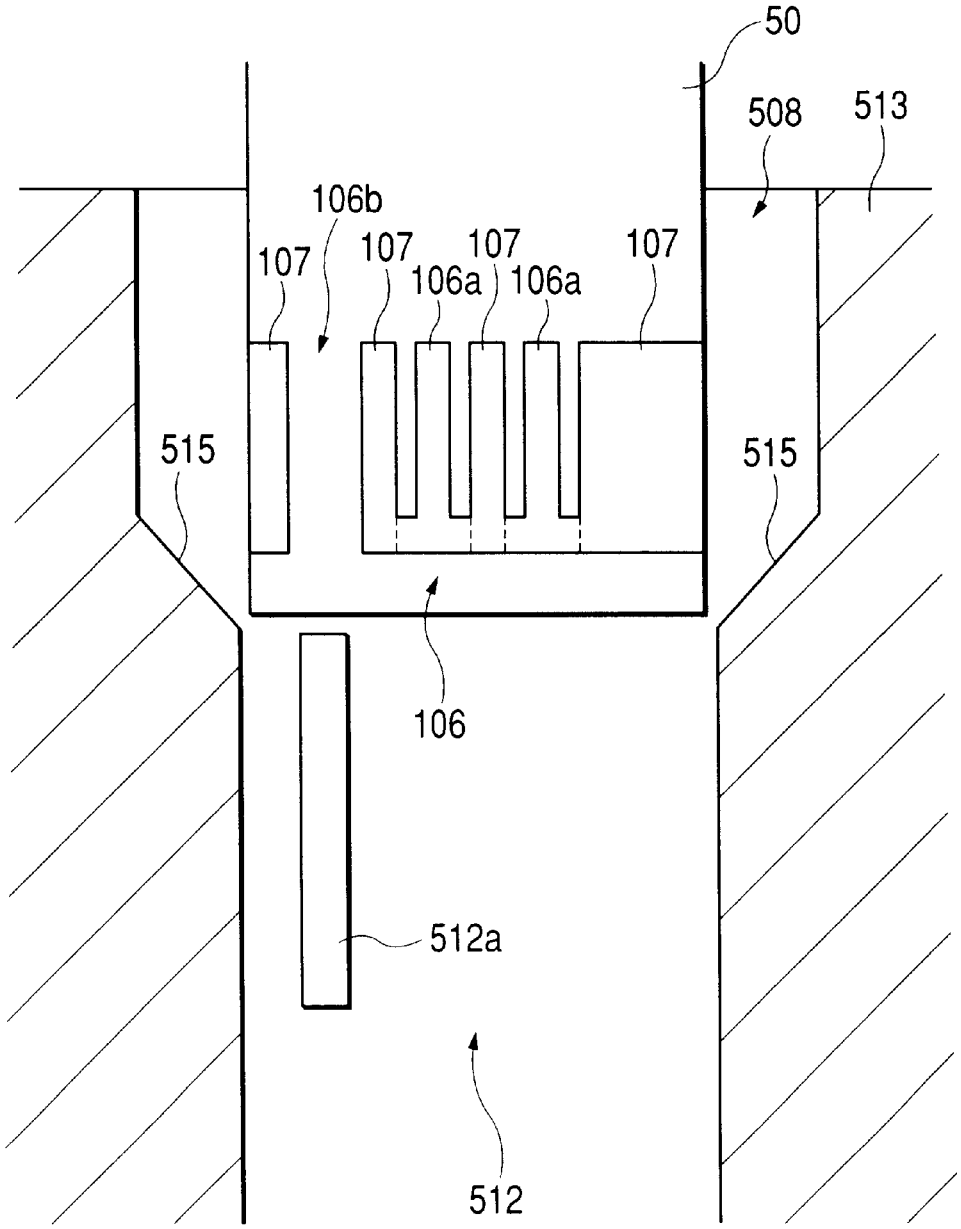
FIG. 32 is a partial magnified view showing a second stage of the insertion of the ink tank shown in FIG. 23.

FIG. 32 shows a stage where the inserting end of the ink tank 50 slightly enters the slot 508 and the identifying portions 106 of the ink tank 50 are immediately before the engagement with the mounted side identifying portions 512 of the slot 508. In the mounted side identifying portion 512 of the slot 508, the identifying ribs 512*a* protrudes, at predetermined identifying points, perpendicularly from the internal wall of the slot 508. As explained in the foregoing, the identifying ribs 512*a* are different in the number and position thereof in each slot 508, and are provided in positions corresponding to the identifying recesses 106*b* of the appropriate ink tank. Stated differently, the ink tank 50 to be mounted in such slot is provided with the identifying recesses 106*b*, formed by cutting off the T-shaped projections of the identifying portion 106, corresponding to the identifying ribs 512*a* of the slot 508.

Figure 33:
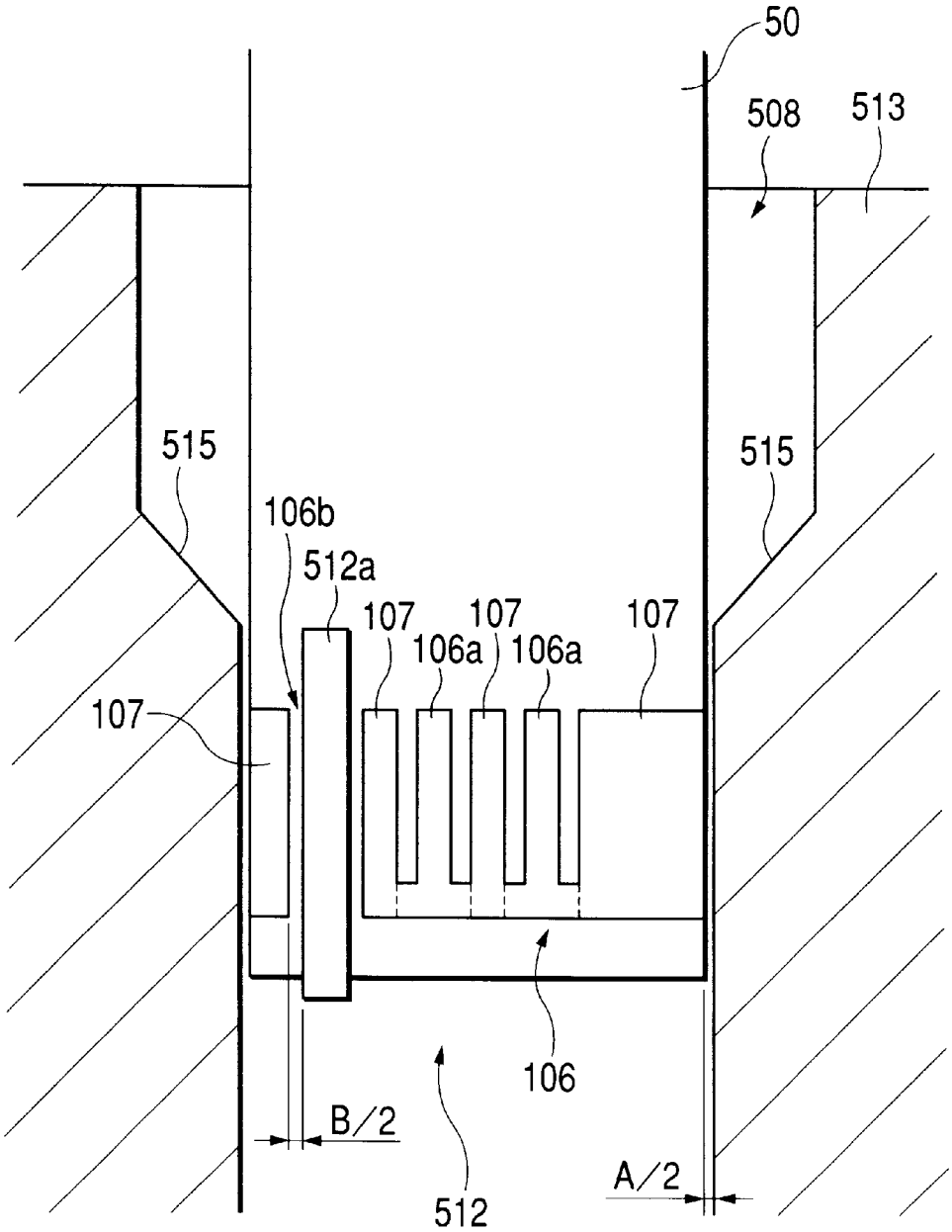
FIG. 33 is a partial magnified view showing a third stage of the insertion of the ink tank shown in FIG. 23.
Figure 34:
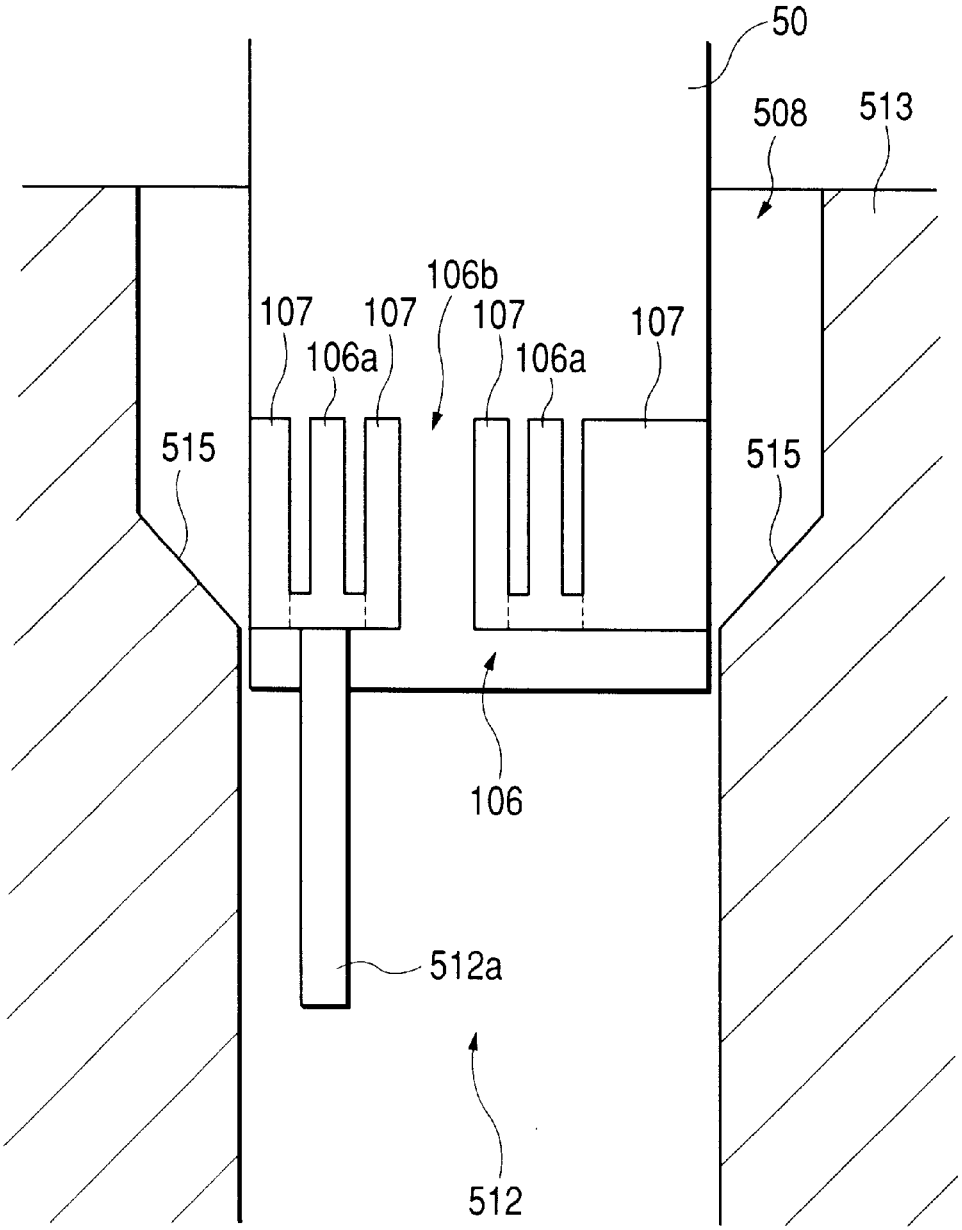
FIG. 34 is a partial magnified view showing an erroneous insertion identifying state for the ink tank shown in FIG. 23.

In case of inserting an appropriate ink tank 50 into the slot 508, the identifying ribs 512*a* are inserted into the identifying recesses 106*b* of the ink tank 50 as shown in FIG. 33, but the identifying projections 106*a* of the ink tank 50 do not impinge on the identifying ribs 512*a* etc., so that the identifying portions 106 of the ink tank 50 can pass through the mounted side identifying portions 512 and the ink tank 50 can be completely inserted into the slot 508. On the other hand, in case of trying to insert an inappropriate ink tank 50 into the slot 508, at least an identifying rib 512*a* impinges on an identifying projection 106*a* of the ink tank 50 as shown in FIG. 34, whereby the ink tank 50 cannot be inserted further. In this manner there is realized a configuration capable of identifying the ink tanks 50 and allowing the mounting of an appropriate ink tank 50 only in the slot 508.

The lower faces (front ends in the inserting direction) of the identifying projections 106*a* of the ink tank 50 are in a same plane in which the lower faces (front ends in the inserting direction) of the support pillars 107, and such plane is substantially perpendicular to the inserting direction of the ink tank 50. Since the lower faces of the identifying projections 106*a* are positioned in the vicinity of the inserting end of the ink tank 50, the erroneous insertion can be detected in a very early stage of the inserting operation of the ink tank 50, and the user can know in such early stage that the ink tank 50 is to be replaced, whereby the convenience of the user can be improved. However, if the lower faces of the identifying projections 106*a* and the support pillars 107 are in a same plane as that of the inserting end of the ink tank 50, such inserting end may come into local impingement with a part of the upper ends of the identifying ribs 512*a* thereby resulting in slippage and positional displacement, whereby the inserting operation may become more difficult. Therefore, the lower ends of the identifying projections

106*a* and of the support pillars 107 are positioned slightly inside (higher in the drawing) of the inserting end of the ink tank 50.

Figure 35:
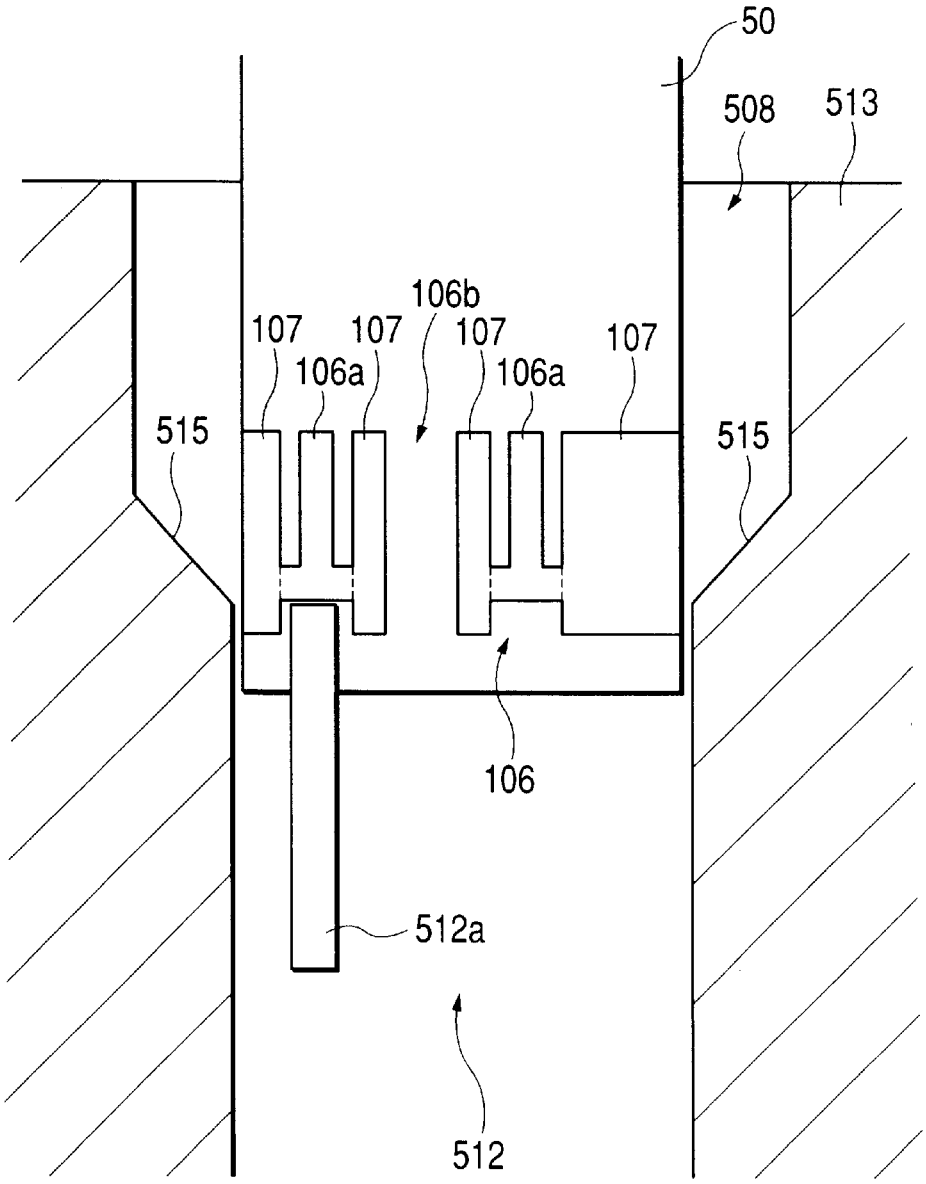
FIG. 35 is a partial magnified view showing an erroneous insertion identifying state for the ink tank of a reference example.

On the other hand, if the lower ends of the identifying projections 106*a* are in a position retracted from the lower ends of the support pillars 107 as shown in FIG. 35, even in a case of trying to insert an inappropriate ink tank 50, the identifying ribs 512*a* fit in the gaps between the support pillars 107 (namely a small space under the identifying projections 106*a*) to give a fitting feeling whereby the user may misjudge that such inappropriate ink tank 50 can be inserted. In such case, the user judges that the ink tank 50 is smoothly insertable in a very early stage of the inserting operation, and, when the insertion of the ink tank 50 is hindered thereafter by impingement, the user may try to press in the ink tank 50 forcedly thereby resulting in a breakage of the components. In order not to provide the user with such fitting feeling, the lower faces of the identifying projections 106*a* and those of the support pillars 107 are preferably formed on a same plane.

FIG. 33 shows a stage where the identifying ribs 512*a*, formed on the internal wall of the slot 508 in the main body of the recording apparatus, are in the course of passing through the identifying recesses 106*b* of the ink tank 50. The identifying recesses 106*b* of the ink tank 50 and the identifying ribs 512*a* of the slot 508 mutually engage without play since the clearance therebetween or the difference B (=(B/2)×2) in the widths thereof is selected small. However, the clearance between the width of the face of the ink tank 50 including the identifying portion 106 and the internal width of the face of the slot 508 including the mounted side identifying portion 512, namely the difference A (=(A/2)×2) in the widths thereof is preferably smaller than B, because of the following reason. When the ink tank 50 is inserted from the entrance of the slot 508 and is guided by the tapered portions 515 to the mounted side identifying portions 512, it is necessary that the entire external shape of the ink tank 50 is precisely positioned with respect to the internal shape of the slot 508, in order that the ink supply needle 528 and the air introducing needle 529 can exactly penetrate the ink supply aperture (first fluid connection aperture) 11 and the air introducing aperture (second fluid connection aperture) 12, and, in comparison, the relative positional accuracy required between the identifying recesses 106*b* and the identifying ribs 512*a* is less rigorous and should rather have a certain margin in order to achieve smooth inserting operation of the ink supply needle 528 and the air introducing needle 529 into the ink supply aperture (first fluid connection aperture) 11 and the air introducing aperture (second fluid connection aperture) 12. Also in a configuration where the clearance is larger between the external shape of the ink tank 50 and the internal width of the entrance of the slot 508 and the clearance A is smaller between the external shape of the ink tank 50 and the internal shape of the portion of the slot 508 where the mounted side identifying portion 512 is provided, the ink tank 50, even if roughly inserted almost by a throw-in operation of the user, is guided by the tapered portions 515 and is extremely precisely positioned upon proceeding to the deeper portion of the slot 508, whereby secure mounting is rendered possible without complicating the operation of the user.

More specifically, in the present embodiment, the clearance (difference in width) A between the width of the face bearing the identifying portion 106 and the internal width of the portion of the slot 508 bearing the mounted side identifying portion 512 is selected as 0.3 mm, while the clearance (difference in width) B between the identifying recess 106*b* of the ink tank 50 and the identifying rib 512*a* of the slot 508 is selected as 0.7 mm. Also the identifying points (support pillars 197, identifying projections 106*a* and identifying recesses 106*b*) of the identifying portions 106 have a longitudinal length of 7 mm, and the identifying ribs 512*a* of the mounted side identifying portions 512 has a longitudinal length of 13 mm. FIG. 33 shows a state where the center line of the identifying recesses 106*b* coincides with that of the identifying ribs 512*a*, and the center line of the ink tank 60 coincides with that of the slot 508.

Figure 36:
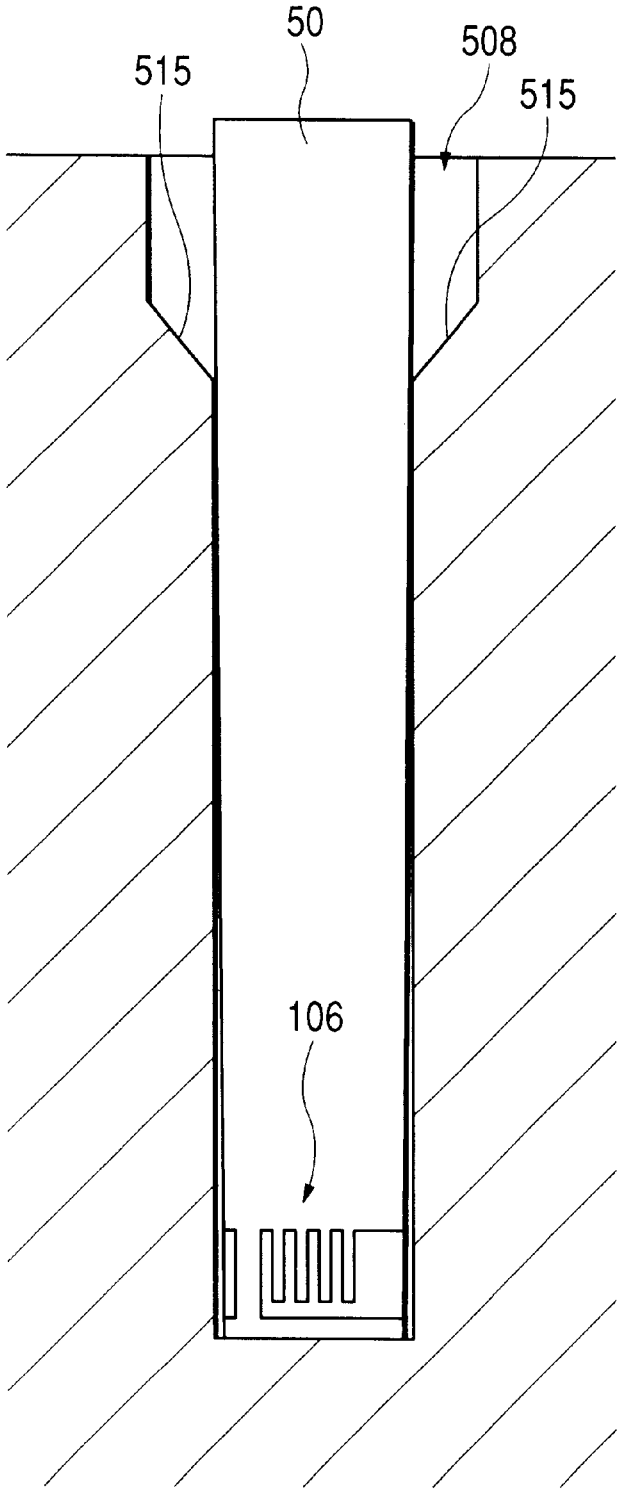
FIG. 36 is a schematic view showing an insertion completed state of the ink tank shown in FIG. 23.

When the identifying ribs 512*a* on the internal wall of the slot 508 in the main body of the recording apparatus pass through the identifying recesses 106*b* of the ink tank 50, namely when the identifying portions 106 of the ink tank 50 pass through the mounted side identifying portions 512 of the slot 508, the ink tank 50 thus guided is further inserted and is completed mounted in the slot 508 as shown in FIG. 36. Thus the ink supply needle 528 protruding in the slot 508 penetrates the ink supply aperture (first fluid connection aperture) 11 of the ink tank 50 whereby the ink supply is started to the recording head 524 through the tube (ink supply pipe) 526. Also the air introducing needle 529 penetrates the air introducing aperture (second fluid connection aperture) 12, thereby enabling air intake into the ink tank 50 from the air introducing needle 529 for example for resolving the negative pressure generated after ink discharge.

The ink tank 50 of the present embodiment can be mass produced and stored in a state prior to cutting-off of the inverted T-shaped projections in the identifying portions (cf. FIG. 26). Thus the ink tank 50 can be used for containing the ink of any color or type, and the inverted T-shaped projections may be suitably cut off, according to the ink to be contained, to form the identifying projections 106a and the identifying recesses 106*b* (cf. FIG. 27). In such method, it is not necessary to design, manufacture and store the different ink tanks corresponding to the different inks, so that the manufacturing cost can be significantly reduced.

In the present embodiment, the identifying portions 106 of the ink tank 50 are provided with inverted T-shaped identifying projections 106*a*. Consequently, in case of trying to insert an inappropriate ink tank 50, the identifying projections 106*a* tend to firmly impinge on the identifying ribs 512*a*, so that the impossibility of insertion can be securely transmitted to the user. Also the identifying projections 106*a* are not easily breakable even under a relatively strong inserting force.

Figure 37:
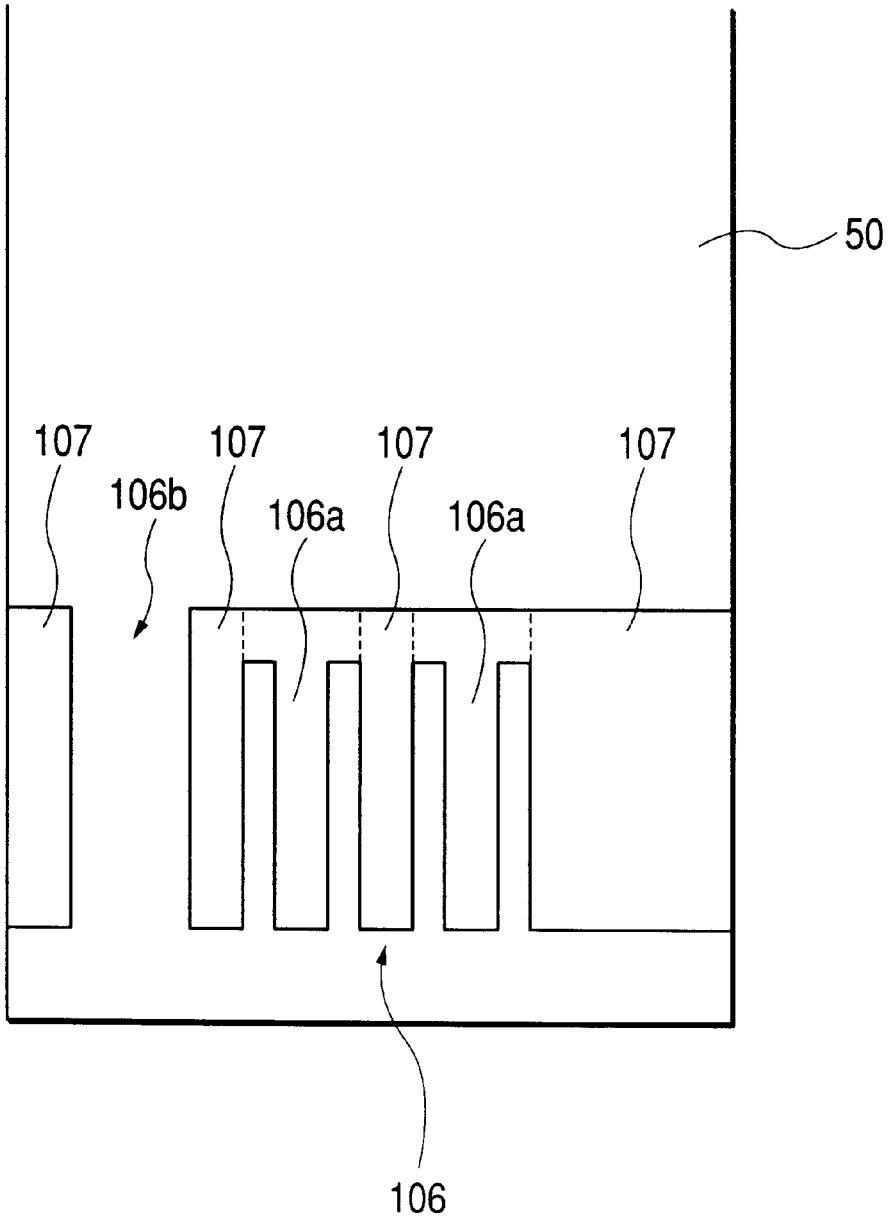
FIG. 37 is a partial magnified view of the identifying portion of the ink tank of another embodiment.

On the other hand, it is also possible to provide the identifying portions 106 of the ink tank 50 with the inverted T-shaped projections 106*a*, as shown in FIG. 37. In case of trying to insert an inappropriate ink tank 50, if the ink tank 50 is inclined with respect to the slot 508 as shown in FIG. 28, the impingement may not occur between the lower faces of the identifying projections 106*a* and the identifying ribs 512*a*, but the upper portions of the identifying projections 106*a* come into firm impingement on the identifying ribs 512*a* even in such case. In case the upper portions of the identifying projections 106*a* are reinforced as in the configuration shown in FIG. 37, and if an inappropriate ink tank 50 is inserted in a state inclined with respect to the slot 508 as explained in the foregoing, the impossibility of insertion can be securely transmitted to the user and the identifying projections 106*a* are not easily breakable even under a relatively strong inserting force.

Furthermore, the present invention may be adopted in a laterally mounting configuration in which the ink tank is mounted on or detached from the slot in a direction perpendicular to the direction of gravity, though such configuration is not illustrated.

Ink Jet Recording Apparatus

In the following there will be explained, with reference to FIG. 38, an example of the ink jet recording apparatus capable of mounting the aforementioned ink tank.

Figure 38:
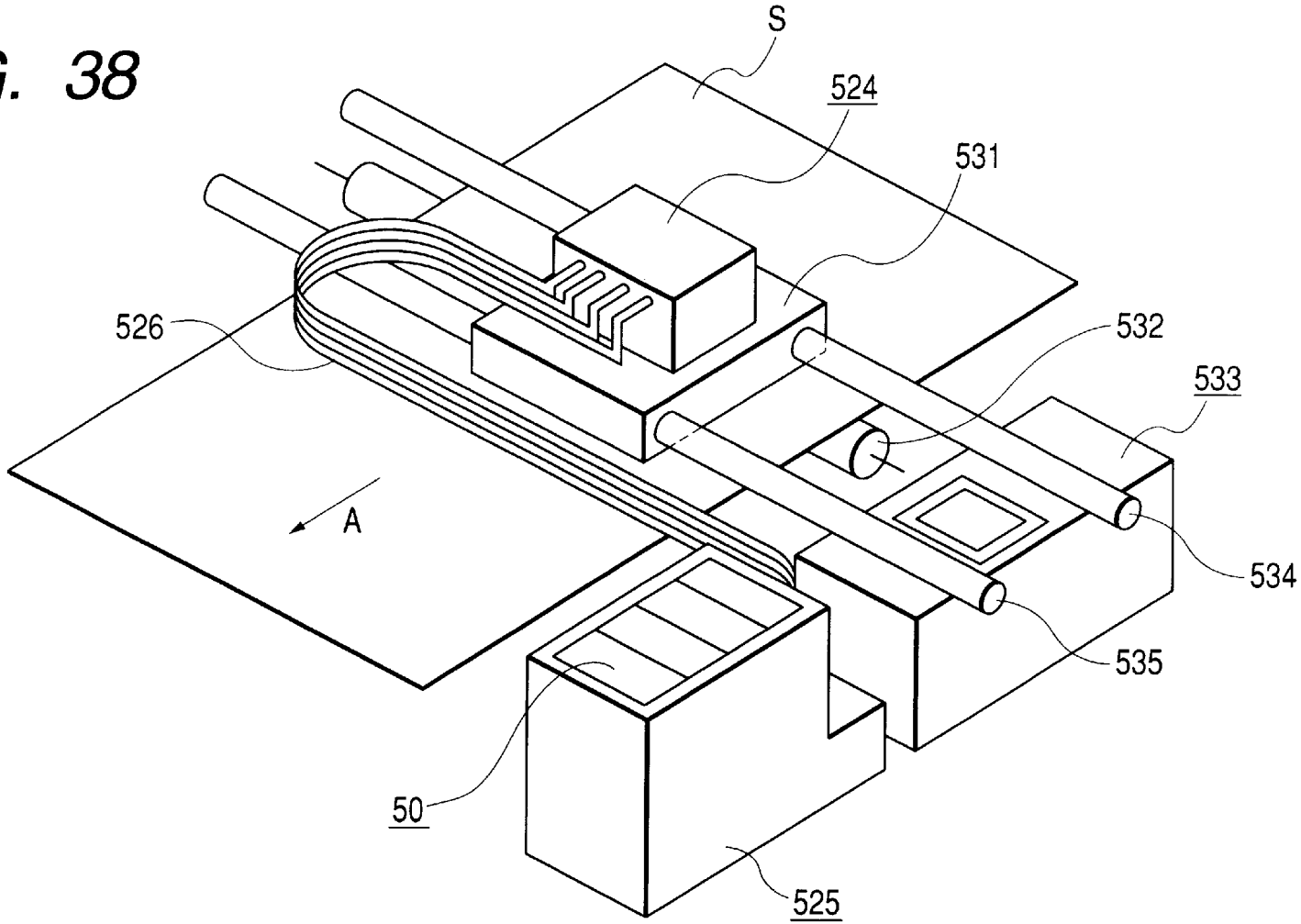
FIG. 38 is a perspective view of an ink jet recording apparatus.

The ink jet recording apparatus shown in FIG. 38 is a recording apparatus of serial type, capable of repeating the reciprocating motion (main scanning) of an ink jet head 524 and the conveying (sub scanning) of a recording sheet (recording medium) S such as an ordinary recording paper, a special paper, an OHP film sheet etc. by a predetermined pitch and causing the ink jet head 524 to selectively discharge ink in synchronization with these motions for deposition onto the recording sheet S, thereby forming a character, a symbol or an image.

Referring to FIG. 38, the ink jet head 524 is detachably mounted on a carriage 531 which is slidably supported by two guide rails 534, 535 and is reciprocated along the guide rails 534, 535 by drive means such as an unrepresented motor. The recording sheet S is conveyed by a conveying roller 532 in a direction crossing the moving direction of the carriage 531 (for example perpendicular direction), so as to be opposed to an ink discharge face of the ink jet head 524 and to maintain a constant distance thereto.

The ink jet head 524 is provided with plural nozzle arrays for discharging inks of respectively different colors. Corresponding to the colors of the inks discharge from the ink jet head 524, plural independent ink tanks 50 are detachably mounted on an ink supply unit 525. The ink supply unit 525 and the ink jet head 524 are connected by plural ink supply tubes 526 respectively corresponding to the ink colors, and, by mounting the ink tanks 50 on the ink supply unit 525, the inks of respective colors contained in the ink tanks 50 can be independently supplied to the nozzle arrays in the ink jet head 524.

In a non-recording area which is within the reciprocating range of the ink jet head 524 but outside the passing range of the recording sheet S, there is provided a recovery unit 533 so as to be opposed to the ink discharge face of the ink jet head 524. The recovery unit 533 is provided with a cap portion for capping the ink discharge face of the ink jet head 524, a suction mechanism for forced ink suction from the ink jet head 524 in the capped state of the ink discharge face, a cleaning blade for wiping off the smear on the ink discharge face etc. The aforementioned suction operation is executed by the recovery unit 533 prior to the recording operation of the ink jet recording apparatus.

When the ink jet recording apparatus is operated after a long pause, the recovery unit 533 sucks ink of higher concentration present in the bottom portion of the ink tank 50, and the ink of which concentration is stabilized by agitation is used for actual recording. Consequently, in case the ink jet recording apparatus has not been used for a long period whereby the pigment component in the ink and the fine resinous particles for improving the fixation on the recording sheet S are precipitated in the bottom portion of the ink tank 50, there can still be obtained an image of high quality in which the concentration of such pigment component and fine resinous particles is thus stabilized.

In the foregoing there has been explained an ink jet recording apparatus of serial type, but the present invention is likewise applicable to an ink jet recording apparatus employing a line-type ink jet head in which the nozzle arrays are formed over the entire width of the recording medium.

What is claimed is:

1. A liquid container detachably attachable to a recording apparatus for executing recording by depositing recording liquid onto a recording medium, the liquid container comprising:

a liquid chamber for containing said recording liquid;

a fluid connection aperture for causing the liquid chamber to communicate with a recording liquid supply system of said recording apparatus upon mounting on said recording apparatus;

an information memory medium which holds information including information relating to said liquid container and in which said information can be renewed or added by linkage with said recording apparatus; and an information memory medium unit to engage, upon mounting on said recording apparatus, with information exchange means of said recording apparatus and adapted to guide said information memory medium to a position capable of communication with said recording apparatus;

wherein said information memory medium unit is capable of changing position and direction with respect to said fluid connection aperture according to the position and direction of the information exchange means of said recording apparatus.

2. Liquid container according to claim 1, further comprising an information memory medium unit containing portion provided with an internal space having an information memory medium connecting aperture in a connecting direction with the connector of said recording apparatus and having a size capable of containing said information memory medium unit without contact thereto;

wherein said information memory medium unit is contained in a freely movable manner in said information memory medium unit containing portion.

3. A liquid container according to claim 2, wherein the external surface of said information memory medium unit and the internal surface of said information memory medium unit containing portion are provided with a projection or a recess adapted for mutual impingement to limit the movable range of said information memory medium unit.

4. A liquid container according to claim 2, wherein said information memory medium unit is composed of an information memory medium holder having a connection aperture and a connection aperture rim protruding around said connection aperture in the direction of said aperture, and an information memory medium provided with a contact portion fixed in said connection aperture and adapted to be electrically connected with the connector of said recording apparatus; and said information memory medium holder is contained in said information memory medium unit containing portion in such a manner that said connection aperture rim is exposed from said information memory medium connecting aperture, and is limited within such a movable range that a gap at least equal to a predetermined amount is formed between said connection aperture rim and the rim of said information memory medium connecting aperture and that a gap at least equal to a predetermined amount is formed between a face in which said connection aperture rim is formed and the internal wall of said information memory medium unit containing portion.

5. A liquid container according to claim 4, wherein the rim of said information memory medium connecting aperture is provided with a capillary groove capable of guiding said recording liquid by a capillary force.

6. A liquid container according to claim 1, wherein said information memory medium unit and the connector of said recording apparatus mutually engage by insertion of a projection formed on either into a recess formed on the other, said projection is provided with a tapered portion pointed in the inserting direction into said recess, and said recess is provided with a tapered portion pointed in the inserting direction of said projection.

7. A liquid container according to claim 2, wherein said information memory medium unit is so formed that said information memory medium connecting aperture and said fluid connection aperture are present on a same external face of said liquid container.

8. A liquid container according to claim 2, wherein said fluid connection aperture includes two fluid connection apertures.

9. A liquid container according to claim 8, wherein said two fluid connection apertures and said information memory medium connecting aperture are formed on a same external face of said liquid container, and, on said external face, said two fluid connection apertures are positioned in mutually adjacent manner at an end of said external face while said information memory medium unit is positioned at the external end side of said external face.

10. A liquid container according to claim 8, wherein one of said two fluid connection apertures is used for the supply of said recording liquid to said recording apparatus, and the other is used for introduction of fluid into said liquid chamber.

11. A liquid container according to claim 10, wherein said fluid is introduced into said liquid chamber so as to substantially cancel the pressure decrease in said liquid chamber resulting from discharge of said recording liquid.

12. A liquid container according to claim 10, wherein said fluid is liquid.

13. A liquid container according to claim 10, wherein said fluid is air.

14. A liquid container according to claim 10, wherein said fluid is said recording liquid or liquid equivalent to said recording liquid.

15. A liquid container according to claim 1, wherein said recording apparatus is an ink jet recording apparatus capable of discharging and depositing said recording liquid on said recording medium.

16. A liquid container according to claim 1, wherein said information exchange means is an antenna for wireless communication.

17. A liquid container according to claim 1, wherein said information exchange means is a connector to be electrically connected with said information memory medium.

18. A liquid container according to claim 2, wherein said information memory medium unit is contained in a space having a face including said information memory medium connecting aperture and formed by said information memory medium unit containing portion, and said liquid container further comprises a guard portion having a connection finger adapted to engage with a connecting portion provided in said liquid chamber and to perform an elastic deformation in response to an external stress.

19. A liquid container according to claim 1, wherein said liquid container is detachably mountable in a mounting slot of said recording apparatus and is provided, on the external periphery, with an identifying portion corresponding to a mounted side identifying portion provided on the internal wall of said slot and adapted to judge, at an inserting operation, whether said liquid container is to be inserted into said slot.

20. A liquid container according to claim 19, wherein said identifying portion is provided in the vicinity of the inserting end of said liquid container and is provided with an identifying recess in which, when opposed to an identifying rib of said mounted side identifying portion of said slot, said identifying rib can be inserted, and an identifying projection to impinge on said identifying rib when opposed to said identifying rib, and said identifying projection has an inverted T-shape of which longitudinal direction is along the inserting direction.

21. A liquid container according to claim 19, wherein said identifying portion is provided in the vicinity of the inserting end of said liquid container and is provided with an identifying recess in which, when opposed to an identifying rib of said mounted side identifying portion of said slot, said identifying rib can be inserted, and an identifying projection to impinge on said identifying rib when opposed to said identifying rib, and said identifying projection has a T-shape of which longitudinal direction is along the inserting direction.

22. A liquid container according to claim 19, wherein said identifying portion is provided in the vicinity of the inserting end of said liquid container and is provided with an identifying recess in which, when opposed to an identifying rib of said mounted side identifying portion of said slot, said identifying rib can be inserted, and an identifying projection to impinge on said identifying rib when opposed to said identifying rib, and the width of the face bearing said identifying portion is narrower than the internal width of said slot in a portion bearing said mounted side identifying portion by a distance A smaller than the difference B between the width of said identifying recess and the width of said identifying rib.

23. A liquid container according to claim 19, wherein said identifying portion is provided on each of a pair of mutually opposed lateral faces.

24. A liquid container according to claim 20, wherein said identifying portion is provided on each of a pair of mutually opposed lateral faces.

25. A liquid container according to claim 21, wherein said identifying portion is provided on each of a pair of mutually opposed lateral faces.

26. A liquid container according to claim 22, wherein said identifying portion is provided on each of a pair of mutually opposed lateral faces.

27. A liquid container according to claim 19, wherein said identifying projection has such a length as to always come into impingement of an identifying rib of said mounted side identifying portion of said slot when said identifying projection is in a position opposed to the identifying rib of said mounted side identifying portion of said slot, even when said liquid container is inserted in a position inclined with respect to said slot.

28. A liquid container according to claim 20, wherein said identifying recess is a portion formed by cutting off a projection which is formed between plural support pillars for connecting adjacent ones of said support pillars, and said identifying projection is a remaining portion of a projection which is formed between said plural support pillars for connecting adjacent ones of said support pillars.

29. A liquid container according to claim 28, wherein the end faces of said support pillars in the inserting direction and the end faces of said identifying projections in the inserting direction are in a same plane.

30. A liquid container according to claim 28, wherein said projection is formed thinner than said support pillar, and the length of said projection in the longitudinal direction thereof at the connecting portion with said support pillars is shorter than the entire length of said projection in the longitudinal direction.

31. A liquid container according to claim 23, wherein said identifying portions are formed asymmetrically in such a manner, when the liquid container is inverted by 180° about a central axis along the inserting direction, the positions of said identifying projection and said identifying recess in said identifying portions are displaced substantially by a half pitch.

32. A liquid container according to claim 24, wherein said identifying portions are formed asymmetrically in such a manner, when the liquid container is inverted by 180° about a central axis along the inserting direction, the positions of said identifying projection and said identifying recess in said identifying portions are displaced substantially by a half pitch.

33. A liquid container according to claim 25, wherein said identifying portions are formed asymmetrically in such a manner, when the liquid container is inverted by 180° about a central axis along the inserting direction, the positions of said identifying projection and said identifying recess in said identifying portions are displaced substantially by a half pitch.

34. A liquid container according to claim 26, wherein said identifying portions are formed asymmetrically in such a manner, when the liquid container is inverted by 180° about a central axis along the inserting direction, the positions of said identifying projection and said identifying recess in said identifying portions are displaced substantially by a half pitch.

35. A liquid container according to claim 19, wherein said fluid connection aperture capable of passing liquid is positioned on a face substantially perpendicular to the inserting direction and positioned at the front end in the inserting direction.

36. A liquid container according to claim 35, wherein said identifying portion is provided close to the face bearing said fluid connection aperture.

37. A liquid container according to claim 35, wherein said identifying portion is provided on a face substantially perpendicular to the face bearing said fluid connection aperture.

38. A liquid container according to claim 21, containing recording ink, wherein the number and position of said identifying projection and said identifying recess are determined according to the color and type of the contained ink.

39. An ink jet recording apparatus comprising a slot constructed to detachably mount the liquid container according to any of claims 1 to 38.

* * * * *